US006288352B1

(12) United States Patent
Fukui et al.

(10) Patent No.: US 6,288,352 B1
(45) Date of Patent: Sep. 11, 2001

(54) PUSH-BUTTON SWITCH, AND OPERATION DEVICE AND TEACHING PENDANT COMPRISING THE SAME

(75) Inventors: Takao Fukui; Yasushi Kamino; Kenji Inoue; Shigetoshi Fujitani; Shigeto Ogino; Toshihiro Fujita; Akito Okamoto; Yoshitaka Tsuji, all of Osaka (JP)

(73) Assignee: Idec Izuni Corporation, Osaka (JP)

( * ) Notice: Subject to any disclaimer, the term of this patent is extended or adjusted under 35 U.S.C. 154(b) by 0 days.

(21) Appl. No.: 09/415,497

(22) Filed: Oct. 12, 1999

Related U.S. Application Data

(63) Continuation of application No. PCT/JP98/01943, filed on Apr. 27, 1998.

(30) Foreign Application Priority Data

Apr. 28, 1997 (JP) ..... 9-125008
Sep. 30, 1997 (JP) ..... 9-284434
Sep. 30, 1997 (JP) ..... 9-284435

(51) Int. Cl.[7] ..... H01H 13/00; H01H 9/00

(52) U.S. Cl. ..... 200/435; 200/1 R; 200/16 A; 200/51 LM; 200/298; 200/523

(58) Field of Search ..... 200/1 R, 16 R–16 D, 200/17 R, 17 B, 1 B, 51 LM, 520, 521, 530, 532, 534, 535, 341, 298, 405, 431, 434, 435, 438, 441, 449, 523, 524

(56) References Cited

U.S. PATENT DOCUMENTS 4,216,358 * 8/1980 Brozille ..... 200/67 D
5,115,179 5/1992 Fujii et al. ..... 318/568.13
5,665,945 * 9/1997 Oshima ..... 200/1 R
6,057,521 * 5/2000 Krebs et al. ..... 200/298

FOREIGN PATENT DOCUMENTS 735 643 5/1943 (DE) .
0 702 384 3/1996 (EP) ..... H01H/13/64
59-138142 9/1984 (JP) ..... H01H/25/04
2-65834 5/1990 (JP) ..... H01H/13/18
7-262865 10/1995 (JP) ..... H01H/9/24
8-241649 * 3/1996 (JP) ..... H01H/21/22

* cited by examiner

*Primary Examiner*—Michael Friedhofer
(74) *Attorney, Agent, or Firm*—Griffin & Szipl, P.C.

(57) ABSTRACT

A push-button switch provided with a hollow push button, a case supporting it, and a switching mechanism having a first contact disposed within the case and a second contact disposed opposite to the first contact, with one of its ends being inserted into a hole of the push button. Within a hole formed in an inserted section of the switching mechanism, a slide block is provided slidably in a direction crossing the direction in which the push button is pushed. A slope capable of engaging with a slope of the hole of the push button is formed on the slide block. A coil spring (return spring) for energizing a shaft of the switching mechanism so as to abut the push button is provided on the bottom of the case. This configuration enables the push button to take up a first OFF state, an ON state and a second OFF state in order of depression.

27 Claims, 61 Drawing Sheets

PUSH-BUTTON SWITCH, AND OPERATION DEVICE AND TEACHING PENDANT COMPRISING THE SAME

This application is a Continuation of International Application No. PCT/JP98/01943, filed Apr. 27, 1998, which claims priority based on Japanese Patent Application No. 9-125008, filed Apr. 28,1997; Japanese Patent Application No. 9-284434, filed Sep. 30,1997; and Japanese Patent Application No. 9-284435, filed Sep. 30,1997. The entire disclosures of the above applications are hereby incorporated herein by reference.

BACKGROUND OF THE INVENTION

1. Field of the Invention

The present invention relates to a push-button switch and more particularly, to a push-button switch which is shifted from an initial or first OFF state to an ON state and then, to a second OFF state as the amount of depression of the push-button increases.

2. Description of the Background Art

In cases where, for example, a manual operation is performed on a numerically controlled machine such as a robot, an operator often enters a dangerous area to carry out his job. In such cases, a pendant with a push-button, such as called an enable switch (or deadman switch), is used for preventing the occurrence of an accident during the work.

This pendant is a portable unit which is enabled by connection with an operation device to teach a program to the robot or operate the robot. As shown in FIG. 80, the pendant 500 includes an input keyboard 501 disposed on a main surface and a push-button switch (enable switch) 502 disposed on one side surface thereof. Incidentally, the push-button switch 502 may be sometimes disposed on the rear side of the pendant 500. The pendant 500 further includes a signal cable 503 for connection with the operation device not shown.

As shown in FIG. 77, a conventional push-button switch 502 includes a push button 505 and a microswitch 506 disposed opposite to the push button. Disposed on a lower surface of the push button 505 is a leaf spring 507 extended downwardly therefrom. Disposed on a top surface of the microswitch 506 are a resilient push plate 508 and an actuator 509. A bent portion 507*a* is formed at a tip of the leaf spring 507.

When the push-button switch 502 is used, the pendant 500 incorporating the push-button switch 502 is first connected, via the signal cable 503, to a control panel of a machine to be manually operated. If the push-button switch is in the OFF state at this time, manipulating the keyboard 501 of the pendant 500 does not effect the key entry.

Upon subsequent depression of the push button 505, the bent portion 507*a* of the leaf spring 507 moving along with the push button 505 engages the push plate 508 of the microswitch 506, and the push plate 508 is resiliently deformed downward to press down the actuator 509, as shown in FIG. 78. This causes the actuator 509 to lower for establishing contact between contacts within the microswitch 506, thereby shifting the microswitch 506 to the ON state.

The operator keys in through the keyboard 501 of the pendant while keeping the push button 505 depressed for maintaining the microswitch in the ON state. If, at this time, the operator releases the push button 505, sensing the danger of contacting some moving part of the machine manually operated, the push button 505 returns to the state shown in FIG. 77 for turning OFF the microswitch 506. Thus, the machine is stopped.

In a case where the operator, who has panicked sensing imminent danger, further presses down the push button 505, the bent portion 507*a* of the leaf spring 507 slides on the push plate 508 to disengage therefrom, as shown in FIG. 79, so that the push plate 508 is returned to its original position by its restoring force. This shifts the microswitch 506 to the OFF state for stopping the machine.

Thus, the push-button switch 502 is adapted to enable the keyboard 501 of the pendant 500 or permits the key entry through the keyboard 502 for manual operation only when the microswitch 506 is in the ON state. Therefore, the operator's intent at the manual operation can be made distinct and hence, the operator's safety is ensured.

However, the known push-button switch is arranged such that the switch is maintained in the ON state by the engagement of the leaf spring and shifted to the OFF state by disengagement thereof which results from increased elastic deformation thereof. Accordingly, precisions of the leaf springs significantly affect a timing of shift between the ON and OFF states.

Therefore, the switch may sometimes be quick to be shifted from the ON state to the OFF state or slow to be shifted depending upon the variations of the leaf springs. Thus, the switch suffers from unstable operation and poor switching accuracy.

SUMMARY OF THE INVENTION

It is therefore, an object of the present invention to provide a push-button switch adapted for stable operation.

Another object of the invention is to provide a push-button switch capable of forcibly separating the contacts for shifting the switch to the OFF state, even if they are fused to each other, thereby providing even more stable operation of the switch.

It is still another object of the invention to provide a push-button switch which provides good operability and a positive shift to the OFF state in the event of an emergency when used as the enable switch of a teaching pendant for industrial manipulating robots.

DETAILED DESCRIPTION OF THE PREFERRED EMBODIMENTS (First Embodiment)

A first embodiment of the invention will be described with reference to FIGS. 1 to 9.

Figure 1:
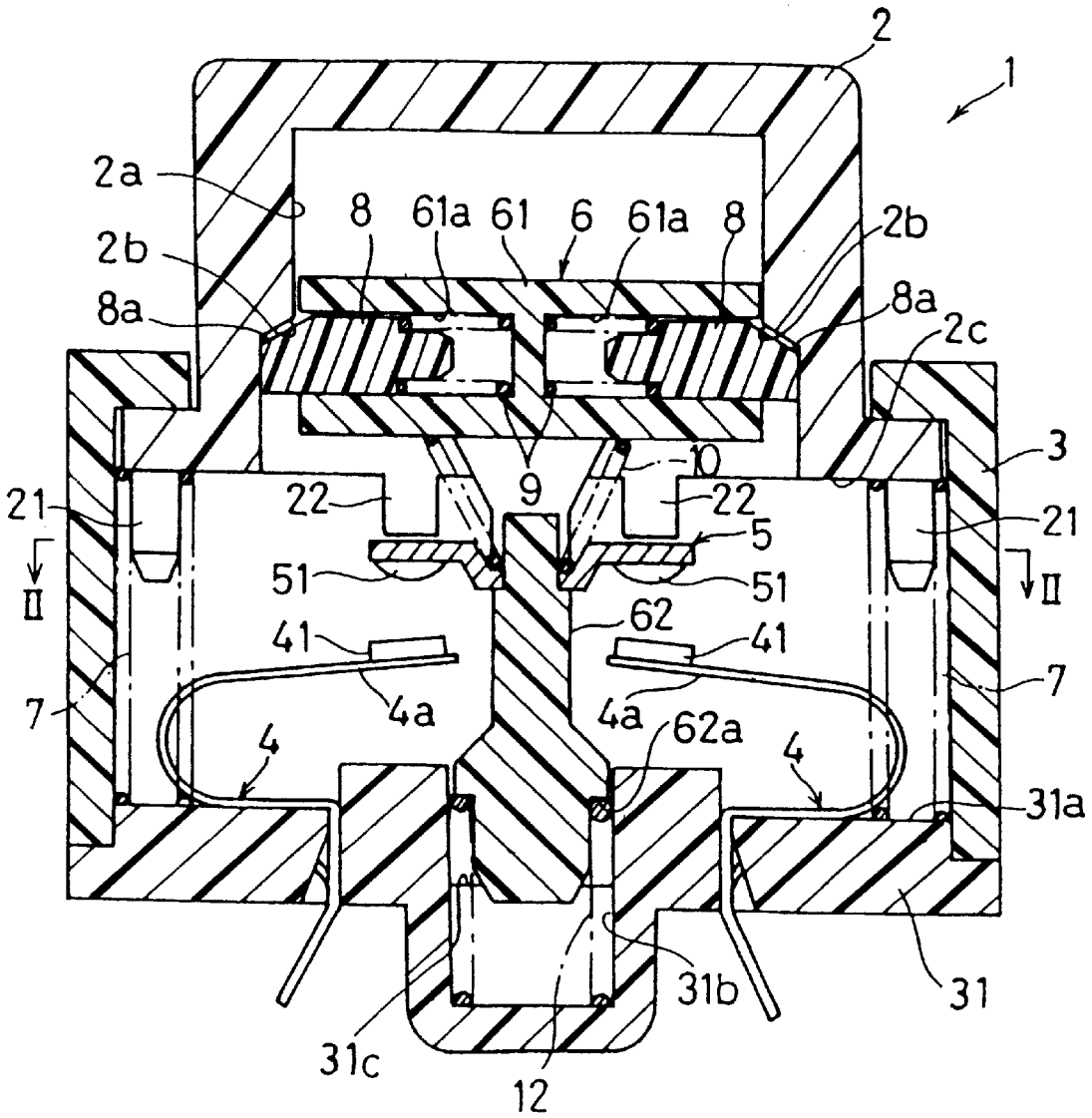
FIG. 1 is a sectional front view showing a push-button switch according to a first embodiment of the invention.
Figure 2:
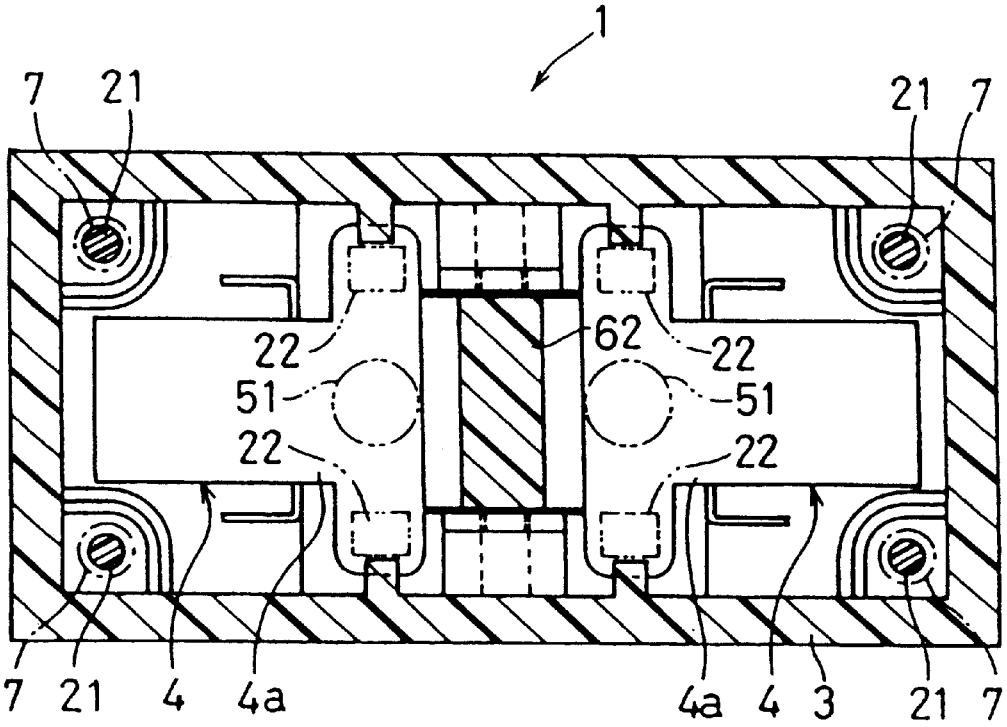
FIG. 2 is a sectional top plan view taken on the line II—II in FIG. 1.

FIG. 1 is a sectional front view showing a push-button switch according to the first embodiment; FIG. 2 a sectional top plan view taken on the line II—II in FIG. 1; FIGS. 3 to 8 sectional front views for illustration of operations of the push-button switch; and FIG. 9 a graph representing a relation between the operating load and the operation stroke of a push button.

As seen in FIG. 1, a push-button switch 1 includes a hollow push button 2 of a substantially rectangular parallelepiped shape, a case 3 for supporting the push button 2, and a switching mechanism 6 having an electrically conductive stationary terminal 4 fixed to a bottom 31 of the case 3 and an electrically conductive movable terminal 5 disposed above the stationary terminal 4.

The push button 2 is formed with a concave hole 2*a* on its lower side so as to be hollowed, and is stepped substantially at midportions on the right and left sides of the hole 2*a*. Both the stepped portions of the hole 2*a* are formed with slopes 2*b*,2*b*, respectively. Projected downwardly of a bottom of the push button 2 are a plurality of support shafts 21, each of which carries thereabout a coiled spring 7 having a greater length than the shaft. An upper end of each coiled spring 7 is locked to a lower surface 2*c* of the push button 2 whereas a lower end thereof is locked to a bottom surface 31*a* of the bottom 31. The push button 2 is constantly urged upward by a spring force of each coiled spring 7.

The stationary terminal 4 is comprised of a bent member disposed in the case 3 and substantially shaped like "T" as viewed in plan (see FIG. 2). Such a bent portion 4*a* has resilience or spring characteristics with respect to vertical directions. A first contact 41 is affixed to a distal end of the bent portion 4*a*.

An upper part of the switching mechanism 6 is inserted in the hole 2*a* of the push button 2. The inserted portion 61 of the switching mechanism is formed with a pair of lateral holes 61*a*, 61*a* extending in a transverse direction which is orthogonal to a direction of depression of the push button 2.

Slide blocks 8 are transversely slidably inserted in the holes 61*a*, 61*a*, respectively. The slide blocks 8, 8 are formed with slopes 8*a*, 8*a* capable of engaging the respective slopes 2*b* of the hole 2*a* of the push button 2. Inserted in the respective holes 61*a*, 61*a* are coiled springs 9, 9, which urge the slide blocks 8 in directions to project the slide blocks from the holes 61*a*, respectively.

A shaft 62 extending downward is disposed at a lower part of the switching mechanism 6. The movable terminal 5 is vertically slidably carried by an upper end portion of the shaft 62. Second contacts 51 are affixed to lower surfaces of opposite ends of the movable terminal 5, respectively. A truncated cone-shaped coiled spring 10 applies a downward spring force to an upper portion of the movable terminal 5. The coiled spring 10 is disposed to ensure a contact pressure when the second contacts 51 of the movable terminal 5 come into contact with the first contacts of the stationary terminal 4.

A bottom portion of the shaft 62 is inserted in a hole 31*b* defined in the bottom 31 of the case 3. Disposed in the hole 31*b* is a coiled spring 12 serving as a return spring. An upper portion of the coiled spring 12 is mounted on a boss-shaped portion as wound thereabout, the boss-shaped portion formed in a smaller diameter at a lower end of the shaft 62. The shaft 62 is constantly urged upward by a spring force of the coiled spring 12. Within the hole 31*b*, there is formed a stopper surface 31*c*, against which a stepped portion 62*a*, a base of the boss-shaped portion of the shaft 62, is to abut.

Respective pairs of projections 22 extend downward from forward and backward places of the bottom of the push button 2. These projections are equivalent to forcible separation means. As shown in FIG. 2 in particular, the respective pairs of projections 22 are so located as to sandwich the movable terminal 5 therebetween as allowed to abut against respective ends of the stationary terminal 4 without touching the movable terminal 5.

In a first OFF state or initial state in which the push button 2 is not depressed, as shown in FIG. 1, the push button 2 is placed at an initial position by the spring force of the coiled springs 7 so that the first and second contacts 41, 51 are spaced from each other to define a gap therebetween. On the other hand, the slopes 8*a* of both slide blocks 8, 8 are engaged with the slopes 2*b* of the hole 2*a* of the push button 2. The switching mechanism 6 is interlocked with the depression of the push button 2 via this engagement.

Next, operations of the push-button switch 1 according to this embodiment will be described with reference to FIGS. 3 to 8.

Figure 3:
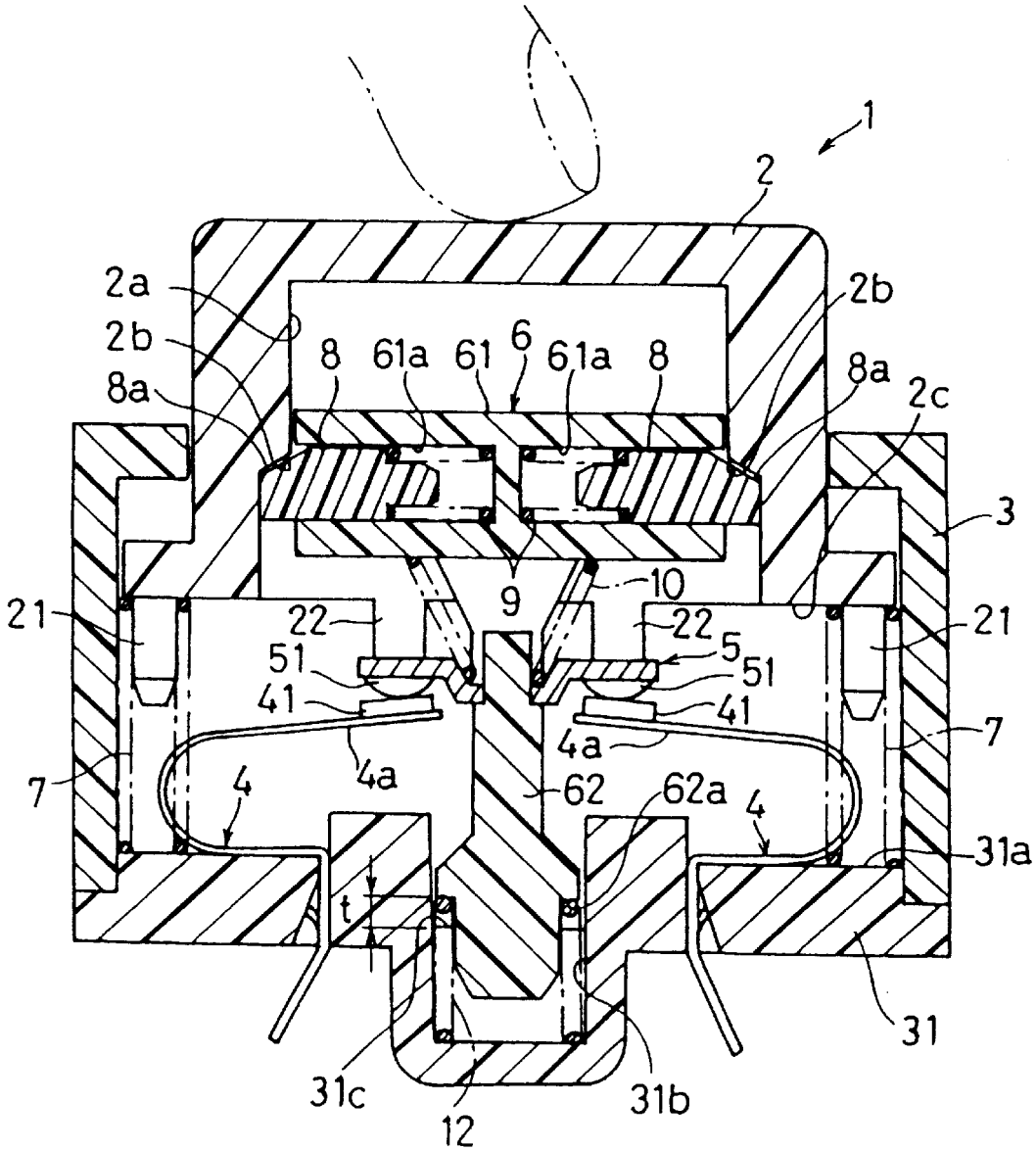
FIG. 3 is a sectional front view for illustration of operation of the push-button switch according to the first embodiment.

If the push button 2 is depressed in the first OFF state shown in FIG. 1, because of the engagement between the slopes 8*a* of the slide blocks 8 and the slopes 2*b* of the push button 2, the switching mechanism 6 is lowered along with the push button 2 thereby bringing the second contacts 51 of the movable terminal 5 of the switching mechanism 6 into contact with the first contacts 41 of the stationary terminal 4 of the case 3, as shown in FIG. 3. Thus, the switch is shifted to an ON state.

In this ON state, the slopes 8*a* of the slide blocks are subject to a pressing force from the slopes 2*a* of the hole 2*a* of the push button 2, the force acting to retract the slide blocks 8 inwardly. However, the spring force of the coiled springs acting to project the slide blocks outwardly dominates this pressing force and hence, the slide blocks 8 are not retracted into the holes 61*a*.

At this time, within the hole 31*b* of the bottom 31 of the case 3, a gap t is defined between the stepped portion 62*a* of the shaft 62 of the switching mechanism 6 and the stopper surface 31*c* in.

Figure 4:
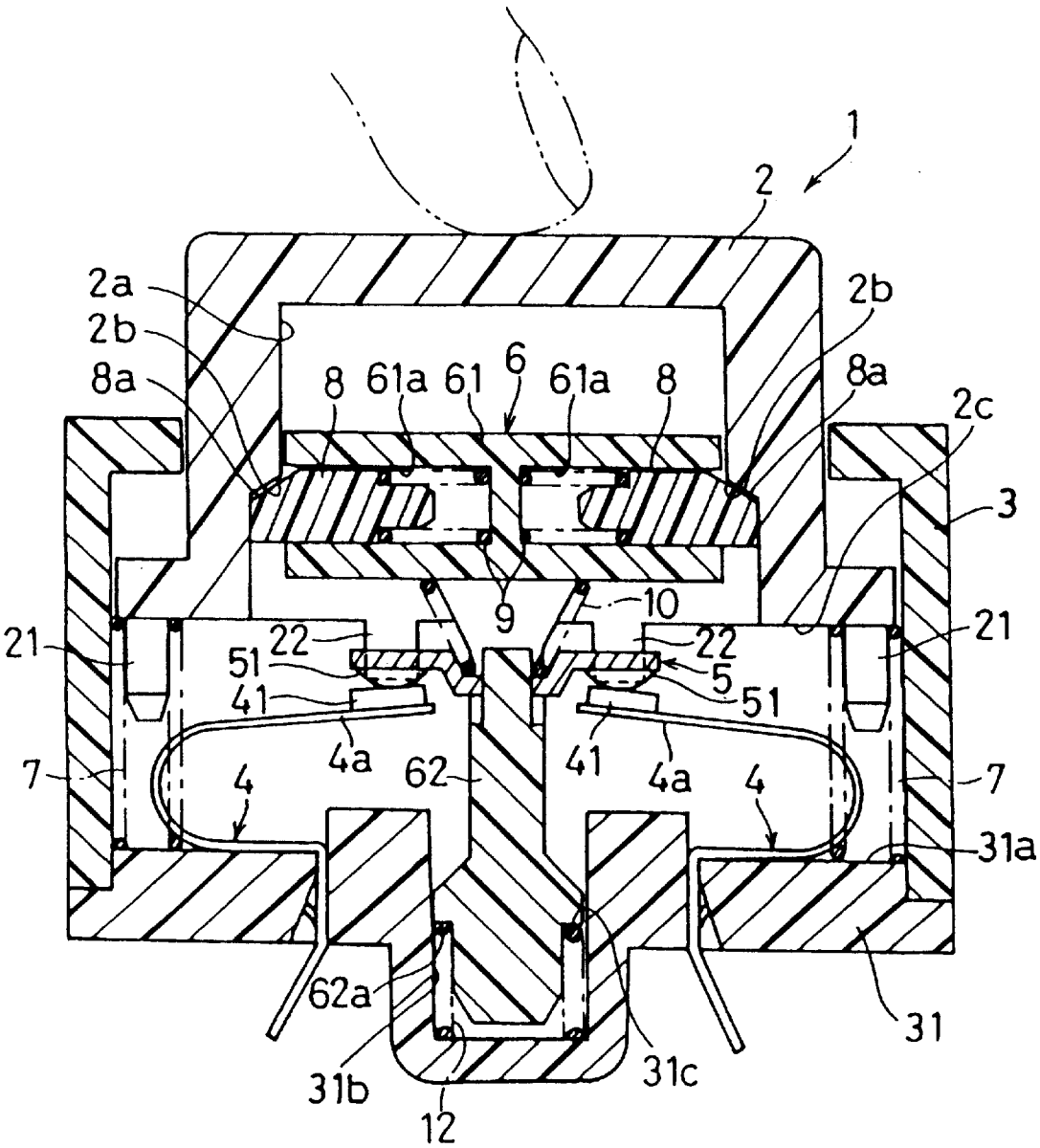
FIG. 4 is a sectional front view for illustration of the operation of the push-button switch according to the first embodiment.

Subsequently, if the push button 2 is further pressed down in the ON state shown in FIG. 3, the stepped portion 62*a* of the shaft 62 of the switching mechanism 6 abuts against the stopper surface 31*a* of the case bottom 31, thereby to reduce the gap t to zero, while the second contacts 51 of the movable terminal 5 stay in contact with the first contacts 41 of the stationary terminal 4, as shown in FIG. 4. At this time, as indicated by a broken line in FIG. 4, the projections 22 at the bottom of the push button 2 overlap with the movable terminal 5 with respect to a direction perpendicular to the drawing sheet.

Figure 5:
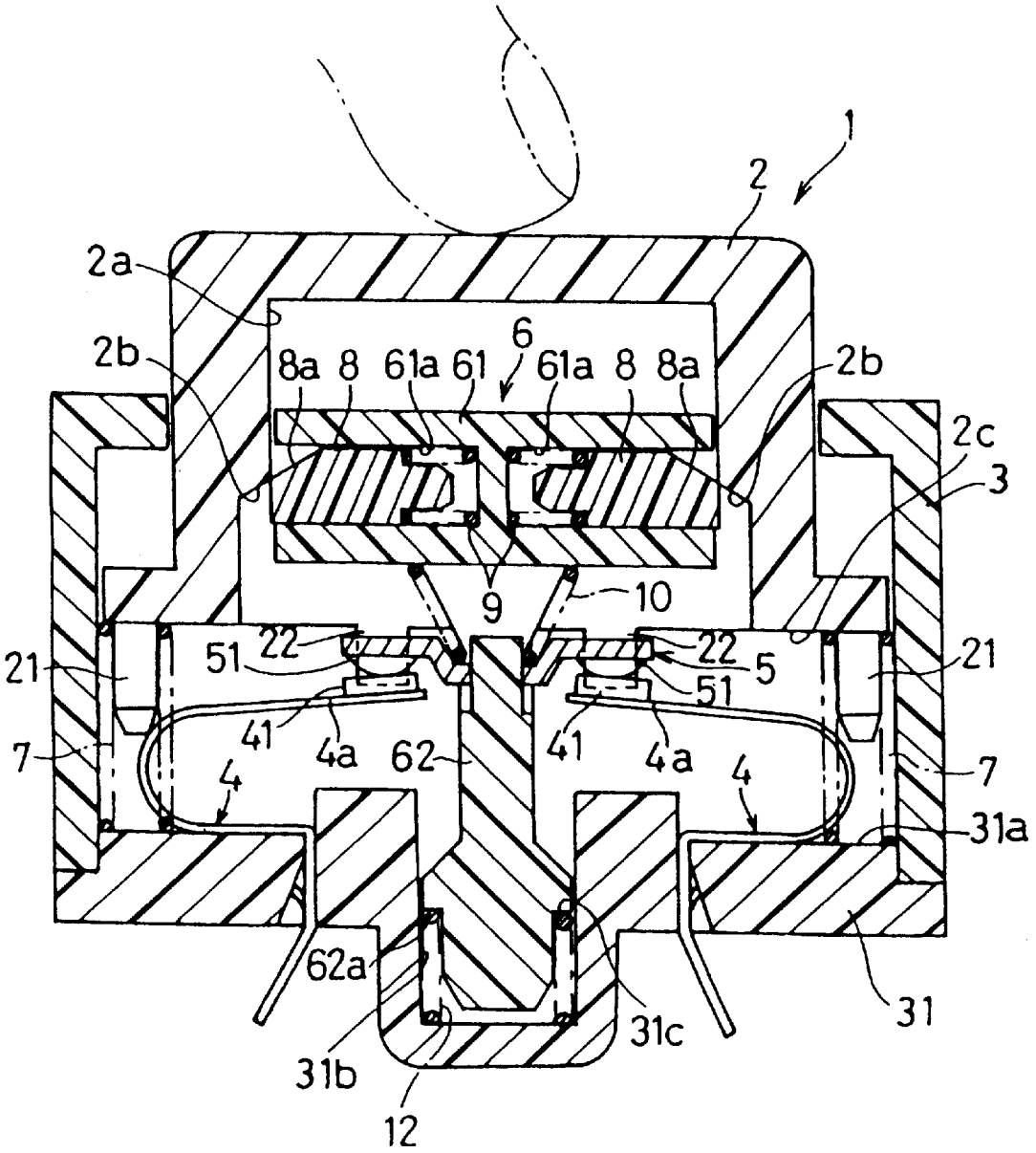
FIG. 5 is a sectional front view for illustration of the operation of the push-button switch according to the first embodiment.

If the push button 2 in this state is further pressed down, the pushing force applied by the push button 2 to the slopes 8*z* of the slide blocks 8 becomes dominant over the spring force of the coiled springs 9 so that the slopes 8*a* of the slide blocks 8 start sliding on the slopes 2*b* of the push button 2 and the slide blocks 8 start to slide into the holes 61*a*, as shown in FIG. 5. Eventually, the slide blocks 8 are completely retracted into the holes 61*a* whereby the slopes 8*a* of the slide blocks 8 are disengaged from the slopes 2*b* of the push button 2. This permits the upper part of the switching mechanism 6 to move up and down in the hole 2*a* of the push button 2 thereby releasing the switching mechanism 6 from the interlocked relation with the depression of the push button 2.

Figure 6:
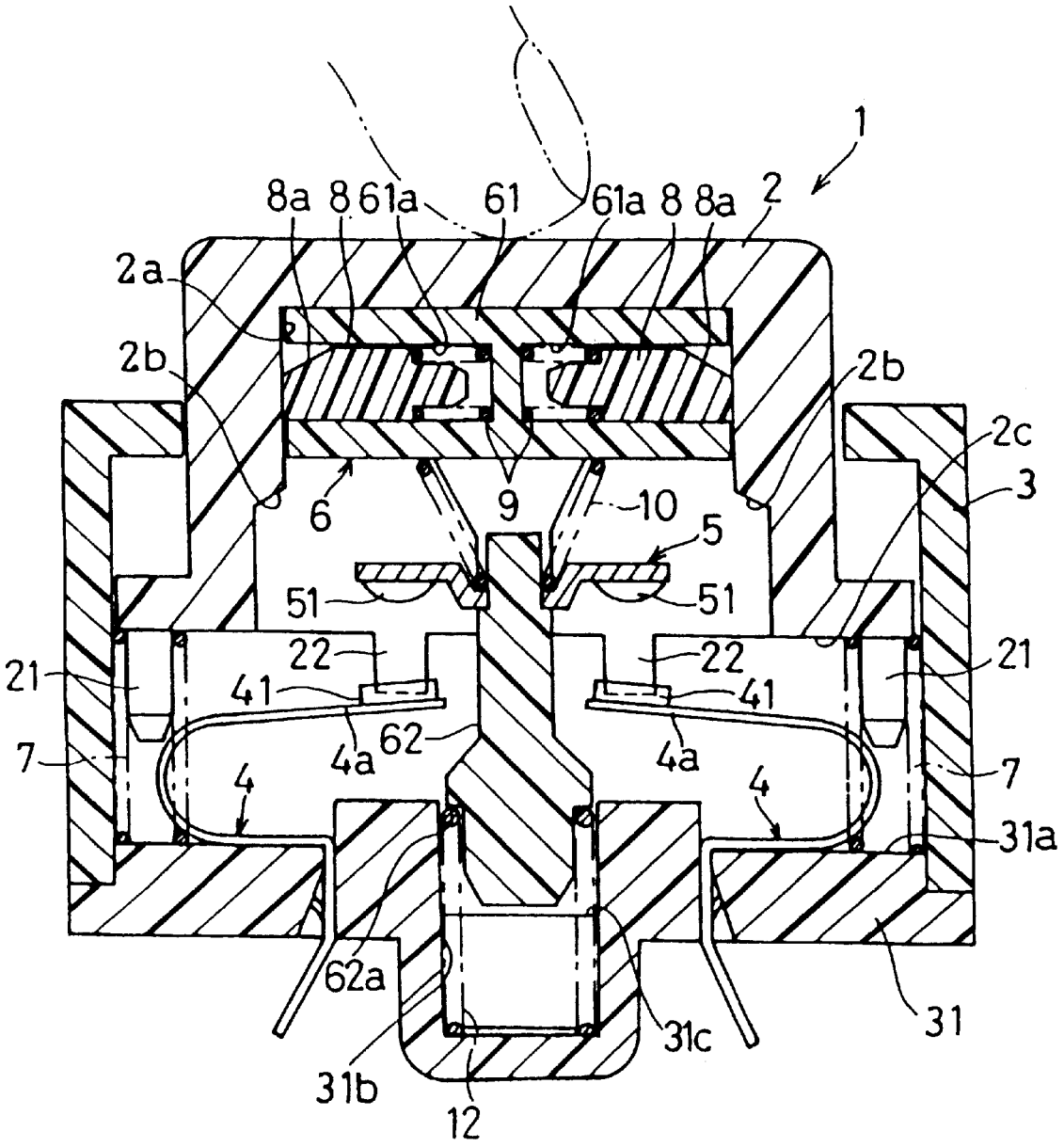
FIG. 6 is a sectional front view for illustration of the operation of the push-button switch according to the first embodiment.

At this time, on the other hand, the coiled spring 12 in the hole 31*b* of the case bottom 31 is compressed so that the stepped portion 62*a* of the shaft 62 is subject to the spring force of the coiled spring 12, the force pushing the shaft 62 upward. Therefore, when the slopes 2*b* of the push button 2 are disengaged from the slopes 8*a* of the slide blocks 8, as mentioned supra, the spring force of the coiled spring 12 causes the upper part of the switching mechanism 6 to move upward in the hole 2*a* of the push button 2 and also the whole body of the switching mechanism 6 to move upward, as shown in FIG. 6. This separates the second contacts 51 of the movable terminal 5 from the first contacts 41 of the stationary terminal 4, shifting the switch to a second OFF state.

Thus, the switch is adapted for shifting from the ON state to the second OFF state in conjunction with the disengagement of the slopes 8*a* of the slide blocks 8 from the slopes 2*b* of the push button 2. Therefore, the switch is stably shifted from the ON state to the second OFF state, accomplishing stable switching operations.

Next, if the push button 2 is further pressed down in the second OFF state shown in FIG. 6, the projections 22 at the bottom of the push button 2 are pressed against the bent portions 4*a* of the stationary terminal 4 to push down the first contacts 41, thereby forcibly separating the first contacts 41 from the second contacts 51. Thus, the first and second contacts 41, 51 are forcibly brought out of contact even if the first and second contacts are fused to each other. This contributes to an even more positive switch shifting from the ON state to the second OFF state.

It is noted that instead of providing the projections 22 at the bottom of the push button 2, the whole lower end portion of the push button 2 may be used to push down the first contacts 41 of the stationary terminal 4. Otherwise, the projections may be disposed at the bent portions 4*a* of the stationary terminal 4.

Figure 8:
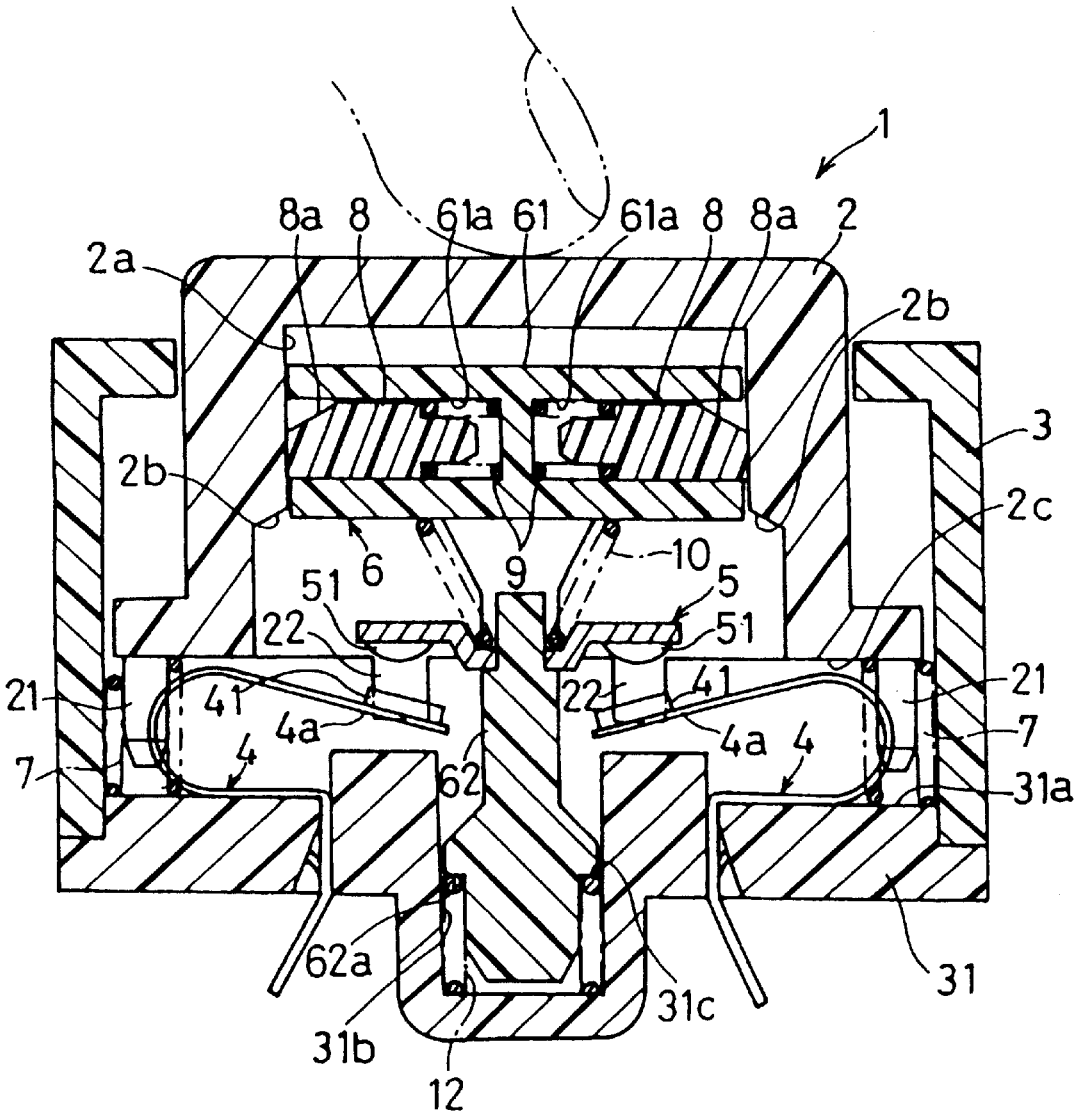
FIG. 8 is a sectional front view for illustration of the operation of the push-button switch according to the first embodiment.

In the state of FIG. 5, on the other hand, even if a breakage of the coiled spring 12 disables the coiled spring 12 to apply its spring force to the shaft 62 of the switching mechanism 6, the depression of the push button 2 permits the projections 22 at the bottom of the push button 2 to forcibly push down the first contacts 41 of the stationary terminals 4, thereby positively shifting the switch from the ON state to the second OFF state (see FIG. 8).

Now referring to FIG. 9, description will be made on a relation between the operating load applied to the push button 2 for manipulation of the push-button switch 1 and the operation stroke. It is noted that circled figures in the graph correspond to the drawing numbers, respectively.

Until the switch is shifted from the first OFF state ①, or an initial state shown in FIG. 1, through the ON state to a state ④ shown in FIG. 4, the operating load progressively increases with increase in the operation stroke. In the subsequent shift from the state ④ of FIG. 4 to a state ⑤ shown in FIG. 5, the operation stroke increases little while the operating load increases sharply. This is because a great load is required for plunging the slide blocks 8 inwardly.

In the subsequent shift from the state ⑤ of FIG. 5 to a state ⑥ shown in FIG. 6, the operation load drops abruptly. This is because the push button 2 is disengaged from the slide blocks 8. It is preferred that the push button 2 is operable with light touch when the operator, manipulating the switch in the ON state, panics to press down the push button forcefully. Hence, the switch is designed to shift smoothly from the ON state to the second OFF state by setting the operating load at a small value. At this time, the operator is also provided with a tactile click-touch (tactile feedback to the operation of the switch).

Figure 7:
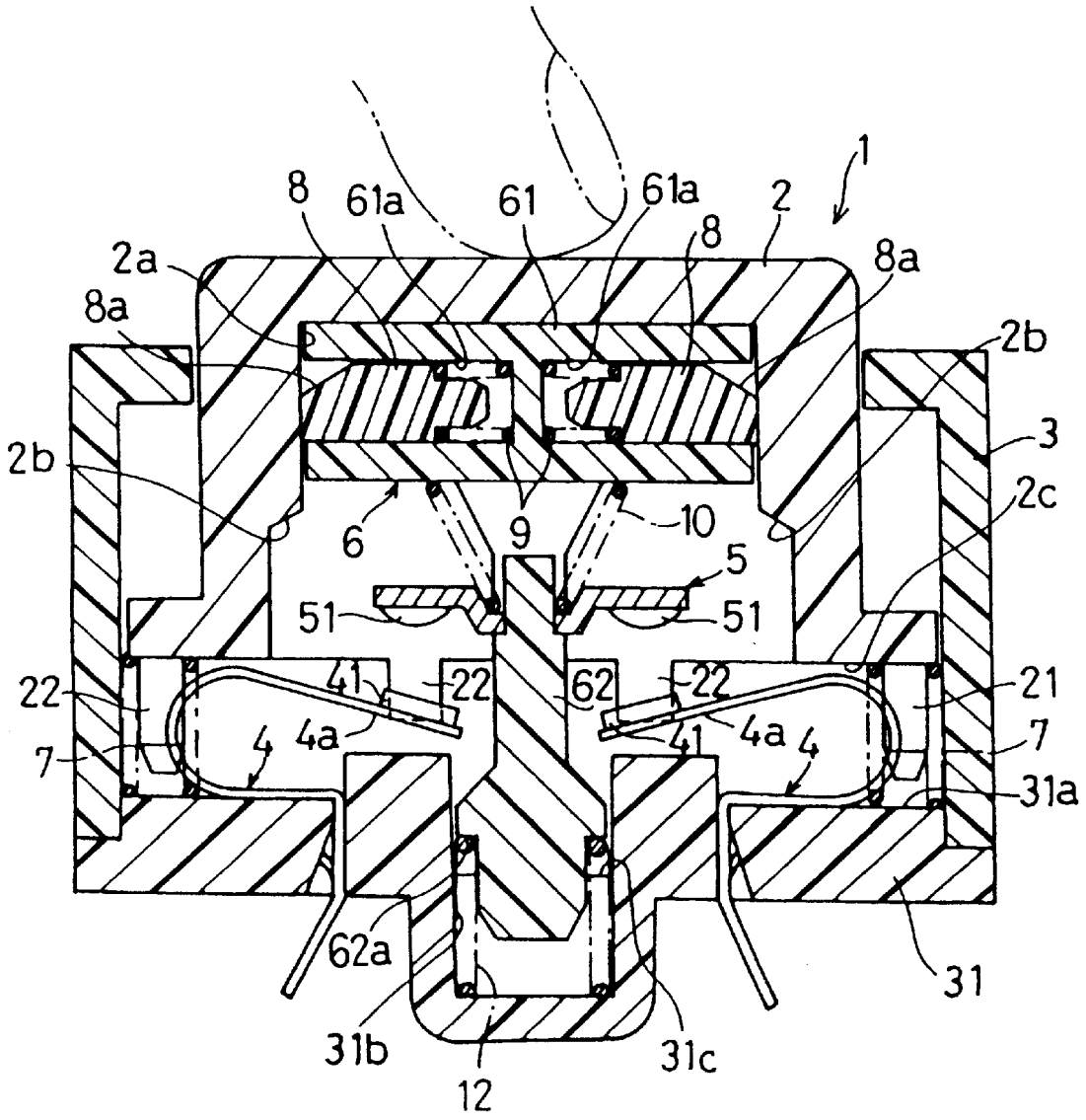
FIG. 7 is a sectional front view for illustration of the operation of the push-button switch according to the first embodiment.

In the subsequent shift from the state ⑥ of FIG. 6 to a state ⑦ shown in FIG. 7, the operating load progressively increases with the increase in the operation stroke. At this time, the projections 22 of the push button 2 progressively press down the contacts 41 of the stationary terminal 4.

According to the first embodiment, the switch is adapted for shifting from the ON state to the second OFF state in conjunction with the disengagement of the slopes 8*a* of the slide blocks 8 from the slopes 2*b* of the push button 2. Therefore, the switch is stably shifted from the ON state to the second OFF state for accomplishing the stable switching operations.

Further, when the switch is shifted from the ON state to the second OFF state, the upward movement of the switching mechanism 6 brings the second contacts 51 of the movable terminal 5 out of contact with the first contacts 41 of the stationary terminal 4 while the first contacts 41 are forcibly separated from the second contacts 51 by the projections 22 of the push button 2 pushing down the contacts 41. This ensures that the first and second contacts 41, 51 are separated from each other even if the contacts are fused to each other. Thus, the switch is positively shifted from the ON state to the second OFF state, accomplishing even more stable switching operations.

Further according to the first embodiment, the stationary terminal 4 is comprised of a single strap-like member. This contributes to a reduced number of components and a simplified construction of the switch.

Although the description of the first embodiment mentioned the projections 22, as the forcible separation means, which are integrally formed with the push button, the projections are not particularly required to be integrally formed. As a matter of course, the forcible separation means, such as the projections 22, may be formed independently from the push button 2 and affixed to the push button.

(Second Embodiment)

Next, a second embodiment of the invention will be described with reference to FIGS. 10 to 19.

Figure 10:
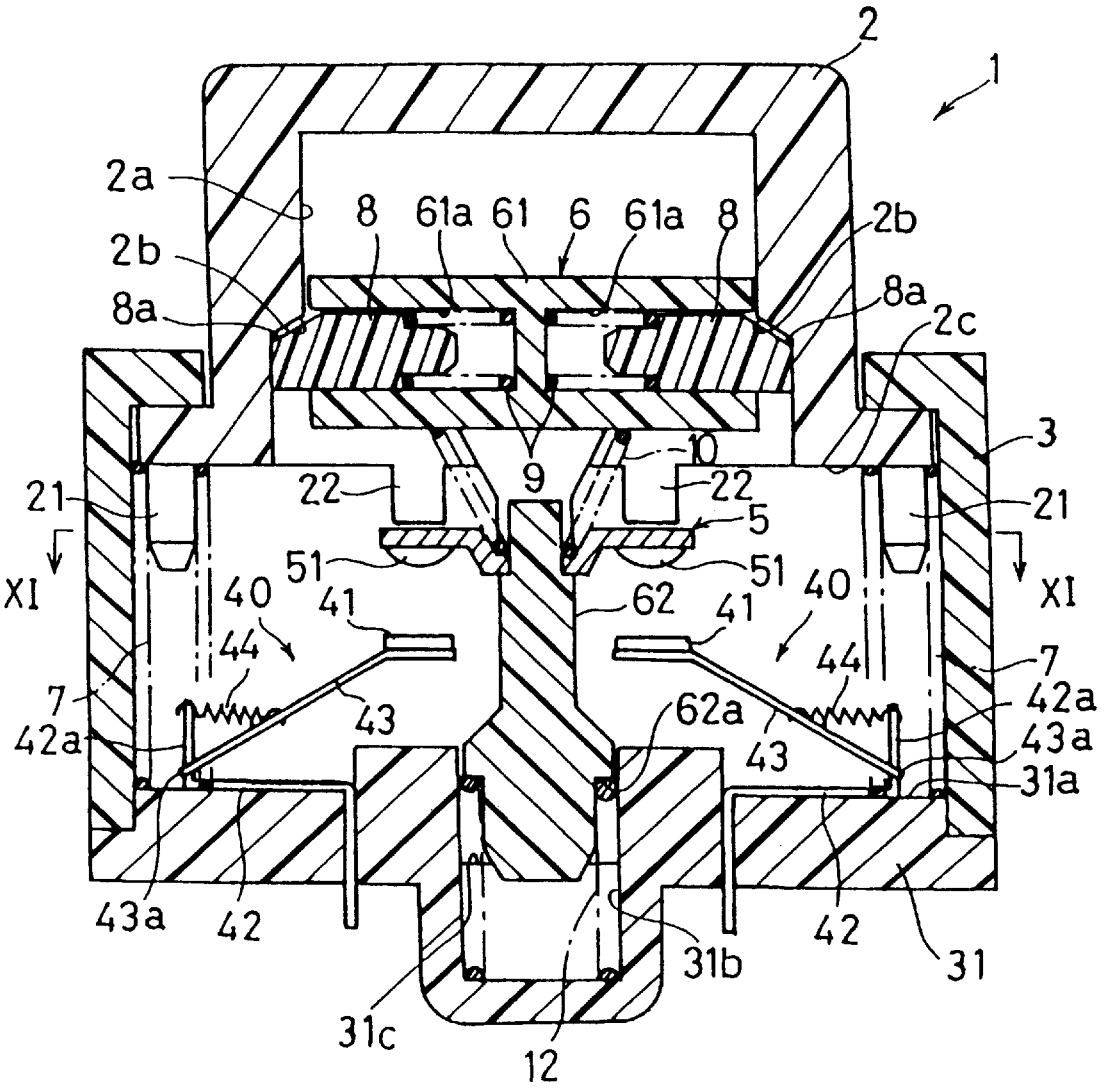
FIG. 10 is a sectional front view showing a push-button switch according to a second embodiment hereof.
Figure 11:
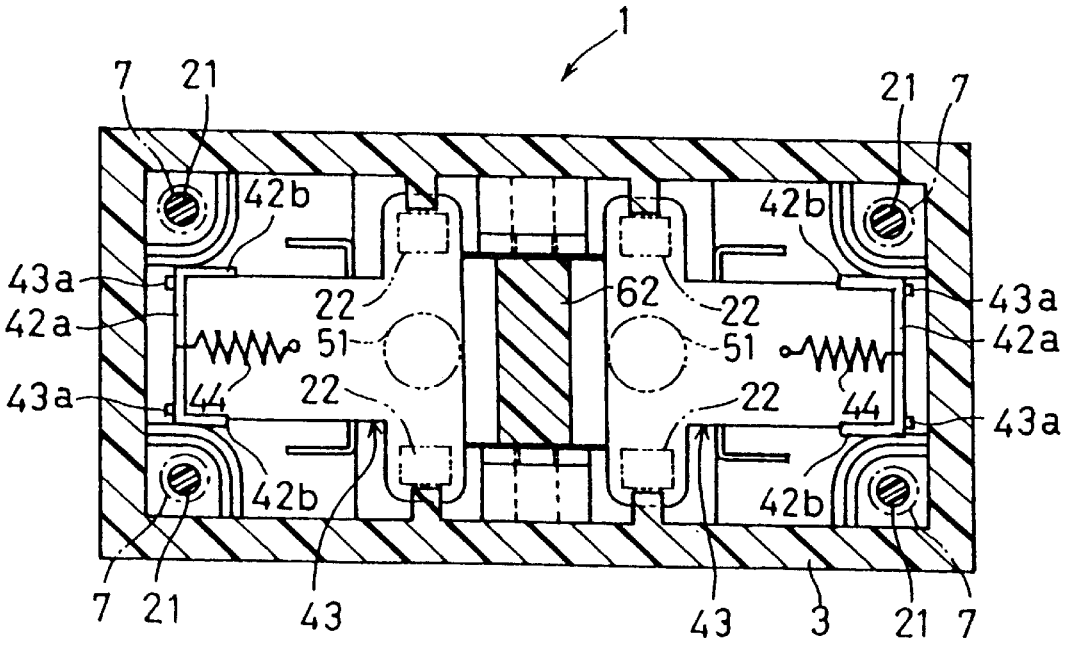
FIG. 11 is a sectional top plan view taken on the line XI—XI in FIG. 10.

FIG. 10 is a sectional front view showing a push-button switch according to the second embodiment of the invention; FIG. 11 a sectional top plan view taken on the line XI—XI in FIG. 10; FIGS. 12 to 17 sectional front views for illustration of operations of the push-button switch; and FIGS. 18 and 19 enlarged views showing the stationary terminal in the push-button switch. FIGS. 10 to 17 correspond to FIGS. 1 to 8 of the first embodiment, respectively. In the figures, the same reference characters with those of the first embodiment represent the same or equivalent portions, respectively.

The second embodiment differs from the first embodiment only in the construction of the stationary terminal. Therefore, this description focuses solely on the stationary terminal and a detailed explanation of the other portions is dispensed with.

In FIGS. 10 to 17, a stationary terminal 40 disposed at the bottom 31 of the case 3 essentially consists of a fixed metal piece 42 fixed to the bottom 31 and a movable metal piece 43 pivotally supported by the fixed metal piece 42.

An upright plate 42 extends upward from one end of the fixed metal piece 42. One end 43*a* of the movable metal piece 43 engages a lower end of the upright plate 42*a*. This arrangement permits the movable metal piece 43 to vertically pivot about the lower end of the upright plate 42*a*.

Figure 17:
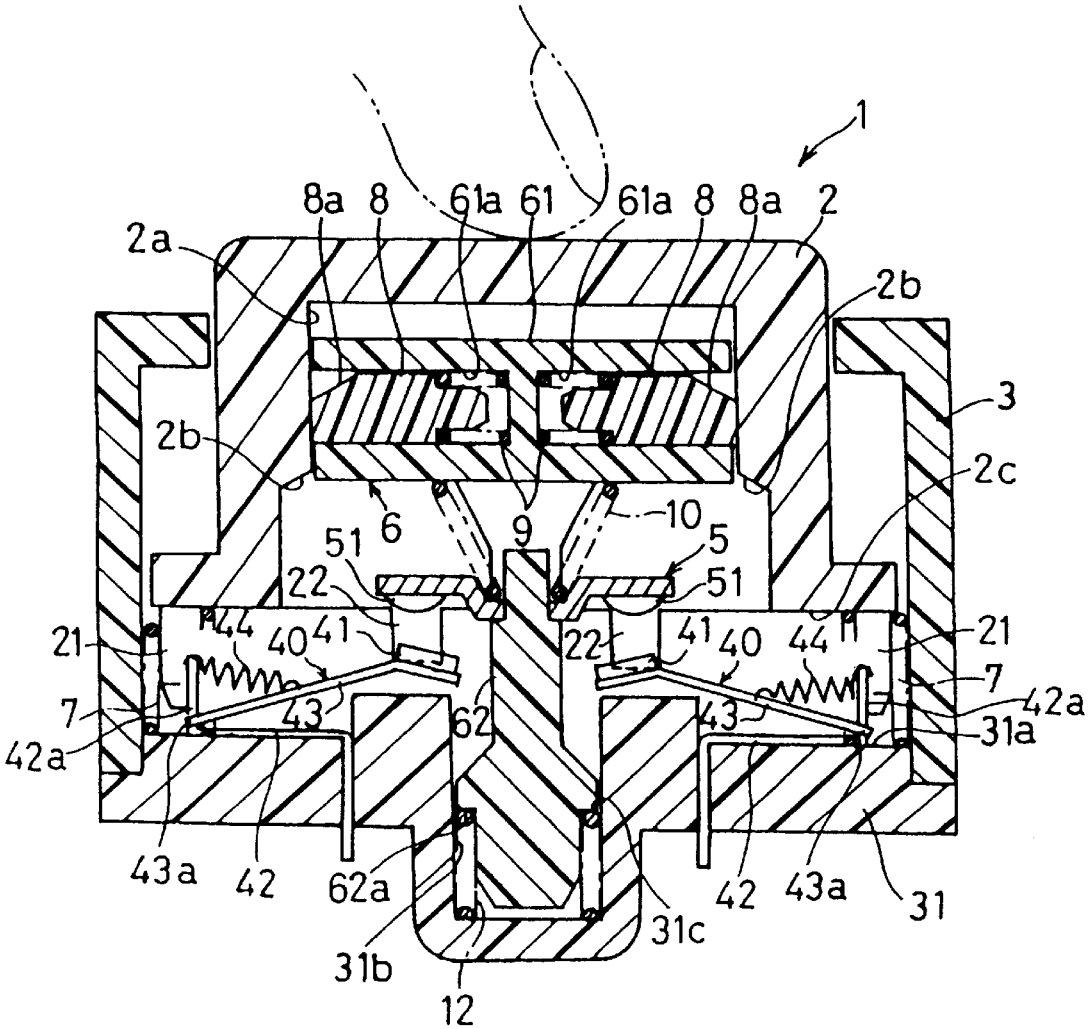
FIG. 17 is a sectional front view for illustration of the operation of the push-button switch according to the second embodiment.
Figure 18:
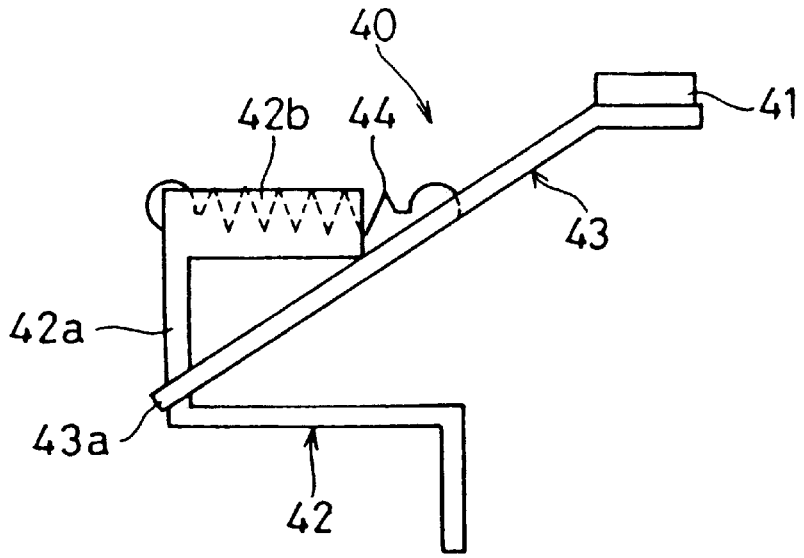
FIG. 18 is an enlarged view showing a state of a stationary terminal in the push-button switch according to the second embodiment.
Figure 19:
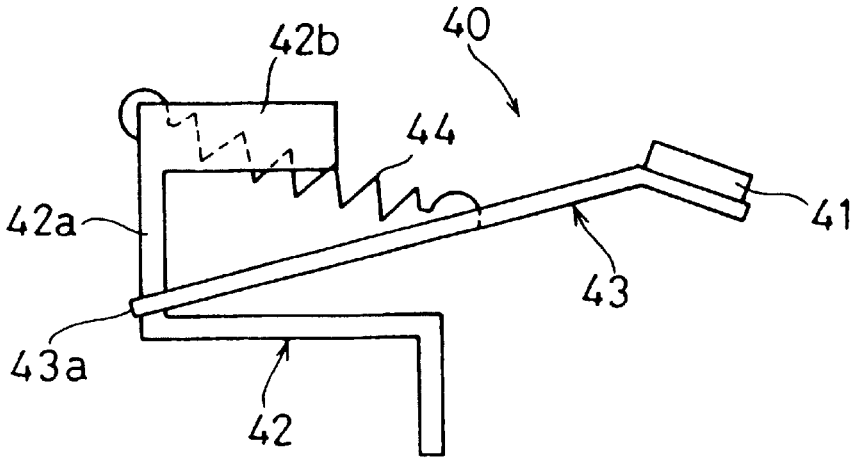
FIG. 19 is an enlarged view showing a different state of the stationary terminal in the push-button switch according to the second embodiment.

As shown in FIGS. 11 and 18, restriction plates 42*b* are disposed at opposite ends of the upright plate 42*a* for restriction of the upward pivotal movement of the movable metal piece 43. Incidentally, FIGS. 10, 12 to 17 omit the restriction plates 42*b* for convenience of depiction.

A coiled spring 44 is stretched between the upright plate 42*a* and the movable metal piece 43. The coiled spring 44 has one end thereof locked to the upright plate 42*a* while the other end thereof locked substantially to a midportion of the movable metal piece 43. The movable metal piece 43 is constantly urged into an upward pivotal movement by a spring force of this coiled spring 44.

As shown in FIG. 11, the movable metal piece 43 is a T-shaped member as seen in Plan, having the first contact 41 affixed to its distal end.

In the first OFF state or the initial state in which the push button 2 is not depressed, as shown in FIG. 10, the push button 2 is placed at the initial position by the spring force of the coiled springs 7 so that the first and second contacts are separated from each other to define the gap therebetween. On the other hand, the slopes 8*a* of the slide blocks 8 are in engagement with the slopes 2*b* of the hole 2*a*, which engagement serves to interlock the switching mechanism 6 with the depression of the push button 2.

If the push button 2 in the first OFF state shown in FIG. 10 is depressed, the engagement between the slopes 8*a* of the slide blocks 8 and the slopes 2*b* of the push button 2 permits the switching mechanism 6 to lower along with the push button 2 so that the second contacts 51 of the movable terminal 5 of the switching mechanism 6 come into contact with the first contacts 41 of the stationary terminal 40 of the case 3. Thus, the switch is shifted to the ON state.

At this time, the inward pushing force is applied to the slopes 8*a* of the slide blocks 8 via the slopes 2*b* of the push button 2. However, the spring force of the coiled springs 9 of the switching mechanism 6 is dominant over this pressing force and hence, the slide blocks 8 are not retracted into the holes 61*a*.

At this time, the gap t is defined between the stepped portion 62*a* of the shaft 62 and the stopper surface 31*c* in the hole 31*b* of the case bottom 31.

Figure 12:
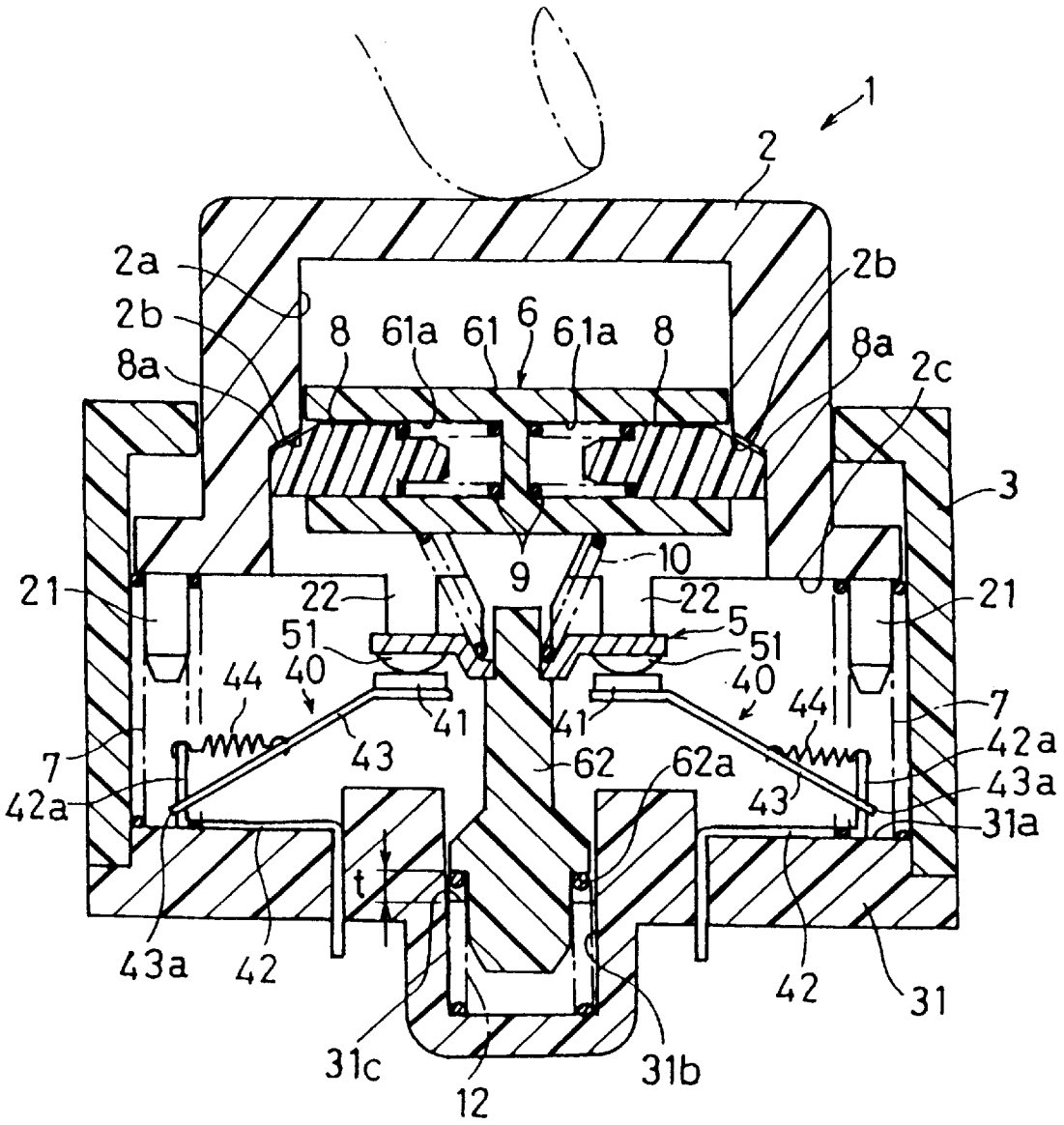
FIG. 12 is a sectional front view for illustration of operation of the push-button switch according to the second embodiment.
Figure 13:
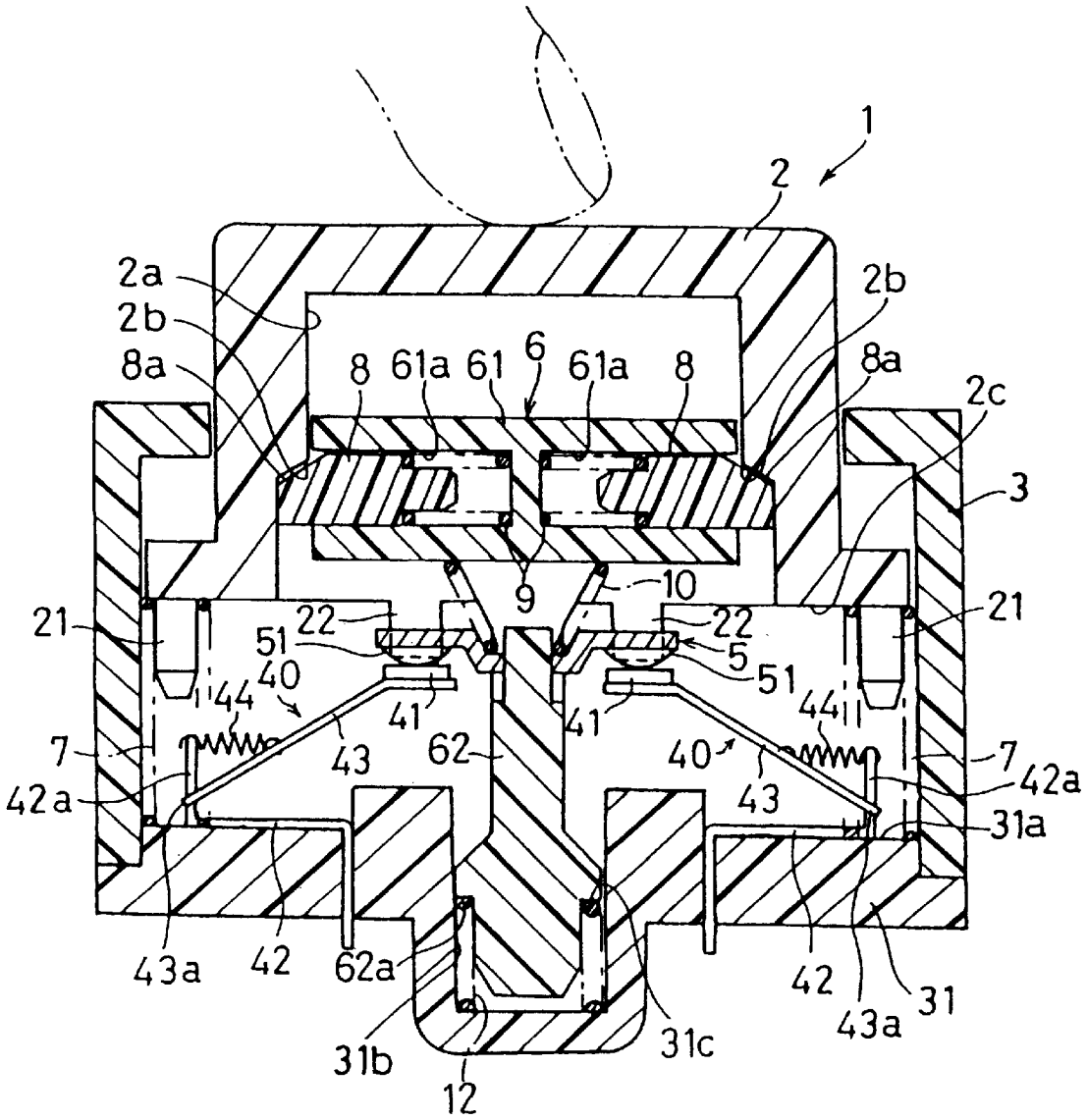
FIG. 13 is a sectional front view for illustration of the operation of the push-button switch according to the second embodiment.

Subsequently, if the push button 2 is further pressed down in the ON state shown in FIG. 12, the stepped portion 62*a* of the shaft 6 of the switching mechanism 6 comes into abutment against the stopper surface 31*c* of the case bottom 31 while the second contacts 51 of the movable terminal 5 stay in contact with the first contacts 41 of the stationary terminal 4, as shown in FIG. 13. Thus, the gap t is reduced to zero. At this time, as indicated by a broken line in FIG. 13, the projections 22 at the bottom of the push button 2 overlap with the movable terminal 5 with respect to the direction perpendicular to the drawing sheet.

Figure 14:
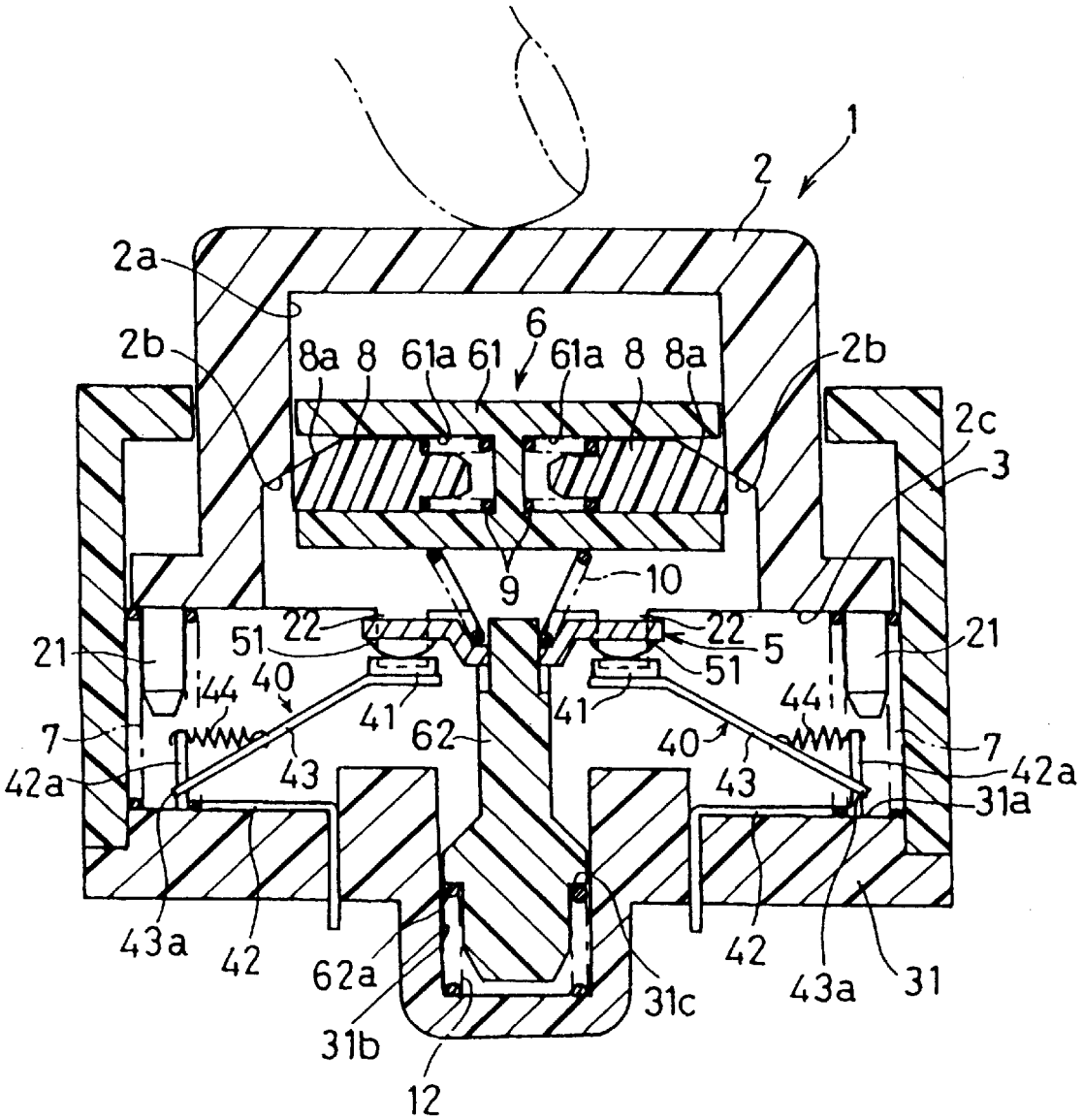
FIG. 14 is a sectional front view for illustration of the operation of the push-button switch according to the second embodiment.

If the push button 2 in this state is further pressed down, the pushing force applied to the slopes 8*a* of the slide blocks 8 by the push button 2 becomes dominant over the spring force of the coiled springs 9 so that the slopes 8*a* of the slide blocks 8 start sliding on the slopes 2*b* of the push button 2 for bringing the slide blocks 8 into sliding movement into the holes 61*a*, as shown in FIG. 14. Eventually, the slide blocks 8 are completely retracted into the holes 61*a* thereby disengaging the slopes 8*a* of the slide blocks 8 from the slopes 2*b* of the push button 2. This permits the upper part of the switching mechanism 6 to move up and down in the hole 2*a* of the push button 2, releasing the switching mechanism 6 from the interlocked relation with the depression of the push button 2.

Figure 15:
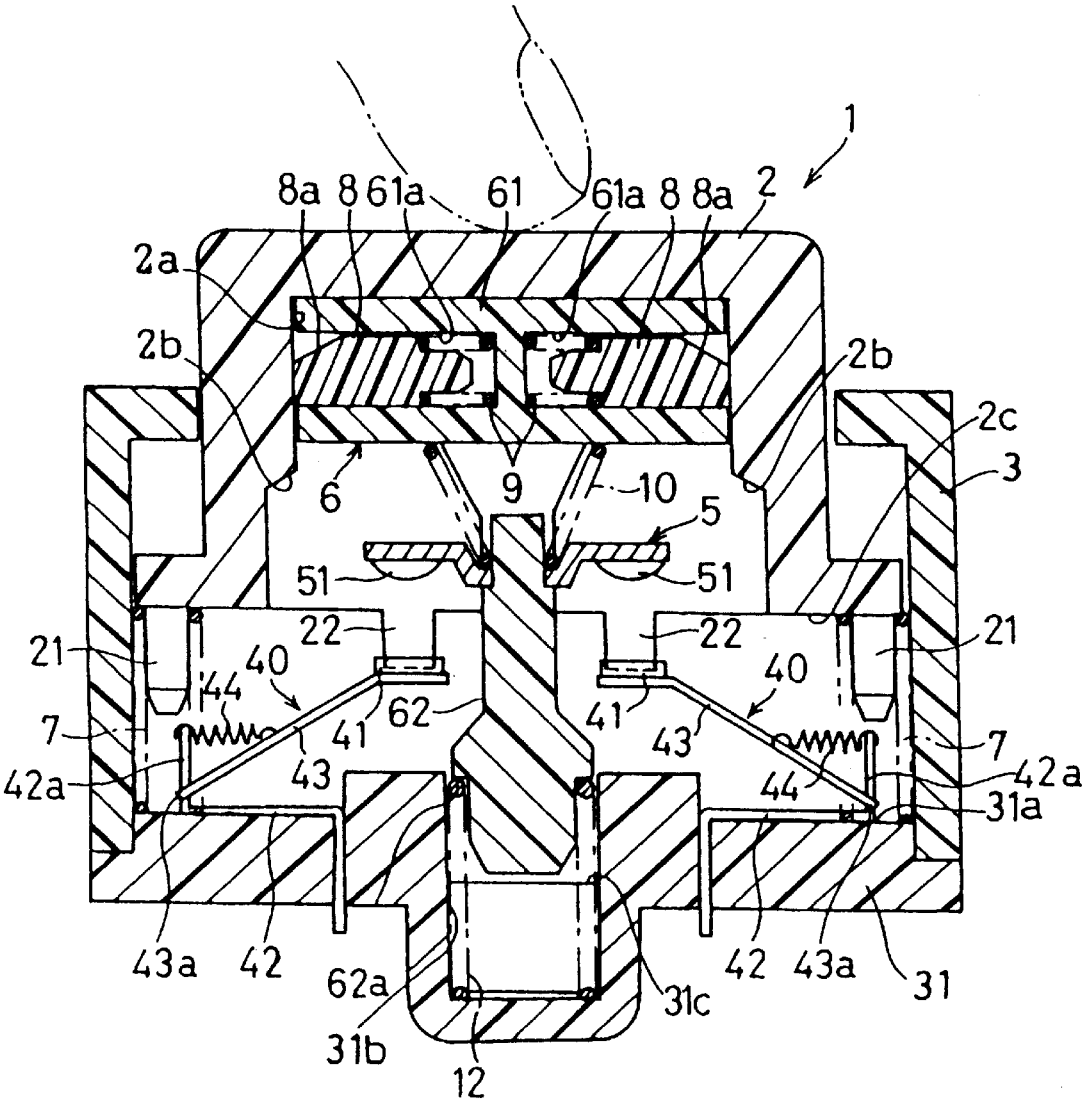
FIG. 15 is a sectional front view for illustration of the operation of the push-button switch according to the second embodiment.

At this time, the coiled spring 12 in the hole 31*b* of the case bottom 31 is compressed so that the stepped portion 62*a* of the shaft 62 is subject to the spring force of the coiled spring 12 acting to push the shaft 62 upward. Therefore, when the slopes 2*b* of the push button 2 disengages from the slopes 8*a* of the slide blocks 8, the spring force of the coiled spring 12 causes the upper part of the switching mechanism 6 to move upward in the hole 2*a* of the push button 2 and also the whole body of the switching mechanism 6 to move toward the push button 2, as shown in FIG. 15. This separates the second contacts 51 of the movable terminal 5 from the first contacts 41 of the stationary terminal 4, shifting the switch to the second OFF state.

Thus, the switch is adapted for shifting from the ON state to the second OFF state in conjunction with the disengagement of the slopes 8*a* of the slide blocks from the slopes 2*b* of the hole 2*a* of the push button 2. Therefore, similarly to the first embodiment, the switch is stably shifted from the ON state to the second OFF state for accomplishing the stable switching operations.

Figure 16:
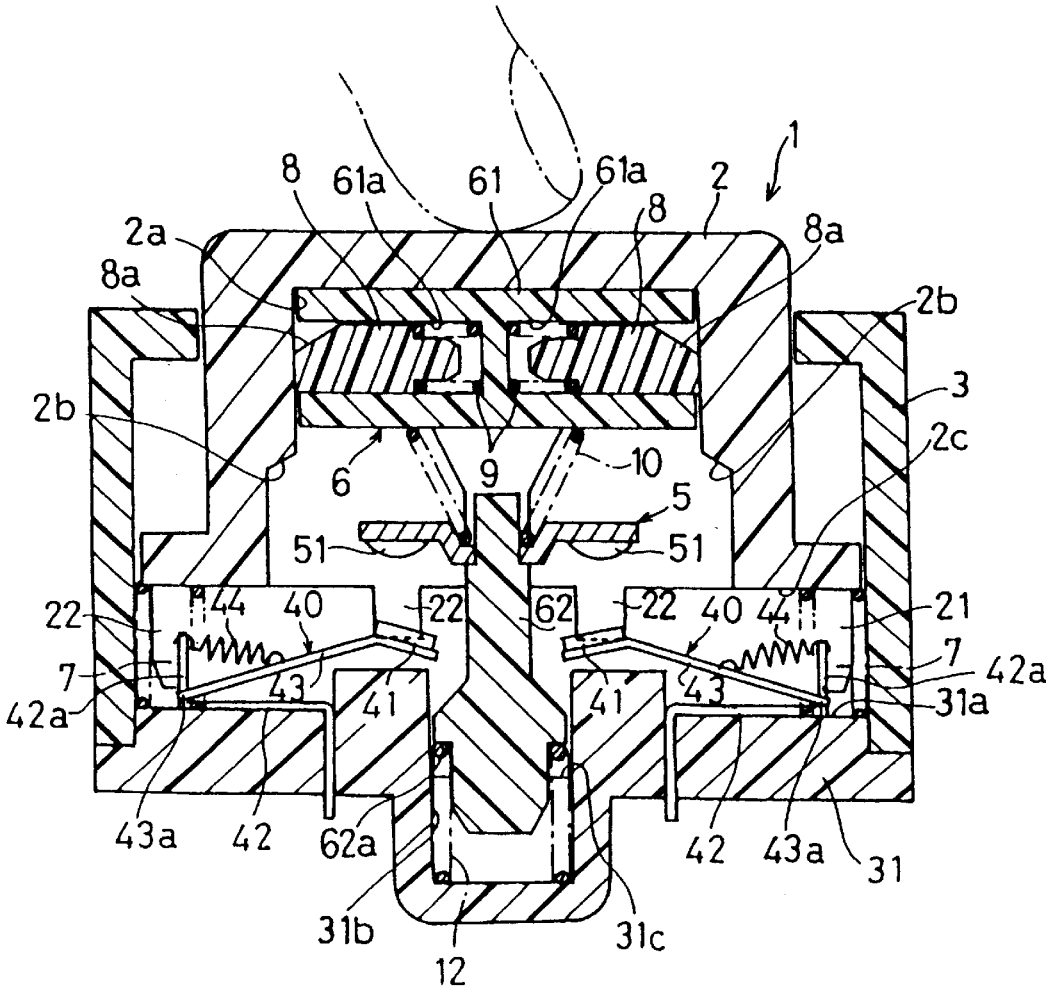
FIG. 16 is a sectional front view for illustration of the operation of the push-button switch according to the second embodiment.

Subsequently, if the push button 2 is further pressed down in the second OFF state of FIG. 15, the projections 22 at the bottom of the push button 2 are pressed against the movable metal pieces 43 of the stationary terminal 40 to push down the first contacts 41 (see FIG. 19), thereby forcibly separating the first contacts 41 from the second contacts 51 of the movable terminal 5, as shown in FIG. 16. Thus, the first and second contacts 41, 51 can be forced into separation even if the first and second contacts are fused to each other. This contributes to an even more positive shifting from the ON state to the second OFF state.

In this case, as well, instead of providing the projections 22 at the bottom of the push button 2, the whole lower end portion of the push button 2 may be used to push down the first contacts 41 of the stationary terminal 4. Otherwise, the projections may be disposed at the movable metal pieces 43 of the stationary terminal 4.

On the other hand, even if the coiled spring 12 is broken to become inoperable to apply its spring force to the shaft 62 of the switching mechanism 6 in the state of FIG. 14, the depression of the push button 2 permits the projections 22 at the bottom of the push button 2 to forcibly push down the first contacts 41 of the stationary terminal 4, thereby positively shifting the switch from the ON state to the second OFF state (see FIG. 17).

Figure 9:
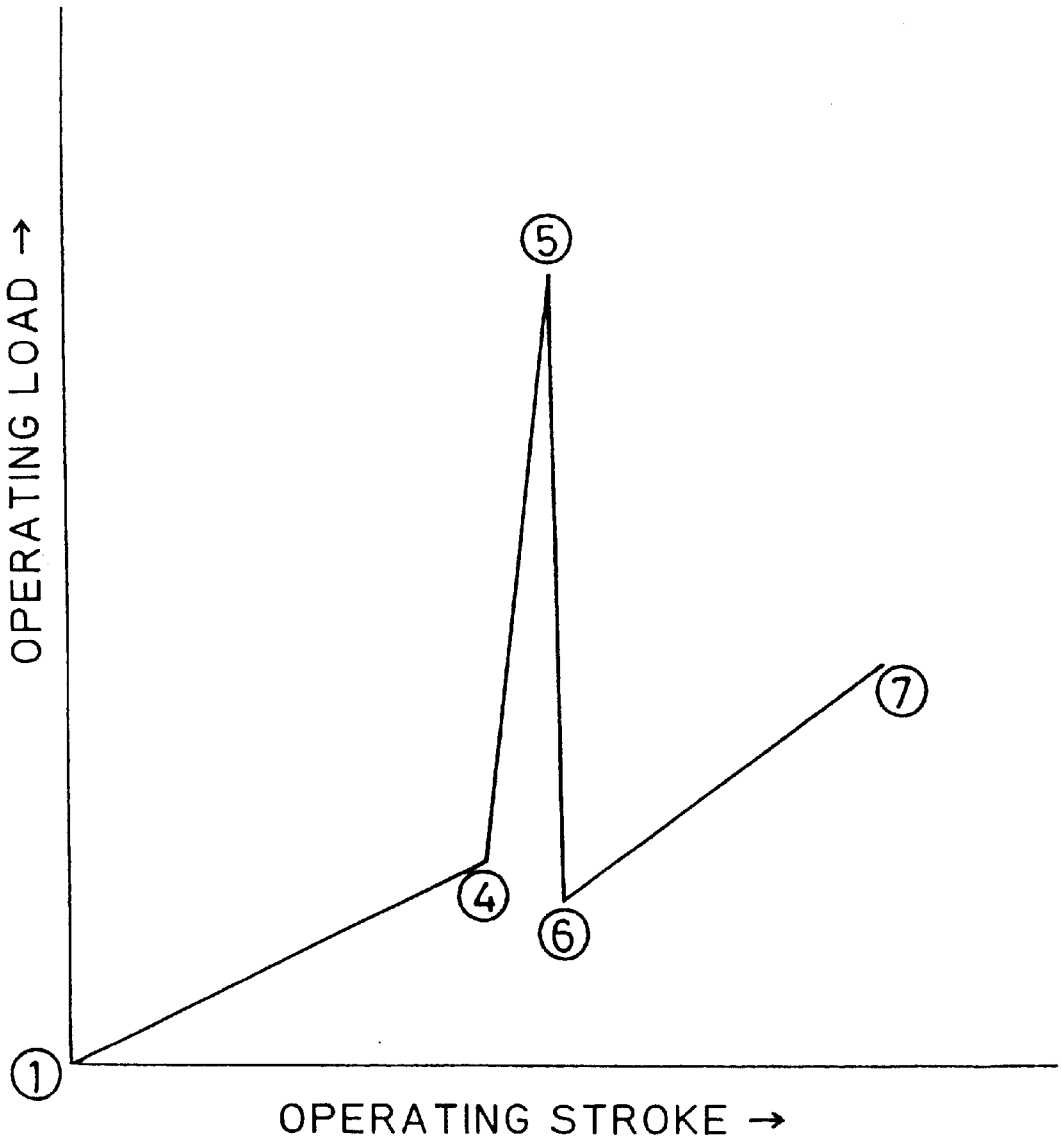
FIG. 9 is a graph representing a relation between the operating load and the operation stroke of a push button according to the first embodiment.

In this case, as well, the relation between the operating load applied to the push button 2 for manipulation of the push-button switch 1 and the operation stroke is similar to that of the first embodiment shown in FIG. 9.

According to the second embodiment, the switch is adapted for shifting from the ON state to the second OFF state, similarly to the first embodiment, in conjunction with the disengagement of the slopes 8*a* of the slide blocks 8 from the slopes 2*b* of the push button 2. Therefore, the switch is stably shifted from the ON state to the second OFF state for accomplishing the stable switching operations.

Further similarly to the first embodiment, at the shifting from the ON state to the second OFF state, the switching mechanism 6 moves toward the push button 2 to bring the contacts 51 of the movable terminal 5 out of contact with the first contacts 41 of the stationary terminal 4 while the projections 22 of the push button 2 push down the first contacts 41 for forcibly separating the first contacts 41 from the second contacts 51. This ensures that the first and second contacts 41, 51 are forced into separation even if the contacts are fused to each other. Thus, the switch is positively shifted from the ON state to the second OFF state for accomplishing even more stable switching operations.

In the first embodiment, the stationary terminal 4 is formed by bending the steel strap substantially into the U-shape. Accordingly, variations in the quality of the steel straps, the thickness of the steel sheet and the like may result in significant variations in the curvature of the bent portions 4*a* of the stationary terminals 4. Hence, it is not easy to control the quality and performance of the stationary terminals 4 within a desired range. In the second embodiment, on the other hand, the spring characteristics of the whole body of the stationary terminal 40 depend upon the coiled spring 44. Therefore, it is relatively easy to control the quality and performance of the stationary terminals within the desired range.

(Third Embodiment)

Next, a third embodiment of the invention will be described with reference to FIGS. 20 to 24.

Figure 20:
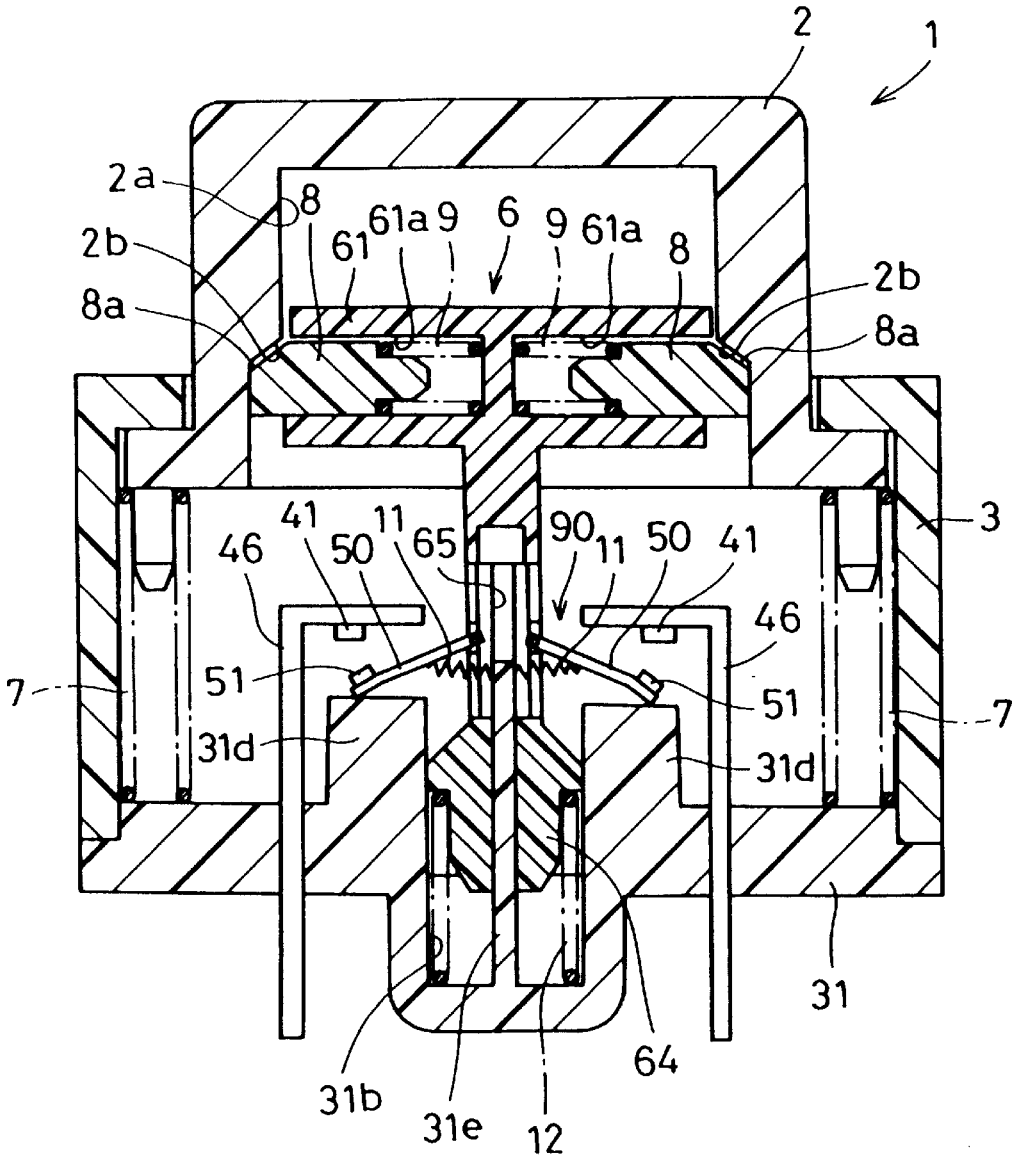
FIG. 20 is a sectional front view showing a push-button switch according to a third embodiment hereof.
Figure 21:
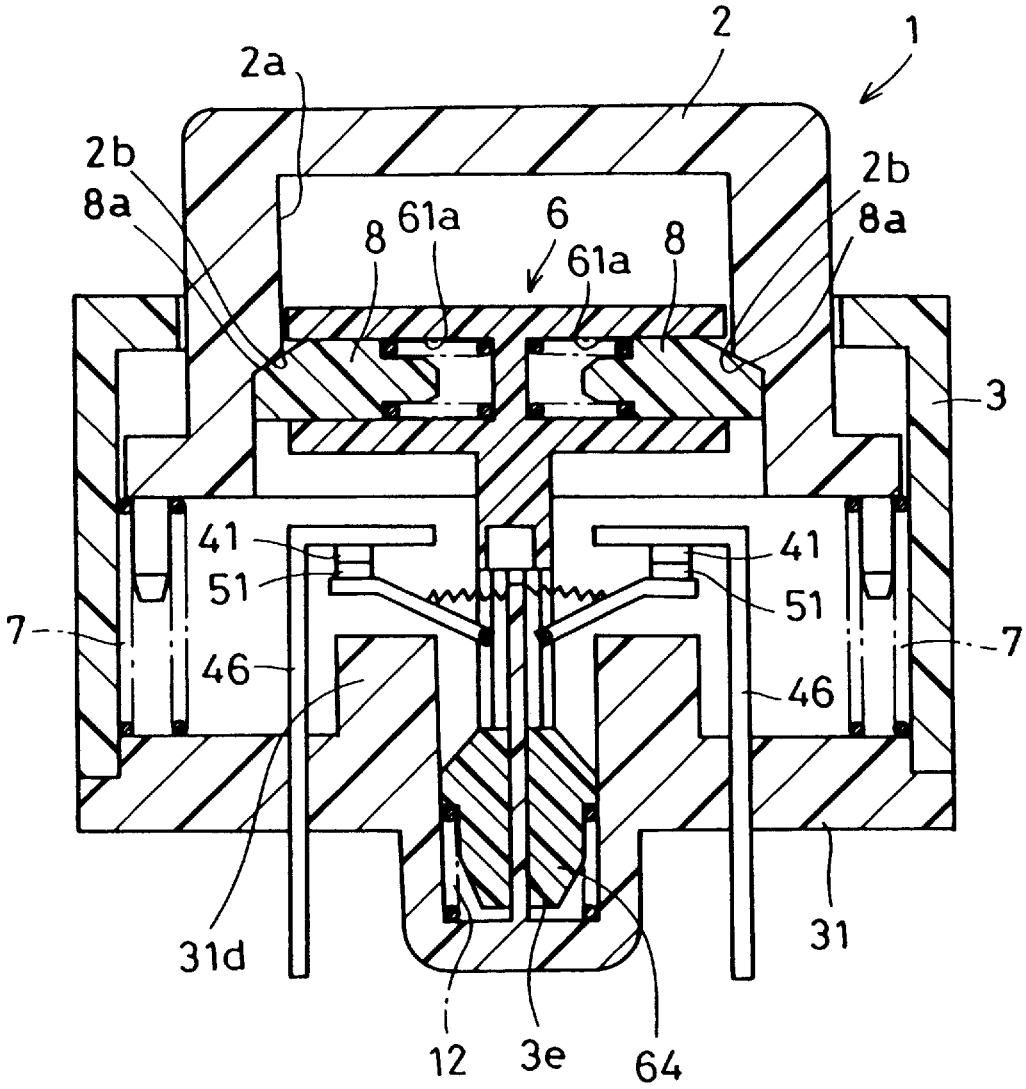
FIG. 21 is a sectional front view for illustration of operation of the push-button switch according to the third embodiment.
Figure 22:
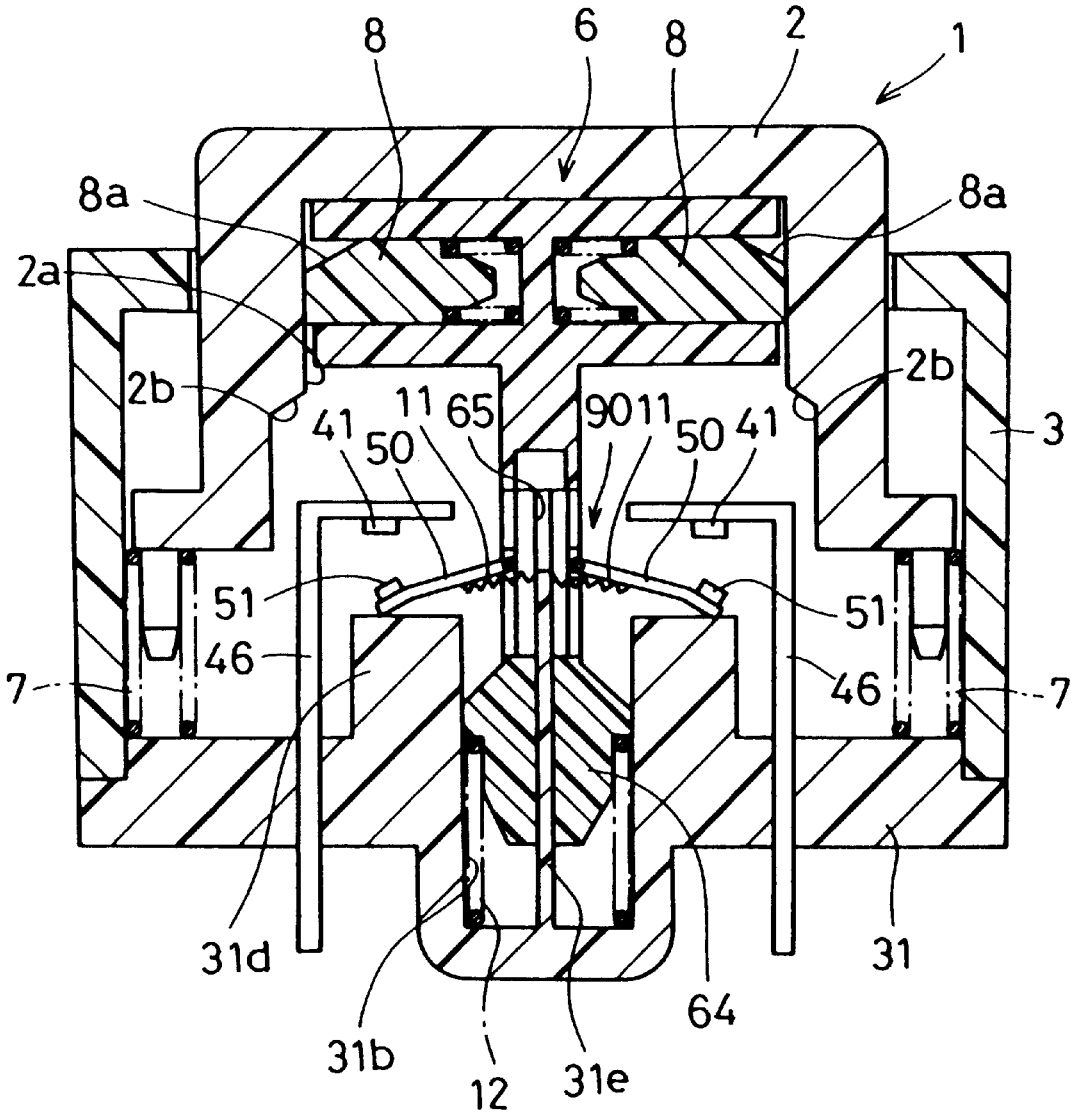
FIG. 22 is a sectional front view for illustration of the operation of the push-button switch according to the third embodiment.
Figure 23:
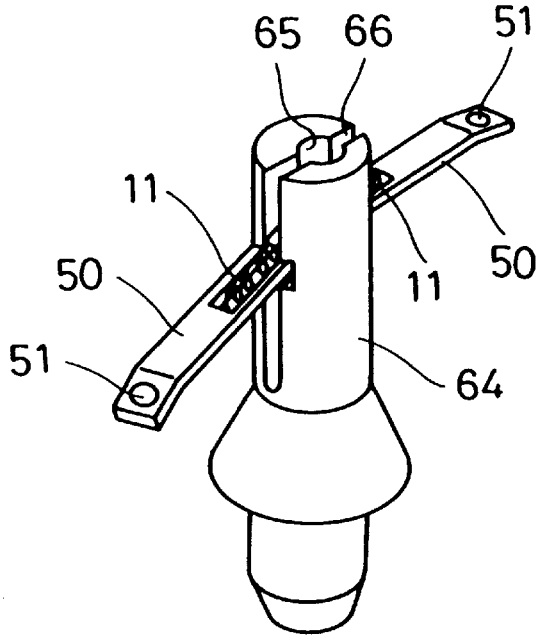
FIG. 23 is a perspective view showing a portion of the push-button switch according to the third embodiment.
Figure 24:
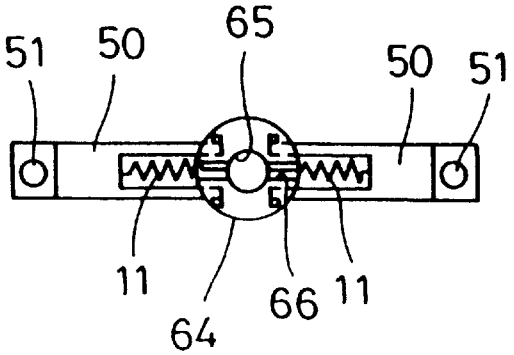
FIG. 24 is a plan view showing the portion of the push-button switch according to the third embodiment.

FIG. 20 is a sectional front view showing a push-button switch according to the third embodiment; FIGS. 21 and 22 sectional front views for illustration of operations of the push-button switch; FIGS. 23 and 24 perspective and plan views showing a portion of the push-button switch. In the figures, the same reference characters with those of the first embodiment represent the same or equivalent portions.

The third embodiment differs from the first embodiment in the construction of the stationary terminal, the movable terminal and the switching mechanism. Accordingly, this description focuses on such differences and a detailed explanation of the other portions is dispensed with.

As shown in FIGS. 20 to 22, the stationary terminal of this embodiment is comprised of a pair of L-shaped fixed metal pieces 46, 46 which extend through the bottom 31 of the case 3 and are disposed in face-to-face relation in the case 3. The first contacts 41 are affixed to respective lower sides of upper end portions of the fixed metal pieces 46.

On the other hand, a pair of movable terminals 50, 50 are mounted to a shaft 64 by way of a reversing mechanism 90, the shaft 64 constituting the switching mechanism 6. The respective ends of the movable terminals 50 in the first OFF state extend over a circumference of the hole 31*b* of the bottom 31 to be abutted against a top surface of a pedestal 31*d* integrally formed with the bottom.

This switching mechanism 6 has substantially the same construction as the switching mechanism of the first embodiment but differs therefrom principally in the following points. That is, the shaft 64 at the lower part of the switching mechanism 6 is formed with a through-hole 65 which vertically extends through the center of the shaft 64. Extended through this through-hole 65 is a boss 31*e* which stands up from the center of the hole 31*b* of the bottom 31 of the case 3. Additionally, the shaft 64 is formed with an expanding slot 66 extending from the top end thereof to a substantial midportion thereof, as shown in FIGS. 23 and 24.

The pair of movable terminals 50, 50 are mounted to the shaft 64 in a gull-wing manner, having a proximal end thereof pivotally carried by the shaft 64, respectively. The second contacts 51 are affixed to the respective distal ends of the movable terminals 50. A pair of coiled springs 11, 11 each have one end thereof locked to the boss 31*e*, as stretched through the expanding slot 66. The other ends of the coiled springs 11, 11 are locked to respective midportions of the movable terminals 50. As shown in FIG. 24, for example, a notch may be formed at a support portion of the shaft 64 for receiving the proximal end of the movable terminal 50. A convex and a concave may be formed at the proximal end of the movable terminal 50 and the notch of the shaft 6, respectively, such that the proximal end of the movable terminal 50 may be pivotally supported by means of the concave-convex fitting relation.

Thus, when the shaft 64 is set at the initial position or the uppermost position, the respective distal ends of the movable terminals 50 are urged downward by the spring force of the coiled springs 11, 11, as shown in FIG. 20, so that the distal ends of the movable terminals 50 are abutted against the top surface of the pedestal 31*d* of the case 3. When the depression of the push button 2 causes the switching mechanism 6 to move down to lower the shaft 64, the respective proximal ends of the movable terminals 50 will move down along with the shaft 64. When the respective distal ends of the movable terminals 50 have lowered to some point, the spring force of the coiled springs 11, 11 acting on the respective distal ends of the movable terminals 50 is reversed in the direction from the above. Hence, the respective distal ends of the movable terminals 50 are urged upward. In this manner, the respective ends of the movable terminals 50 are displaced by changing the direction of the spring force of the coiled springs 11, 11 acting on both movable terminals 50.

In this manner, the movable terminals 50, 50, coiled springs 11, 11 and the pedestal 31*d* of the case 3 compose the reversing mechanism 90.

Next, a brief description will be made on the operations. If the push button 2 is depressed in the first OFF state shown in FIG. 20, the same operations as in the first embodiment take place so that the switching mechanism 6 is moved down along with the push button 2 because of the engagement between the slopes 8*a* of the slide blocks 8 and the slopes 2*b* of the push button 2, as shown in FIG. 21. Then, as mentioned supra, the shaft 64 of the switching mechanism 6 is lowered to cause the distal ends of the movable terminals 50 of the reversing mechanism 90 to move upward. Thus, the second contacts 51 of the movable terminals 50 come into contact with the first contacts 41 thereby to shift the switch to the ON state.

Similarly to the first embodiment, the slide blocks 8 are not retracted into the holes 61*a* in this ON state.

Subsequently, if the push button 2 is further pressed down in the ON state of FIG. 21, the slopes 8*a* of the slide blocks 8 start sliding on the slopes 2*b* of the push button 2 to bring the slide blocks 8 into sliding movement into the holes 61*a*. Eventually, the slide blocks 8 are completely retracted into the holes 61*a* thereby to disengage the slopes 2*b* of the push button 2 from the slopes 8*a* of the slide blocks 8. This permits the upper part of the switching mechanism 6 to move up and down in the hole 2*a* of the push button 2 and hence, the switching mechanism 6 is not interlocked with the depression of the push button 2.

At this time, on the other hand, the coiled spring 12 in the hole 31*b* of the case bottom 31 is compressed so that upon disengagement of the slopes 2*b* of the push button 2 from the slopes 8*a* of the slide blocks 8, the spring force of the coiled spring 12 causes the upper part of the switching mechanism 6 to move upward in the hole 2*a* of the push button 2 and also the whole body of the switching mechanism 6 to move upward, as shown in FIG. 22.

Thus, the respective distal ends of the movable terminals 50 of the reversing mechanism 90 are displaced to the lower positions, thereby separating the second contacts 51 of the movable terminals 50 from the first contacts 41. The switch is shifted from the ON state to the second OFF state.

According to the third embodiment, the arrangement is made such that the reversing mechanism 90 is displaced in conjunction with the disengagement of the slopes 8*a* of the slide blocks 8 from the slopes 2*b* of the push button 2, thereby shifting the switch from the ON sate to the second OFF state. Therefore, the switch is stably shifted from the ON state to the second OFF state for accomplishing the stable switching operations.

As a matter of course, projections, as the forcible separation means, which are the same as the projections 22 of the first embodiment, may be provided at the lower side of the push button 2 in order that these projections will push down the ends of both movable terminals 50 upon further depression of the push button 2 after the switch is shifted from the ON state to the second OFF state. Thus, the first and second contacts 41, 51 may be forced into separation even if they are fused to each other.

In this case, the forcible separation means is not particularly limited to the aforesaid projections but may be of any structure that is capable of pushing down the ends of both movable terminals 50 upon further depression of the push button 2 after the switch is shifted from the ON state to the second OFF state.

(Fourth Embodiment)

Next, a fourth embodiment of the invention will be described with reference to FIGS. 25 to 30.

Figure 25:
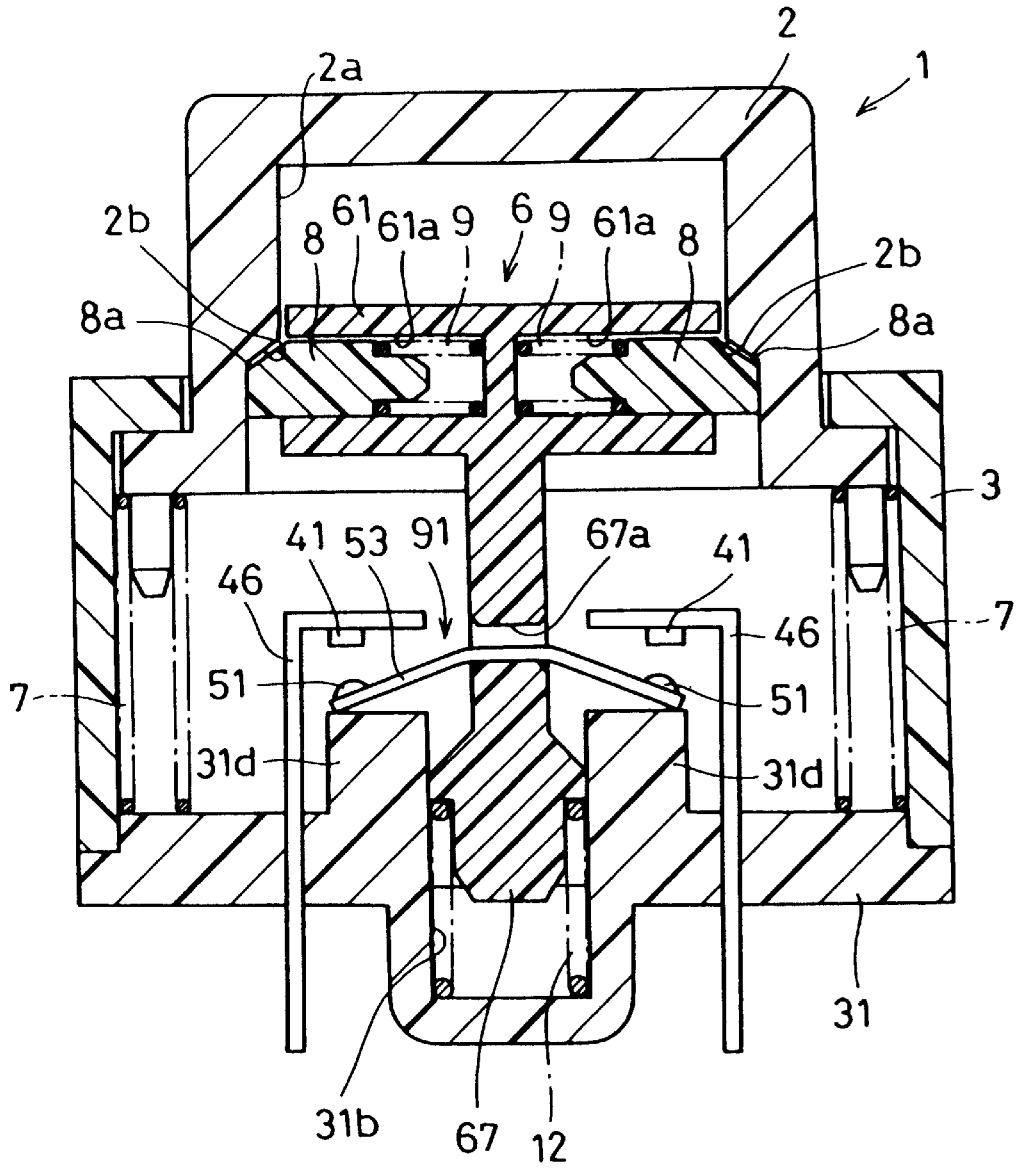
FIG. 25 is a sectional front view showing a push-button switch according to a fourth embodiment hereof.
Figure 26:
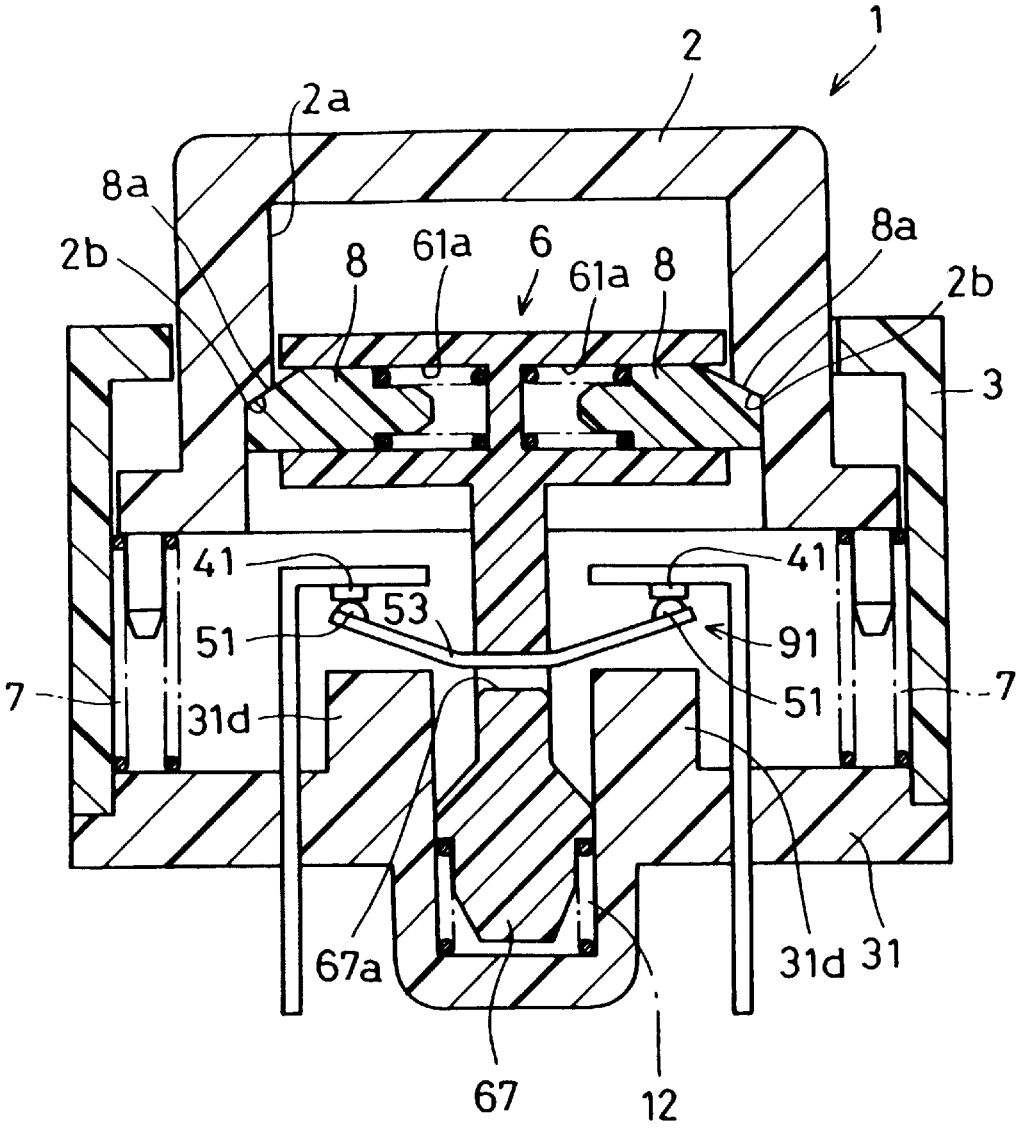
FIG. 26 is a sectional front view for illustration of operation of the push-button switch according to the fourth embodiment.
Figure 27:
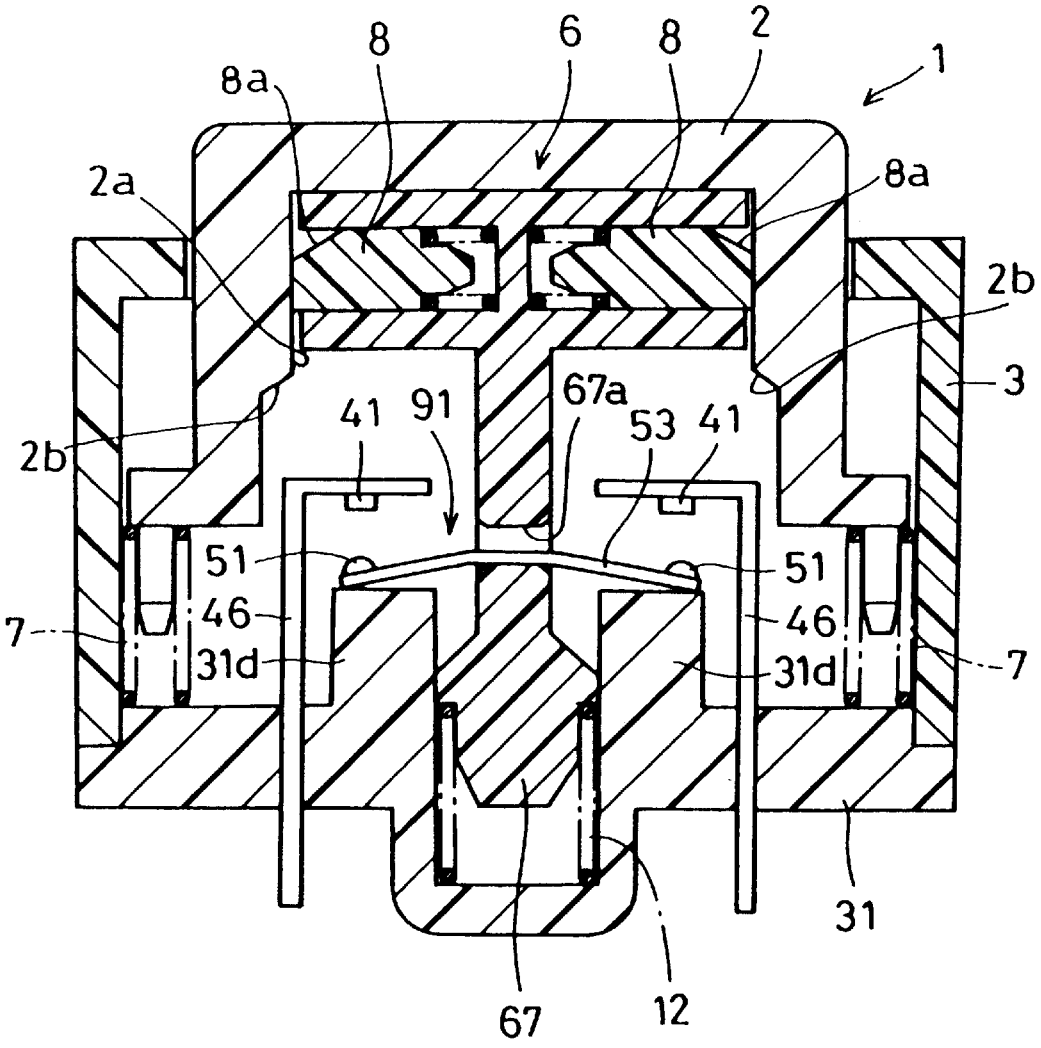
FIG. 27 is a sectional front view for illustration of the operation of the push-button switch according to the fourth embodiment.
Figure 28:
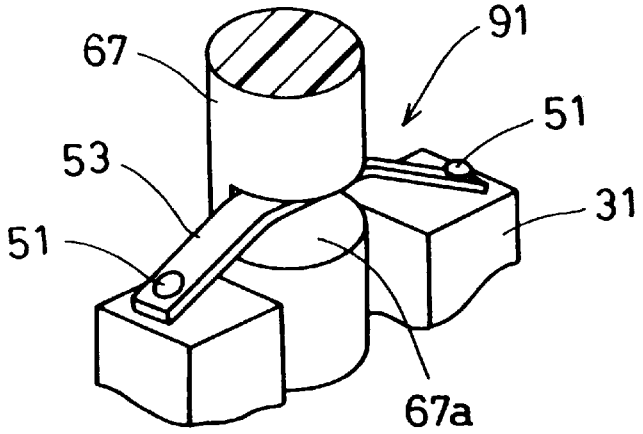
FIG. 28 is a perspective view showing a portion of the push-button switch according to the fourth embodiment.

FIG. 25 is a sectional front view showing a push-button switch according to the fourth embodiment; FIGS. 26 and 27 sectional front views for illustration of the operations of the push-button switch; FIG. 28 a perspective view showing a portion of the push-button switch; and FIGS. 29 and 30 perspective and sectional views showing another portion, as a modification, of the push-button switch. In the figures, the same reference characters as those of the third embodiment represent the same or equivalent portions.

The fourth embodiment particularly differs from the third embodiment in the constructions of the movable terminal and of the switching mechanism. Accordingly, this description focuses on these differences and a detailed explanation on the other portions is dispensed with.

As shown in FIGS. 25 to 27, the movable terminal of this embodiment is comprised of an electrically conductive spring member 53 having opposite end portions curved downward relative to its midportion. At the lower part of the switching mechanism 6, a shaft 67 is formed with a notched recess 67*a* substantially at its midportion thereby to define a substantially U-shaped section. The spring member 53 is disposed such that a midportion thereof is received by this notched recess 67*a* whereas opposite ends thereof abut against the top surface of the pedestal 31*d* in the first OFF state.

If the shaft 67 moves to cause an upper side of the notched recess 67*a* to push down the midportion of the spring member 53 with its opposite ends curved downward and abutted against the top surface of the pedestal 31*d*, the direction of a spring force applied to the opposite ends of the spring member 53 is changed to an upward direction. If, on the other hand, the shaft 67 moves to cause a lower side of the notched recess 67*a* to push up the midportion of the spring member 53 with its opposite end portions curved upward and engaged with the first contacts 41 via the second contacts 51, the direction of the spring force applied to the opposite end portions of the spring member 53 is changed to the downward direction.

The second contacts 51 may be disposed at places on the upper surface of the opposite end portions and opposite to the first contacts 41 such that the opposite end portions of the spring member 53 are displaced to bring the second contacts into or out of contact with the first contacts 41.

In this manner, the spring member 53 as the movable terminal, the notched recess 67*a* of the shaft 67 and the pedestal 31*d* of the case 3 compose the reversing mechanism 90.

Next, a brief description will be made on the operations. If the push button 2 is depressed in the first OFF state shown in FIG. 25, the same operations as in the third embodiment take place so that the switching mechanism 6 is moved down along with the push button 2 because of the engagement between the slopes 8*a* of the slide blocks 8 and the slopes 2*b* of the push button 2, as shown in FIG. 26. Then, as mentioned supra, the shaft 64 of the switching mechanism 6 lowers to press the upper side of the notched recess 67*a* against the midportion of the spring member 53 for pushing down the same. This causes the opposite end portions of the spring member 53 to rise to the first contacts 41. This brings the second contacts 51 of the spring member 53 into contact with the first contacts 41, shifting the switch to the ON state.

Similarly to the third embodiment, the slide blocks 8 are not retracted into the holes 61*a* in this ON state.

Subsequently, if the push button 2 is further pressed down in the ON state of FIG. 26, the slopes 8*a* of the slide blocks 8 start sliding on the slopes 2*b* of the push button 2 to bring the slide blocks 8 into sliding movement into the holes 61*a* the same way as in the third embodiment. Eventually, the slide blocks 8 are completely retracted into the holes 61*a* thereby to disengage the slopes 2*b* of the push button 2 from the slopes 8*a* of the slide blocks 8. This permits the upper part of the switching mechanism 6 to move up and down in the hole 2*a* of the push button 2 and hence, the switching mechanism 6 is not interlocked with the depression of the push button 2.

At this time, on the other hand, the coiled spring 12 in the hole 31*b* of the case bottom 31 is compressed so that upon disengagement of the slopes 2*b* of the push button 2 from the slopes 8*a* of the slide blocks 8, the spring force of the coiled spring 12 causes the upper part of the switching mechanism 6 to move upward in the hole 2*a* of the push button 2 and also the whole body of the switching mechanism 6 to move upward, as shown in FIG. 27.

Thus, the lower side of the notched recess 67*a* of the shaft 67 is pressed against the midportion of the spring member 53 to push up the same. Therefore, the opposite end portions of the spring member 53 are moved downward or in the direction to move away from the first contacts 41, thereby separating the second contacts 51 of the spring member 53 from the first contacts 41 for shifting the switch to the second OFF state.

According to the fourth embodiment, the opposite end portions of the spring member 53 constituting the reversing mechanism 90 are caused to displace by the disengagement of the slopes 8*a* of the slide blocks 8 from the slopes 2*b* of the push button 2, thereby shifting the switch from the ON sate to the second OFF state. Hence, the switch is stably shifted from the ON state to the second OFF state, accomplishing the stable switching operations.

As a matter of course, projections, as the forcible separation means, which are the same as the projections 22 of the first embodiment, may be provided at the lower side of the push button 2 in order that these projections will push down the opposite ends of the spring member 53 upon further depression of the push button 2 after the switch is shifted from the ON state to the second OFF state. Thus, the first and second contacts 41, 51 are forced into separation even if they are fused to each other.

In this case, the forcible separation means is not particularly limited to the aforesaid projections but may be of any structure that is capable of pushing down the opposite ends of the spring member 53 upon further depression of the push button 2 after the switch is shifted from the ON state to the second OFF state.

Figure 29:
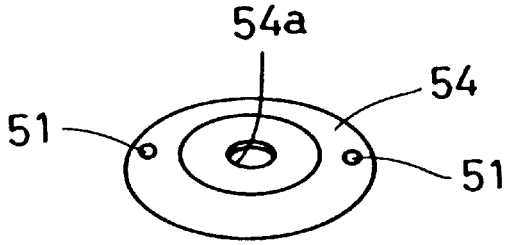
FIG. 29 is a perspective view showing another portion, as a modification, of the push-button switch according to the fourth embodiment.
Figure 30:
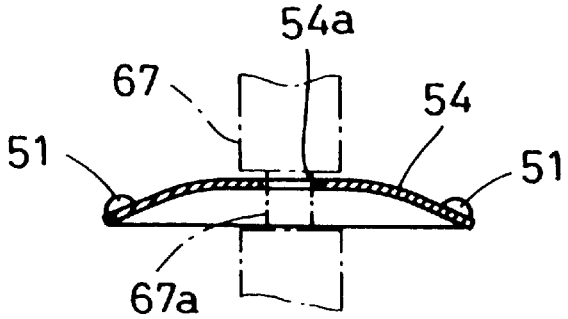
FIG. 30 is a sectional view showing the portion, as the modification, of the push-button switch according to the fourth embodiment.

As a modification of the spring member, there may be employed a dome-like spring member 54 formed with a through hole 54*a* at the center thereof, the through hole having a smaller diameter than that of the shaft 67, as shown in FIGS. 29 and 30. In this case, an arrangement may be made such that a minor diameter portion 67*b* of a smaller diameter than that of the through hole of the dome-like spring member 54 is formed at the midportion of the shaft 67 of the switching mechanism 6 while the shaft is passed through the through hole of the spring member 54, and that the central portion of the dome-like spring member 54 is pushed up or down by the shaft 67 located at the opposite ends of the minor diameter portion 67*a*.

In this case, as well, it is preferred to provide the forcible separation means for forcibly pushing down an edge of the dome-like spring member 54.

(Fifth Embodiment)

Next, a fifth embodiment of the invention will be described with reference to FIG. 31, which is a sectional front view showing a push-button switch according to the fifth embodiment. In the figure, the same reference characters with those of the first embodiment represent the same or equivalent portions.

The fifth embodiment somewhat differs from the first embodiment in the construction of the push button 2, in particular. Accordingly, this description focuses on this difference and a detailed explanation of the other portions is dispensed with.

Figure 31:
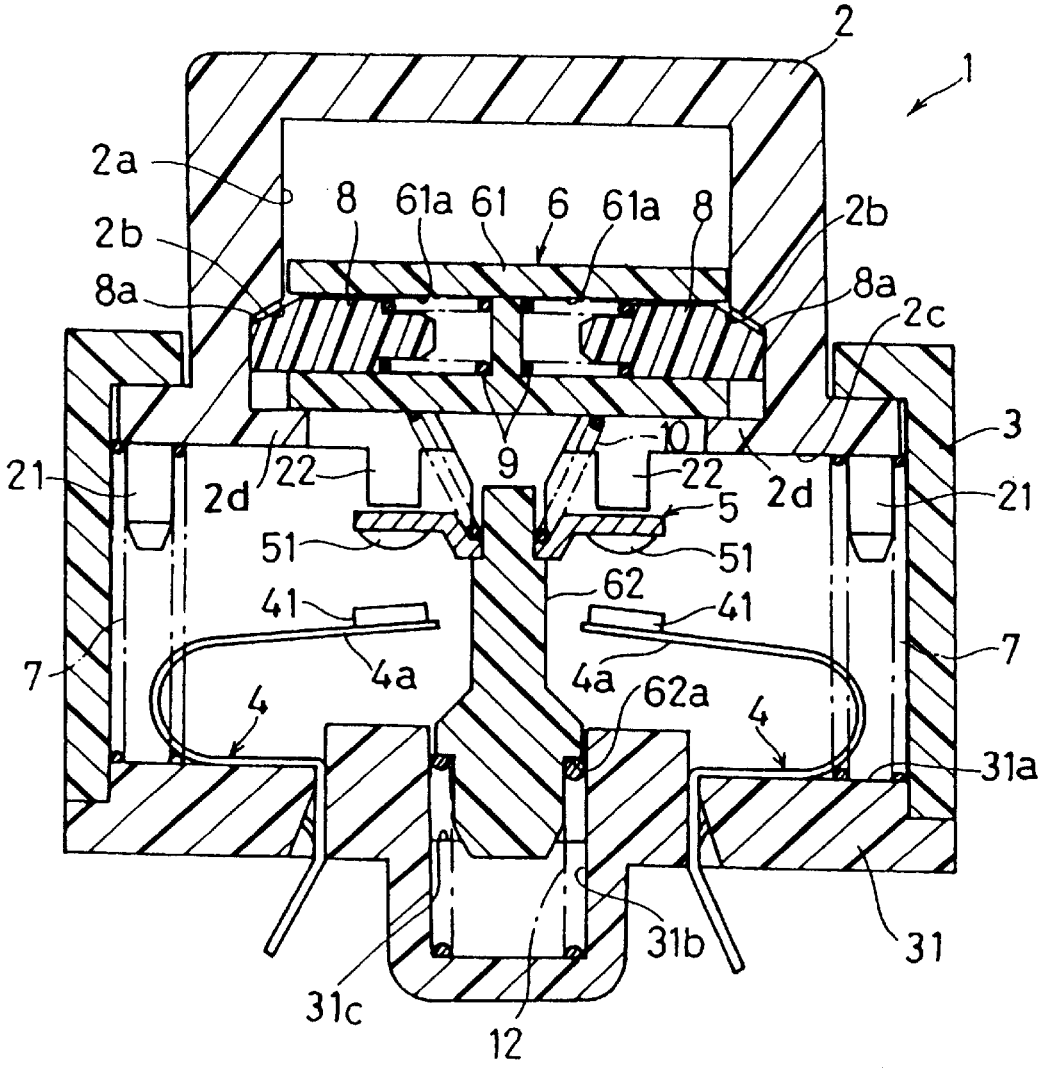
FIG. 31 is a sectional front view showing a push-button switch according to a fifth embodiment hereof.

As shown in FIG. 31, engaging pieces 2*d* are integrally formed with the lower end of the hole 2*a* equivalent to the hollow portion of the push button 2. The engaging pieces 2*d* are adapted to engage the lower side of the inserted portion 61 of the switching mechanism 6 within the hole 2*a* when the push button 2 is returned to the position prior to the depression thereof by the spring force of the coiled springs 7 as the urging means.

Thus, the engagement of the engaging pieces 2*d* with the inserted portion 61 of the switching mechanism 6 ensures that the switching mechanism 6 together with the push button 2 are returned to the initial positions.

According to the fifth embodiment, the switching mechanism 6 can be interlocked with the return of the push button 2. Therefore, even if the coiled spring 12 operating as the return spring for the switching mechanism 6 is damaged, the switching mechanism can positively be returned to its initial position.

It is noted that the engaging pieces 2*d* are not necessarily formed at the push button 2 in an integral manner and independent engaging pieces may be affixed thereto.

Alternatively, the engaging pieces 2*d* may be disposed at places such as to engage the slide blocks 8.

As a matter of course, such engaging pieces may be provided at the push buttons 2 of the second to fourth embodiments hereof.

(Sixth Embodiment)

Next, a sixth embodiment of the invention will be described with reference to FIGS. 32 to 36.

Figure 32:
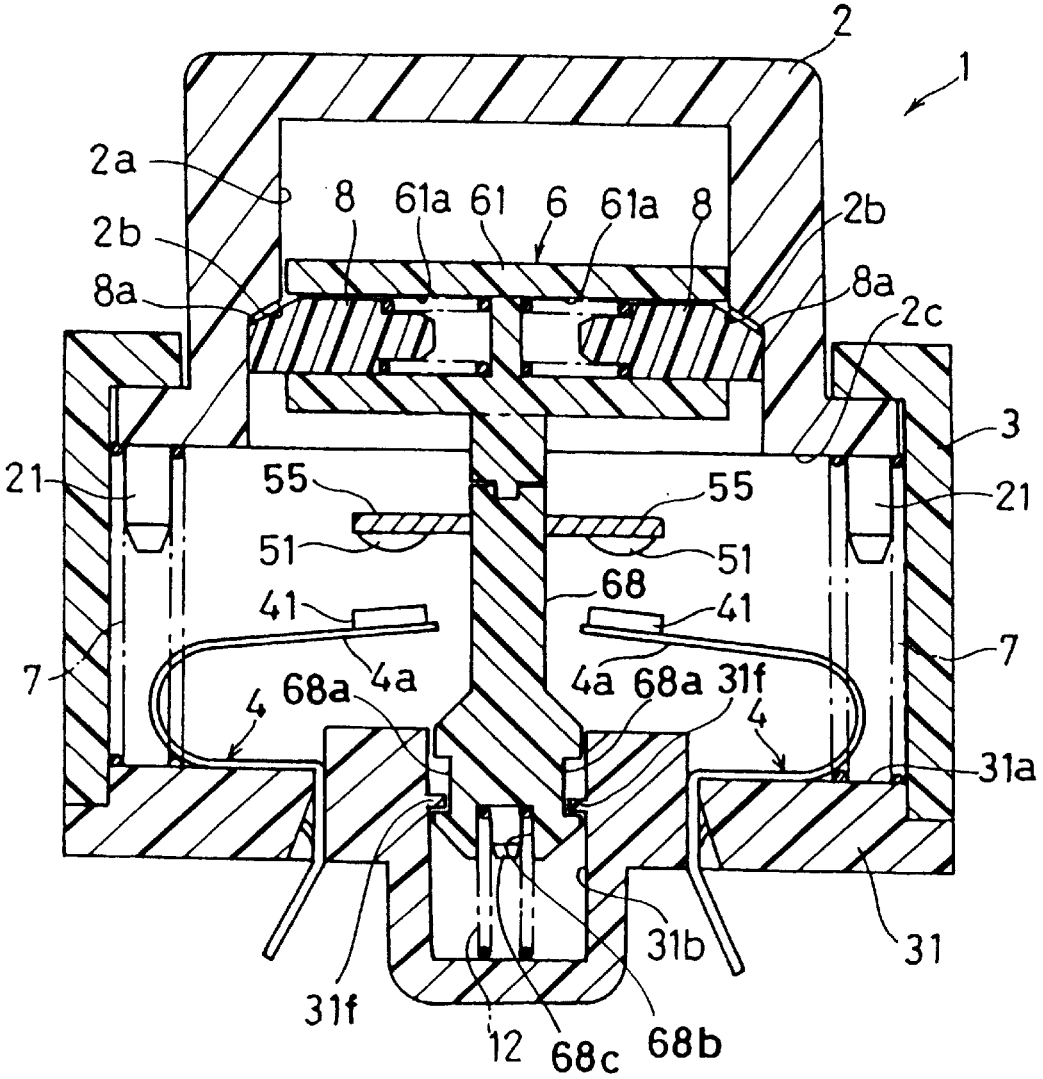
FIG. 32 is a sectional front view showing a push-button switch according to a sixth embodiment hereof.
Figure 33:
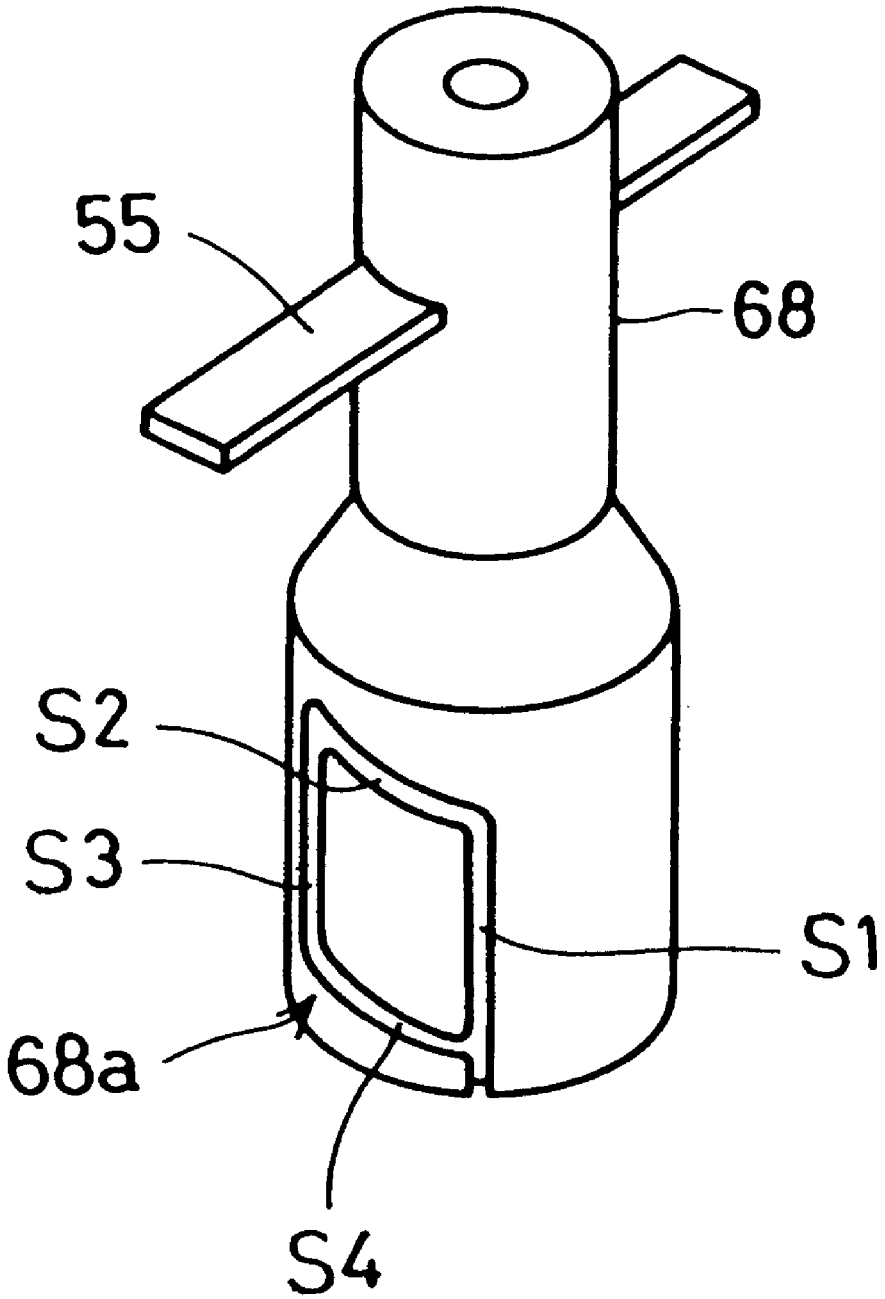
FIG. 33 is a perspective view showing a portion of the push-button switch according to the sixth embodiment.
Figure 34:
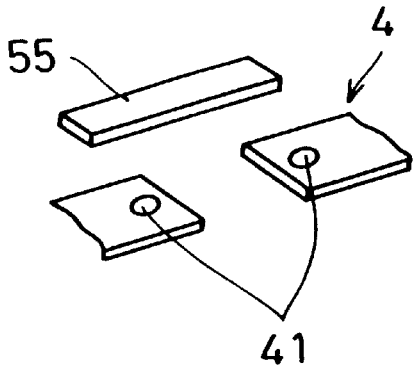
FIG. 34 is a perspective view for illustration of operation according to the sixth embodiment.
Figure 35:
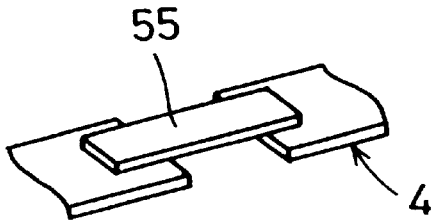
FIG. 35 is a perspective view for illustration of the operation according to the sixth embodiment.
Figure 36:
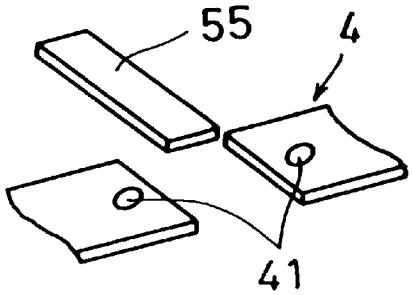
FIG. 36 is a perspective view for illustration of the operation according to the sixth embodiment.

FIG. 32 is a sectional front view showing a push-button switch according to the sixth embodiment; FIG. 33 is a perspective view showing a portion thereof; and FIGS. 34 to 36 are perspective views for illustration of the operations. In the figures, the same reference characters with those of the first embodiment represent the same or equivalent portions.

The sixth embodiment particularly differs from the first embodiment in the construction of the movable terminal and the support therefor. Accordingly, the description focuses on such differences and a detailed explanation of the other portions is dispensed with.

As shown in FIGS. 32 and 33, this embodiment is arranged such that a shaft 68, constituting the lower part of the switching mechanism 6, is rotatably coupled to the inserted portion 61, constituting the upper part thereof, in projection/depression fitting relation and that a pair of movable terminals 55, 55 are attached to an upper end portion of the shaft 68. Both movable terminals 55 have the second contacts 51 affixed to the respective lower surfaces of end portions thereof.

A lower end portion of the shaft 68 is received by the hole 31*b* of the bottom 31 of the case 3 and is formed with cam grooves 68*a*, such as shown in FIG. 33, in its peripheral surface, the cam grooves opposing each other. Projections 31*f* disposed on the circumferential surface of the hole 31*b* are fittedly received by such cam grooves 68*a*.

The cam groove 68*a* consists of a first groove S1 defined in the peripheral surface of the lower end portion of the shaft 68 and extended vertically, a second groove S2 continuous to an upper end of the first groove S1 and extended diagonally upward, a third groove S3 continuous to an end of the second groove S2 and extended downward, and a fourth groove S4 continuous to a lower end of the third groove S3 and extended diagonally downward to join a lower end of the first groove S1.

A recess 68*b* is formed in the bottom surface of the shaft 68 of the switching mechanism 6. Within the recess 68*b*, a boss 68*c* is integrally formed with the shaft 68 and carries the coiled spring 12, as the return spring, thereabout.

Next, a brief description will be made of the operation. If the push button 2 in the first OFF state shown in FIGS. 32 and 34 is depressed, the same operations as in the first embodiment take place so that the switching mechanism 6 is moved down along with the push button 2 because of the engagement between the slopes 8*a* of the slide blocks 8 and the slopes 2*b* of the push button 2.

At this time, the downward movement of the switching mechanism 6 causes the projections 31*f* to move relatively through the first vertical grooves S1 of the cam grooves 38*a*. Accordingly, while moving through the first grooves S1, the projections 31*f* inhibits the rotation of the shaft 68.

If the length of the first groove S1 is so defined that the switch is shifted to the ON state by bringing the first and second contacts 41, 51 into contact exactly when the projections 31*f* have reached the upper ends of the first groove S1 of the cam grooves 68*a* in conjunction with the downward movement of the switching mechanism 6 caused by the depression of the push button 2, the switch is shifted from the first OFF state to the ON state as shown in FIG. 35 when the switching mechanism 6 has been lowered, by depressing the push button 2, for a distance equivalent to the length of the first groove S1 of the cam groove 68*a*.

Subsequently, if the push button 2 in the ON state is further pressed down, the slopes 8*a* of the slide blocks 8 start sliding on the slopes 2*b* of the push button 2 to bring the slide blocks 8 into sliding movement into the holes 61*a* in the same manner as the third embodiment. Eventually, the slide blocks 8 are completely retracted into the holes 61*a* thereby to disengage the slopes 2*b* of the push button 2 from the slopes 8*a* of the slide blocks 8. This permits the inserted portion 61 of the switching mechanism 6 to move up and down in the hole 2*a* of the push button 2 and hence, the switching mechanism 6 is not interlocked with the depression of the push button 2.

At this time, on the other hand, the coiled spring 12 in the hole 31*b* of the case bottom 31 is compressed so that upon disengagement of the slopes 2*b* of the push button 2 from the slopes 8*a* of the slide blocks 8, the spring force of the coiled spring 12 causes the upper part of the switching mechanism 6 to move upward in the hole 2*a* of the push button 2 and also the whole body of the switching mechanism 6 to move upward, as described supra.

At this time, the projections 3 1f move relatively through the second grooves S2 and the third grooves S3 of the cam grooves 38*a*. During the movement of the projections 31*f* through the second grooves S2 of the cam grooves 38*a*, the shaft 68 is rotated relative to the projections 31*f*. If the length of the second groove S2 is defined such that the shaft 68 has substantially rotated through 90° to disengage the slopes 2*b* of the push button 2 from the slopes 8*a* of the slide blocks 8 exactly when the projection 31 reaches the end of the second groove S2, the switch is shifted from the ON state to the second OFF state shown in FIG. 36 when the push button 2 in the ON state is pressed down to cause the projections 31*f* to move through the second grooves S2.

Subsequently, as mentioned supra, the projections 31*f* move through the third grooves S3 and the fourth grooves S4 of the cam grooves 68*a* while the switching mechanism 6 is moved upward by the spring force of the coiled spring 12. While the projections 31*f* move through the fourth grooves S4, the shaft 68 is rotated substantially through 90° in the opposite direction to the above, returning the switch to the initial or the first OFF state (see FIG. 34).

Thus, the combination of the cam grooves 68*a* and the projections 31*f* ensures that the switch is shifted from the first OFF state to the ON state in conjunction with the depression of the push button 2 and is shifted from the ON state to the second OFF state by the 90° rotation of the shaft 68.

Thus, according to the sixth embodiment, the switch is stably shifted from the ON state to the second OFF state without the switching mechanism of the first embodiment and hence, the stable switching operations are accomplished.

Inasmuch as the shaft 68 in this case is configured to rotate, the first and second contacts 41, 51 can be forced into separation by the rotation of the shaft 68 even if the first and second contacts are fused to each other. This negates the special need for providing the forcible separation means.

(Seventh Embodiment)

Next, a seventh embodiment of the invention will be described with reference to FIGS. 37 to 41.

Figure 37:
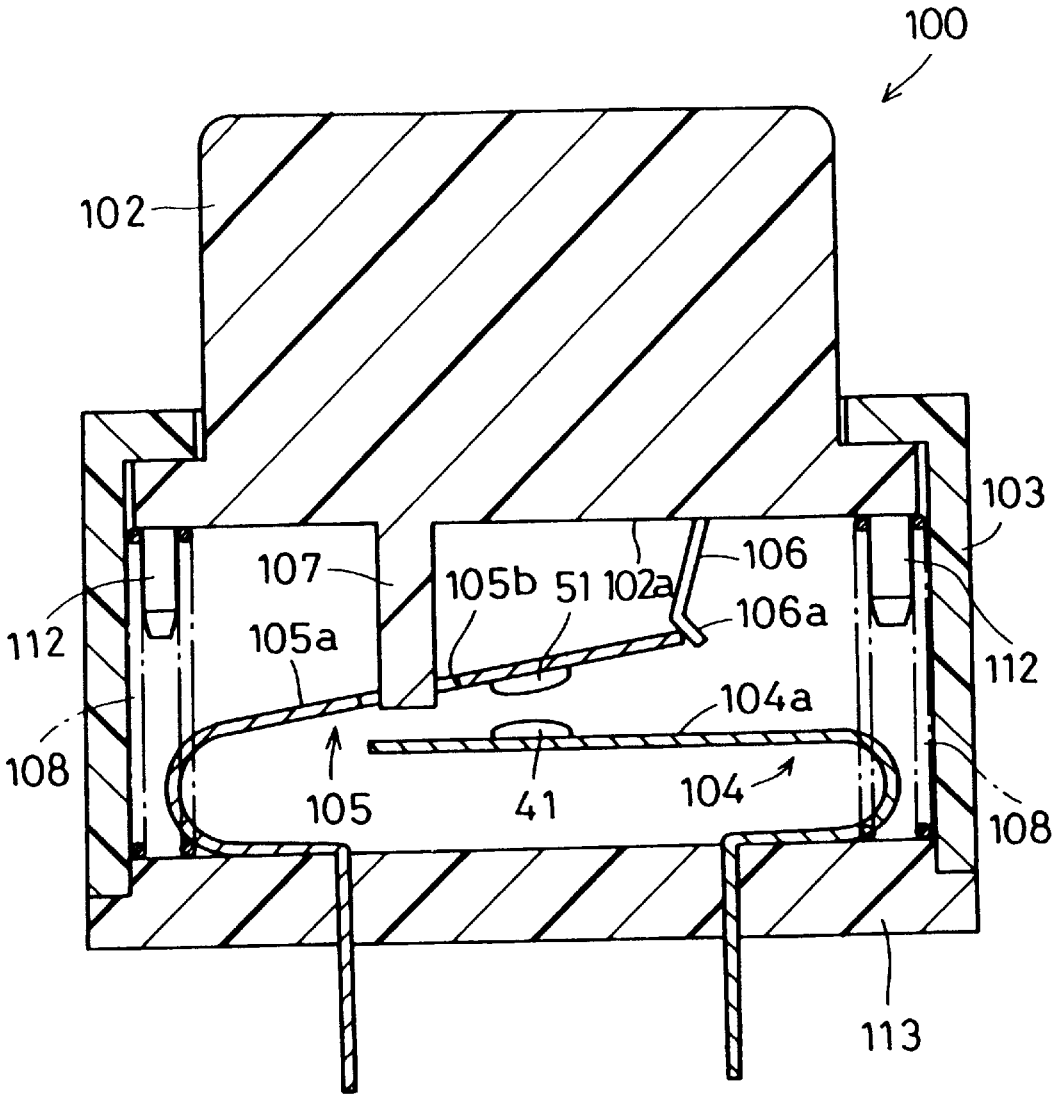
FIG. 37 is a sectional front view showing a push-button switch according to a seventh embodiment hereof.
Figure 38:
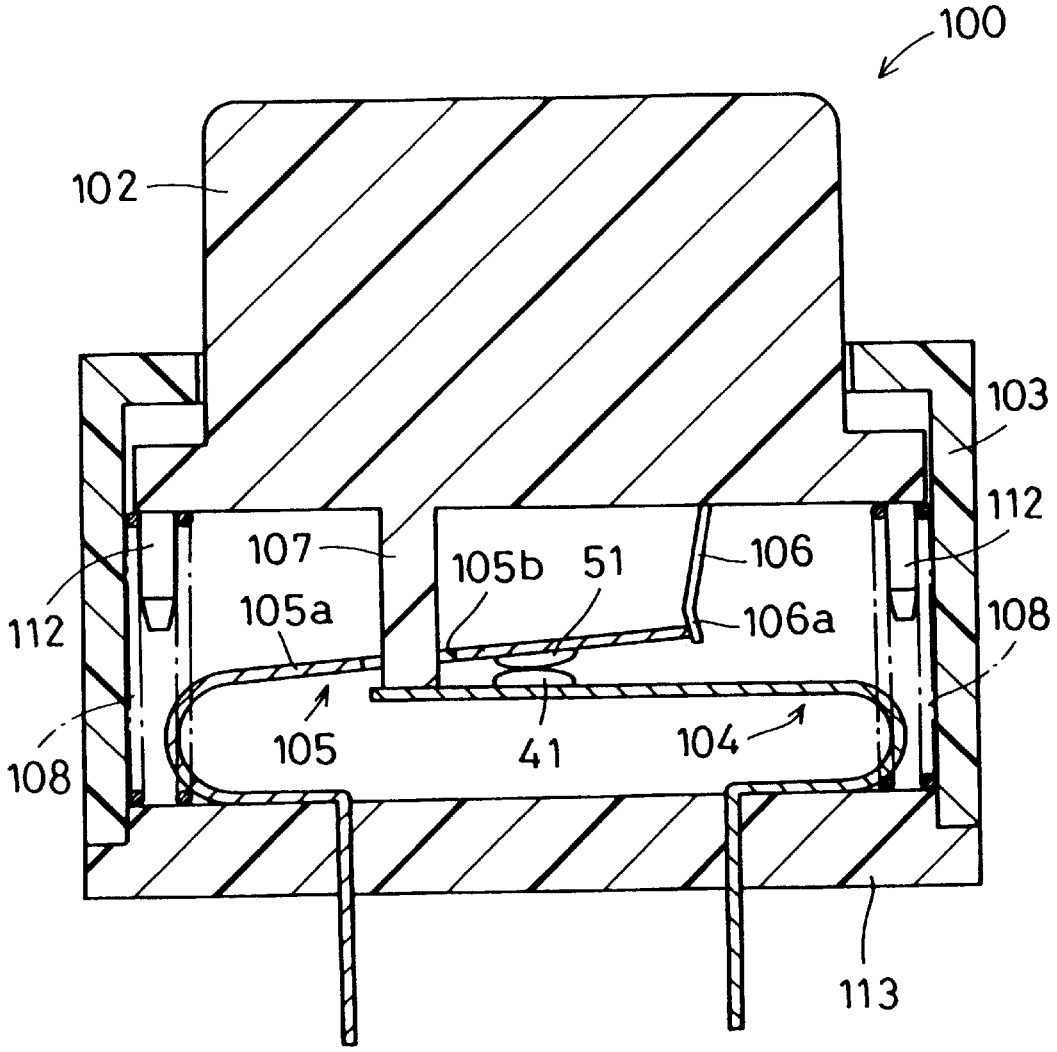
FIG. 38 is a sectional front view for illustration of operation of the push-button switch according to the seventh embodiment.
Figure 39:
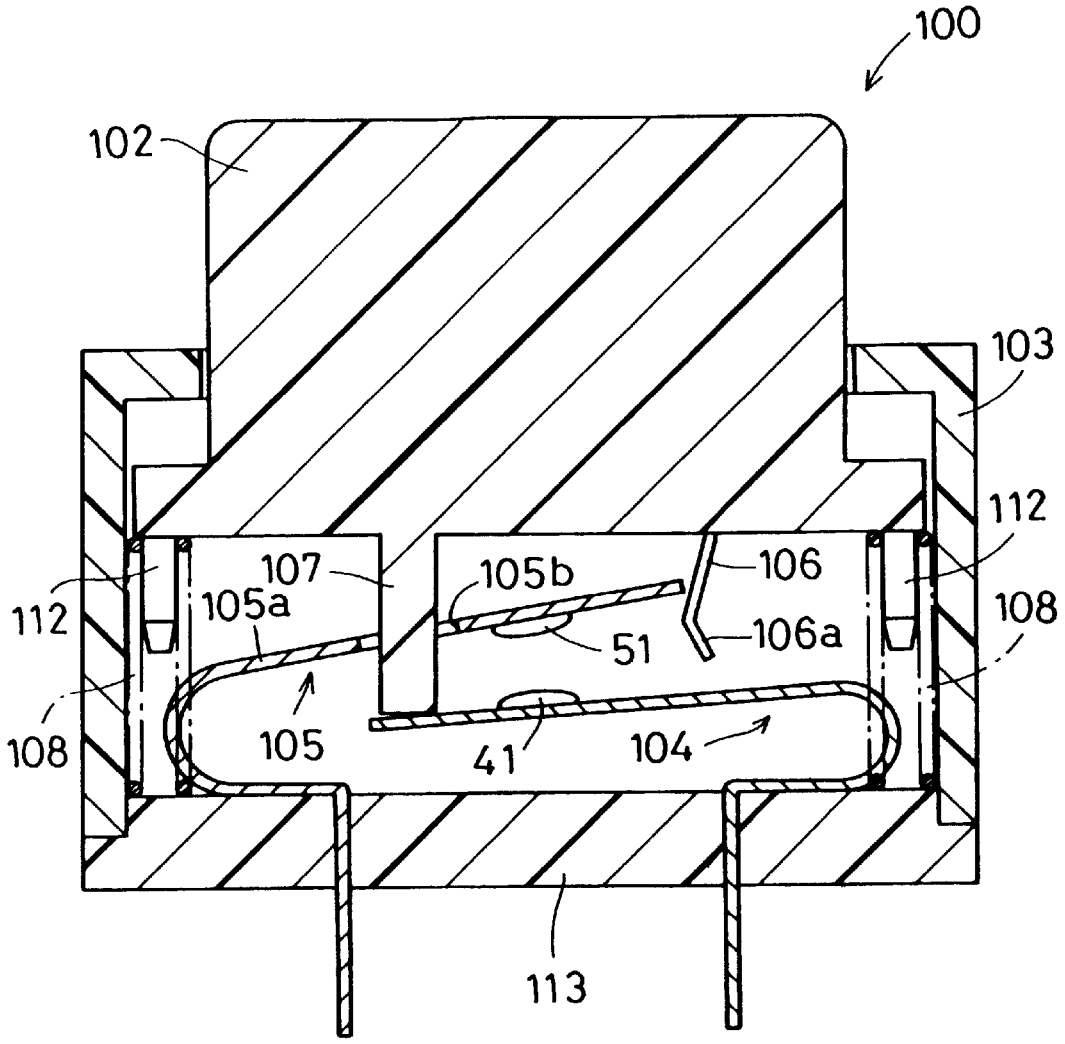
FIG. 39 is a sectional front view for illustration of the operation of the push-button switch according to the seventh embodiment.
Figure 40:
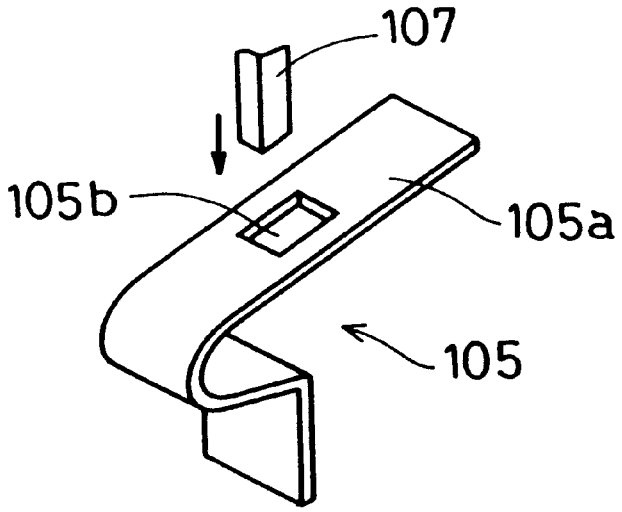
FIG. 40 is an exploded perspective view showing a portion of the push-button switch according to the seventh embodiment.

FIG. 37 is a sectional front view showing a push-button switch according to the seventh embodiment; FIGS. 38 and 39 sectional front views for illustration of the operations; FIG. 40 an exploded perspective view showing a portion of the switch; and FIG. 41 an exploded perspective view showing a modification of the portion.

As shown in FIG. 37, a push-button switch 100 includes a push button 102 substantially of a rectangular parallelpiped shape, a case 103 for supporting the push button 102, a stationary terminal 104 as a first electrically conductive member fixed to a bottom 113 of the case 103, a movable terminal 105 as a second electrically conductive member disposed above the stationary terminal 104, a leaf spring 106 fixed to a lower side of the push button 102, and an operating member 107 for forcible separation which is attached to the lower side of the push button 102.

A plurality of support shafts 112 are projected downward from end portions of the lower side of the push button 2. Each of the support shafts 112 carries thereabout a coiled spring 108 having a greater length than the support shaft 112. Each coiled spring 108 has its upper end locked to a lower surface 102*a* of the push button 2 and its lower end locked to the bottom 113. The push button 2 is constantly urged upward by a spring force of these coiled springs 108.

The stationary terminal 104 is comprised of a member which has its root portion supported by the bottom 113 of the case 103 as extended therethrough and which is substantially bent into a U-shape within the case 103. Such a bent portion 104*a* has resilience or spring characteristics with respect to the vertical axis. The first contact 41 is affixed to an upper side of a distal end of the bent portion 104*a*.

In the substantially the same manner as the stationary terminal 104, the movable terminal 105 is also comprised of a member which has its root portion supported by the bottom 113 of the case 103 as extended therethrough and which is substantially bent into a U-shape within the case 103. Such a bent portion 105*a* has resilience or spring characteristics with respect to vertical directions. The bent portion 105*a* is interposed between the push button 102 and the bent portion 104*a* of the stationary terminal 104. The second contact 51 is affixed to a lower side of a distal end of the bent portion 105*a* in face-to-face relation with the first contact 41.

The leaf spring 106 has its upper end fixed to the push button 102 and a tip of a lower end thereof positioned close to the distal end of the bent portion 105*a* of the movable terminal 105. A leftward spring force is applied to the lower end of the leaf spring 106.

The tip of the lower end of the leaf spring 106 is bent in a direction away from the distal end of the bent portion 105*a* of the movable terminal 105, thereby defining a bent portion 106*a* at the lower end of the leaf spring 106. This bent portion 106*a* is brought into engagement with the distal end of the bent portion 105*a* of the movable terminal 105 in conjunction with the depression of the push button 102.

Incidentally, as shown in FIG. 40, a rectangular through hole 105*b* is defined substantially in a midportion of the bent portion 105*a* of the movable terminal 105. Upon depression of the push button 102, the operating member 107 freely passes through this through hole 105*b* so that a lower end of the operating member 107 pushes down the distal end of the bent portion 104*a*.

Next, a brief description will be made of the operation. If the push button 102 is depressed in the first OFF state shown in FIG. 37, the leaf spring 106 lowers as interlocked with the depression of the push button 102 whereby the bent portion 106*a* abuttingly engages the distal end of the bent portion 105*a* of the movable terminal 105.

In an initial stage of the depression of the push button 102, the spring force of the leaf spring 106 acts to keep the bent portion 106*a* engaged with the distal end of the bent portion 105*a* of the movable terminal 105 thereby permitting the bent portion 106*a* to push down the bent portion 105*a* of the movable terminal 105. Eventually, as shown in FIG. 38, the second contact 51 comes into contact with the first contact 41 for shifting the switch to the ON state.

Subsequently, if the amount of depression of the push button 2 is further increased, the bent portion 106*a* starts to move in a direction (rightward) to leave the distal end of the bent portion 105*a* of the movable terminal 105 against the spring force of the leaf spring 106. The bent portion 106*a* slides on the distal end of the bent portion 105*a* of the movable terminal 105 thereby disengaging the bent portion 106*a* from the distal end of the bent portion 105*a* of the movable terminal 105. Then, the distal end of the bent portion 105*a* of the movable terminal 105 is returned to its original upper position by the spring force of the bent portion thereby bringing the second contact 51 out of contact with the first contact 41, as shown in FIG. 39. Thus, the switch is shifted from the ON state to the second OFF state.

If, on the other hand, the push button 102 in the second OFF state is further pressed down, the lower end of the operating member 107 is pressed against the distal end of the bent portion 104*a* of the stationary terminal 104 to push it down. Therefore, even if the first and second contacts 41, 51 are fused to each other, the operating member 107 forcibly separates them from each other by pushing down the bent portion 104*a* of the stationary terminal 104.

Thus, according to the seventh embodiment, the switch can be stably shifted from the ON state to the second OFF state by means of the leaf spring 106 without resorting to the switching mechanism of the first embodiment. Hence,the stable switching operations can be accomplished by the simple construction.

In addition, even if the switch is not smoothly shifted to the second OFF state because of a lowered spring force of the leaf spring 106 or the contacts are fused to each other, the operating member 107 is capable of forcing the contacts into separation.

Figure 41:
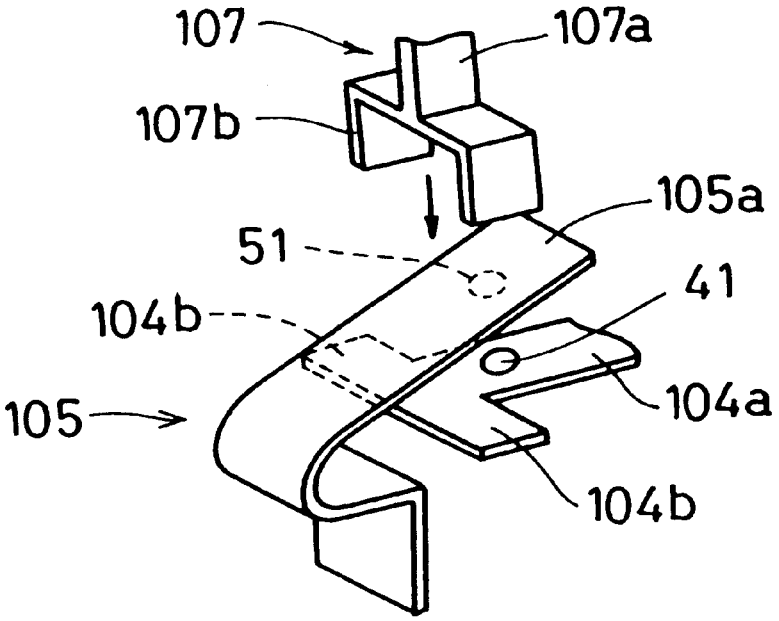
FIG. 41 is an exploded perspective view showing a modification of the portion of the push-button switch according to the seventh embodiment.

Incidentally, a modification of the operating member may be comprised of, as shown in FIG. 41, a bar-like fixing member 107 secured to the lower side of the push button 102 and a U-shaped member 107*b* affixed to a lower end of the fixing member 107*a*. An extension piece 104*b* is disposed at the distal end of the bent portion 104*a* of the stationary terminal 104 as extended forward and backward relative to the bent portion such that the U-shaped member 107*b* may be pressed against the extension piece 104*b* as circumventing the bent portion 105*a* of the movable terminal 105 in a manner to straddle the movable terminal.

(Eighth Embodiment)

Next, an eighth embodiment of the invention will be described with reference to FIGS. 42 to 44.

Figure 42:
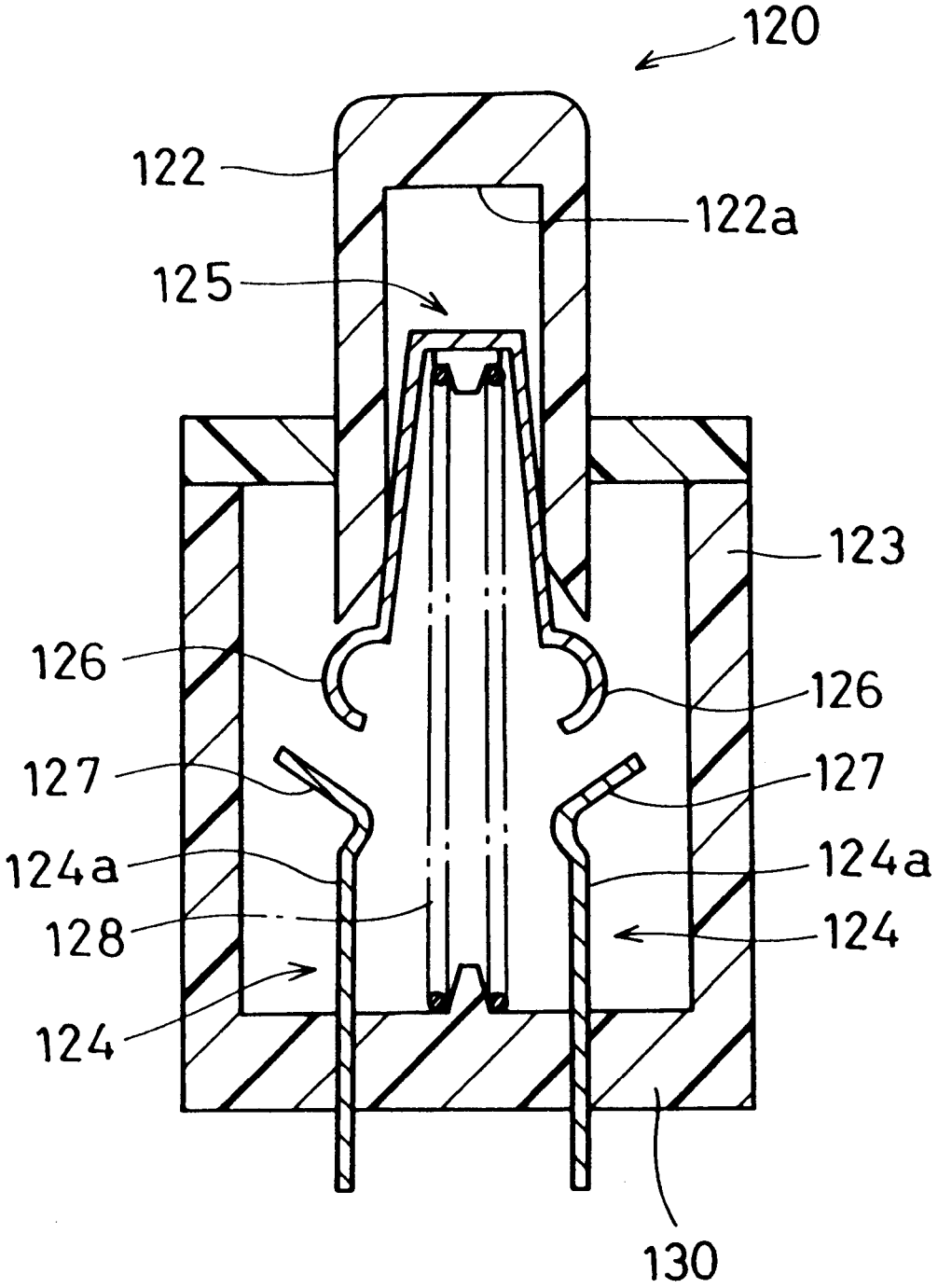
FIG. 42 is a sectional side view showing a push-button switch according to an eighth embodiment hereof.
Figure 43:
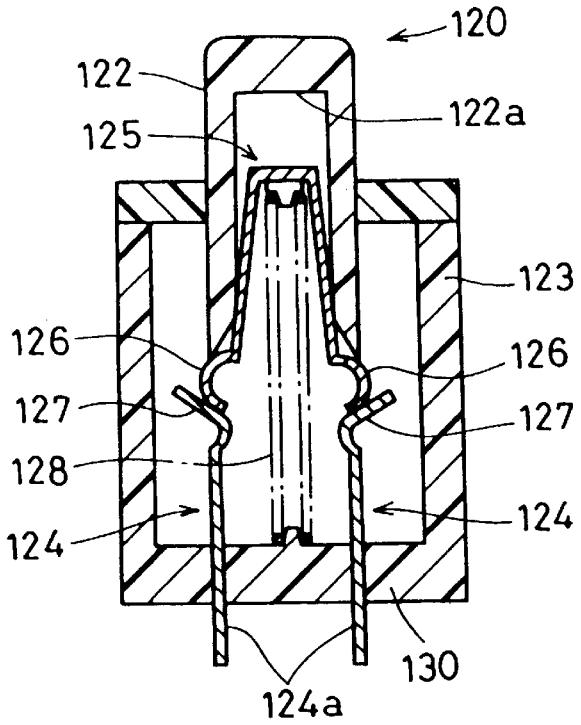
FIG. 43 is a sectional side view for illustration of operation of the push-button switch according to the eighth embodiment.
Figure 44:
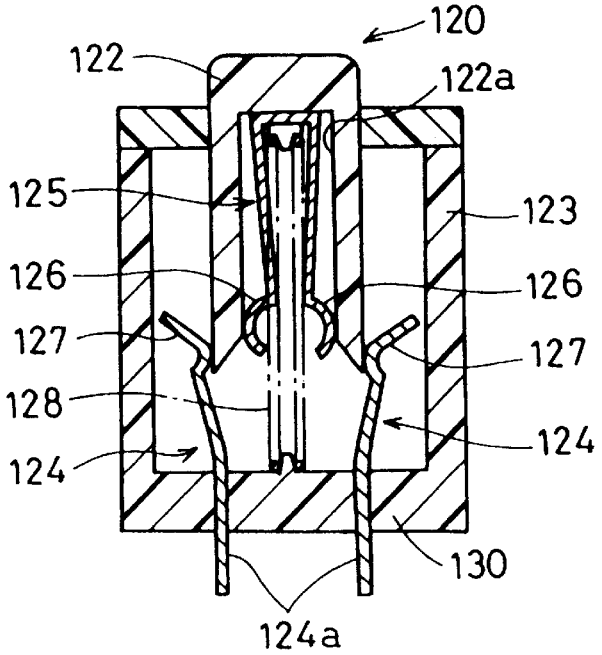
FIG. 44 is a sectional side view for illustration of the operation of the push-button switch according to the eighth embodiment.

FIG. 42 is a sectional side view showing a push-button switch according to the eighth embodiment; and FIGS. 43 and 44 are sectional side views for illustration of the operations.

As seen in these figures, a push-button switch 120 is formed of an electrically insulative material, such as a resin, and includes a hollow push button 122 of a substantially rectangular parallelepiped shape, a case 123 for supporting the push button 122, an electrically conductive stationary terminal 124 fixed to a bottom 130 of the case 123, and an electrically conductive movable terminal 125 accommodated in the hollow portion of the push button 122 with its lower end portions allowed to project downward of the hollow portion.

As shown in FIGS. 42 to 44, the stationary terminal 124 includes a pair of electrically conductive plate-like members 124*a*, 124*a* which are extended through the bottom 130 of the case 123 as positioned in parallel at fore and rear places, respectively. First contacts 127, 127, bent outwardly, are integrally formed with upper end portions of the plate-like members 124*a*, 124*a* within the case 123. The upper end portions of the plate-like members 124*a*, 124*a* are subject to a spring force which acts in a direction to reduce a gap therebetween when an external force acts to push open the gap between the upper end portions of the plate-like members 124*a*, 124*a*.

The push button 122 is formed with a concave hole 122*a* at a lower side thereof, thus configured as a hollow structure. The movable terminal 125 is accommodated in the concave hole 122*a*. The movable terminal 125 has a U-shaped section. Second contacts 126, 126, which have an arcuate section and are curved outward, are integrally formed with the lower end portions of the movable terminal 125, respectively. The lower end portions of the movable terminal 125 are subject to a spring force acting in a direction to expand a gap therebetween. Thus, the second contacts 126 at the lower ends of the movable terminal 125 are adapted to retract into the hole 122*a* of the push button 122 or to project out of the hole 122*a*. Incidentally, lower end portions of the push button 122, which come into sliding contact with the second contacts 126, are tapered for facilitating the retraction and projection of the second contacts 126.

A coiled spring 128 is disposed in the case 123 and has opposite ends thereof locked to the bottom 130 and the movable terminal 125, respectively, so that the movable terminal 125 is urged upward. Although not shown in the figures, the same coiled springs as in the first embodiment are also disposed in the case 123 such that the push button 122 may be returned to its initial position when the push button 122 is released.

When the state wherein the movable terminal 125 is retracted in the hole 122*a* of the depressed push button 122 is returned to the initial state, the push button 122 is moved up by the spring force of the coiled springs for returning the push button 122 while the movable terminal 125 is moved up by a spring force of the coiled spring 128.

The upward movements of the push button 122 and the movable terminal 125 are substantially interlocked. However, an unillustrated locking body serves to lock against further upward movement of the movable terminal 125 so that the movable terminal 125 is stopped at place corresponding to its initial position whereas the push button continues to rise further.

As a result, the second contacts 126 at the lower ends of the movable terminal 125 project again from the hole 122*a* of the push button 122, returning to their initial positions prior to the depression of the push button.

Next, a brief description will be made of the operation. If the push button 122 is depressed in the first OFF state shown in FIG. 42, the second contacts at the lower ends of the movable terminal 125, which are projected from the hole 122*a* of the push button 122 at this point of time, are lowered in synchronism with the depression of the push button 122 while maintaining this projected position. Eventually, as shown in FIG. 43, the second contacts 126 come into contact with the first contacts 127, shifting the switch from the first OFF state to the ON state.

Subsequently, as the amount of depression of the push button 122 further increases, the depressed push button 122 continues to lower further against the spring force of the coiled spring 128 and the abutment force between the first and second contacts 127, 126, which forces act to hold the movable terminal 125 at place to establish the contact between the first and second contacts 127, 126. Accordingly, the push button 122 opposes the spring forces to reduce the gap between the opposite lower ends of the movable terminal 125 so that, as shown in FIG. 44, the movable terminal 125 is moved up in the hole 122*a* relative to the push button 122. Thus, the second contacts 126 are retracted into the push button 122 while the lower end portion of the push button 122 is interposed between the first and second contacts 127, 126. Hence, the first and second contacts 127, 126 are electrically isolated from each other whereby the switch is shifted from the ON state to the second OFF state.

Then if the push button 122 is released after the switch is shifted to the second OFF state, the spring forces of the coiled spring 128 and the like act to elevate the push button 122 together with the movable terminal 125 staying retracted in the hole 122*a* of the push button 122, as mentioned supra. When the movable terminal 125 moves up to the initial position prior to the depression of the push button, the aforesaid locking body locks against the upward movement of the movable terminal 125 whereas the push button 122 continues to be elevated further by the spring force of the coiled return springs. Therefore, the second contacts 126 at the lower ends of the movable terminal 125 are allowed to project from the hole 122*a* of the push button 122 while the push button 122 continues to move up and to the initial position shown in FIG. 42. Thus, the switch is returned to the initial first OFF state.

Thus, according to the eighth embodiment, the switch can be stably shifted from the ON state to the second OFF state without resorting to the switching mechanism of the first embodiment. Hence, the stable switching operations can be accomplished by the simple construction.

In this case, the arrangement is made such that the lower end of the push button 122 is interposed between the first and second contacts 127, 126 in contact for electrically isolating the first and second contacts 127, 126 from each other. Therefore, even if the first and second contacts 127, 126 are fused to each other, the first and second contacts 127, 126 can be forced into separation. Hence, there is no need for providing special means as the forcible separation means.

(Ninth Embodiment)

Figure 45:
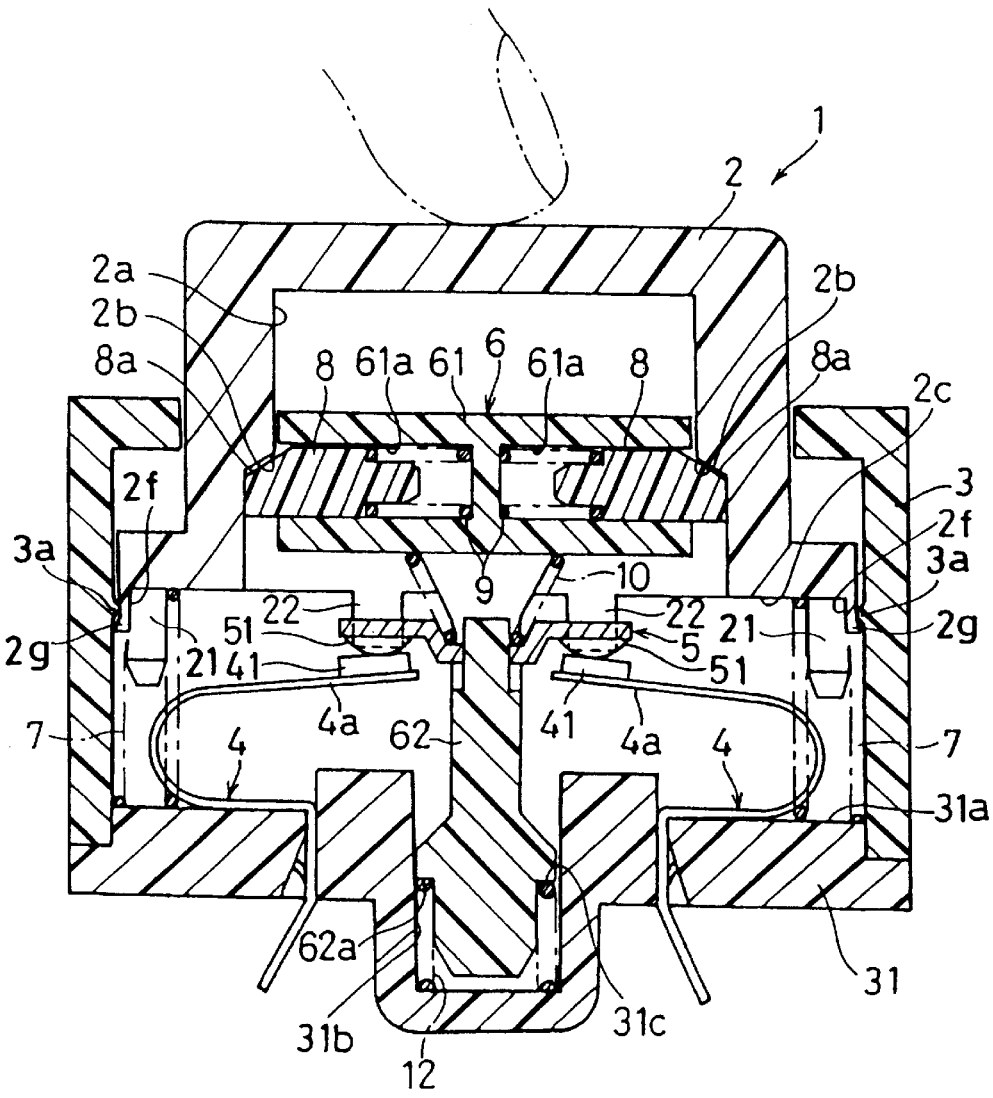
FIG. 45 is a sectional front view showing a push-button switch according to a ninth embodiment hereof.
Figure 46:
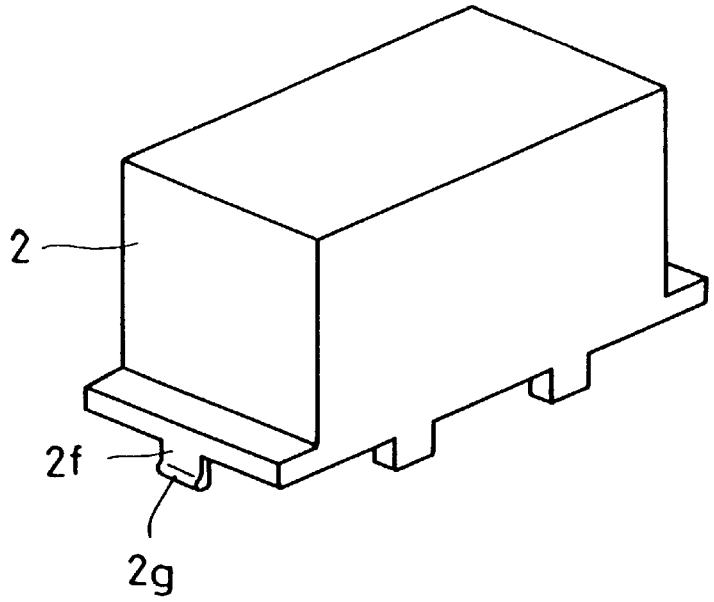
FIG. 46 is a perspective view showing a portion of the push-button switch according to the ninth embodiment.

Next, a ninth embodiment of the invention will be described with reference to FIGS. 45 to 47. Incidentally, FIG. 45 is a sectional front view showing a push-button switch according to the ninth embodiment; and FIGS. 45 and 46 are a perspective view of a portion thereof and an enlarged sectional view of another portion thereof. In the figures, the same reference characters as those of the first embodiment represent the same or equivalent portions.

The ninth embodiment somewhat differs from the first embodiment specifically in the construction of the push button 2. Accordingly, the description focuses on the difference and a detailed explanation of the other portions is dispensed with.

Figure 47:
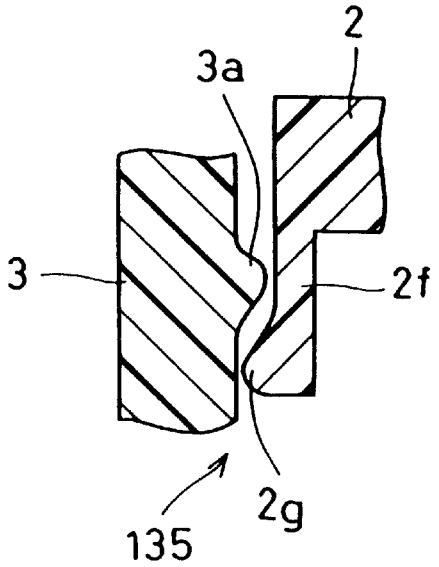
FIG. 47 is an enlarged sectional view showing a portion of the push-button switch according to the ninth embodiment.

As shown in FIGS. 45 to 47, extension pieces 2*f*, 2*f* are integrally formed with the lower side of the push button 2, as extended downward from laterally opposite places of the lower end of the push button. Projections 2*g*, 2*g* are formed on outer peripheral surfaces of the extension pieces 2*f*, 2*f*, respectively, whereas projections 3*a*, 3*a* to come into sliding contact with the respective projections 2*g*, 2*g* of the push button 2, are formed at laterally opposite places on an inside circumferential surface of the case 3. These projections 2*g*, 3*a* constitute a tactile click-touch generating mechanism 135 for providing a tactile click-touch when the switch is shifted from the first OFF state to the ON state.

In this case, the projections 2*g*, 2*g* of the push button 2 and the projections 3*a*, 3*a* of the case 3 are formed in such a positional relation that the projections 2*g* may slidably move beyond the projections 3*a* immediately before the first and second contacts 41, 51 are brought into contact.

By providing the tactile click-touch generating mechanism 135 in this manner, a resistance is generated when the projections 2*g* slidably move beyond the projections 3*a* in conjunction with the switch shift from the first OFF state to the ON state. This resistance is recognized as the tactile click-touch by the operator.

Thus, according to the ninth embodiment, the operator is provided with the tactile click-touch when the switch is shifted from the first OFF state to the ON state. Hence, the operator can distinctly recognize that the switch is shifted from the first OFF state to the ON state.

It is noted that the tactile click-touch generating mechanism should not be limited to the above construction. In short, any construction that is capable of generating the tactile click-touch at the switch shift from the first OFF state to the ON state may serve this purpose. For instance, an arrangement may be made such that a recess is formed in an outside surface of the push button 2 or in an inside surface of the case 3 to accommodate therein a ball and a spring for urging the ball outwardly thereof, the ball being retained in a manner to be prevented from slipping off the recess and to be partially projected from the recess, whereas a projection to come into sliding contact with the ball is formed on the inside surface of the case 3 or in the outside surface of the push button 2 at a place corresponding to the recess. In this case, the tactile click-touch is provided when the ball moves beyond the projection.

As a matter of course, the aforementioned tactile click-touch generating mechanism may be applied to the push-button switches of the second to the eighth embodiments.

(Tenth Embodiment)

Figure 48:
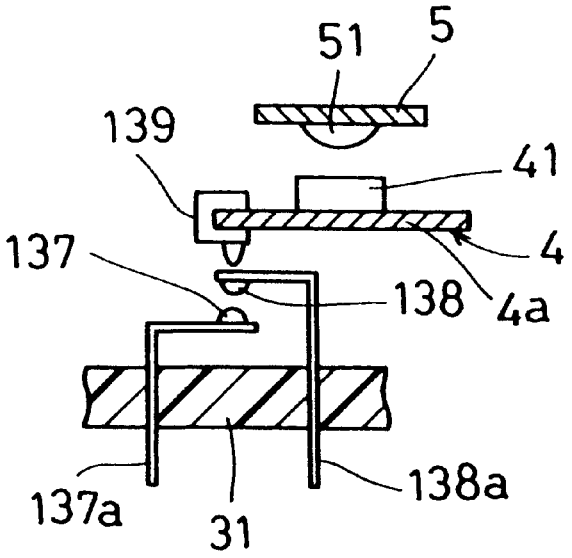
FIG. 48 is a sectional side view showing a sate of a portion of a push-button switch according to a tenth embodiment hereof.
Figure 49:
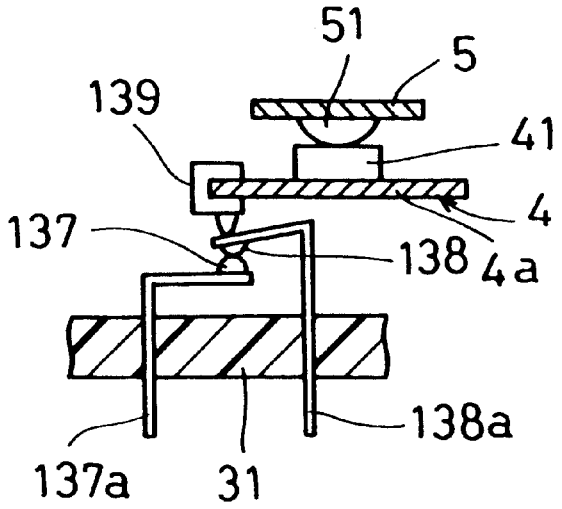
FIG. 49 is a sectional side view showing a different state of the portion of the push-button switch according to the tenth embodiment.

Next, a tenth embodiment of the invention will be described with reference to FIGS. 48 and 49. FIGS. 48 and 49 are sectional side views showing a portion of a push-button switch according to the tenth embodiment in different states. In the figures, the same reference characters as those of the first embodiment represent the same or equivalent portions.

The description of the tenth embodiment focuses solely on difference from the first embodiment and hence, a detailed explanation of the other portions is dispensed with.

As shown in FIGS. 48 and 49, a pair of auxiliary contacts including an auxiliary stationary contact 137 and an auxiliary movable contact 138 are disposed at places under the distal end of the bent portion 4*a* of the stationary terminal 4 in the case 3. An operating body 139 formed of an insulative material such as a resin is affixed to the bent portion 4*a* of the stationary terminal 4. The operating body is adapted to push down the auxiliary movable contact 138 in synchronism with the contact between the first and second contacts 41, 51, thereby bringing the auxiliary movable contact 138 into contact with the auxiliary stationary contact 137.

In this case, L-shaped fixing members 137*a*, 138*a* are extended through the bottom 31 of the case 3 while distal end portions of the fixing members 137*a*, 138*a* are so disposed as to vertically oppose each other in the case 3. The auxiliary stationary contact 137 is affixed to an upper side of the distal end of the fixing member 137*a* whereas the auxiliary movable contact 138 is affixed to a lower side of the distal end of the fixing member 138*a*.

Additionally, other projections equivalent to the projections 22 may be provided, for example, at the bottom of the push button 2 such as to separate the auxiliary stationary contact 137 from the auxiliary movable contact 138 in synchronism with the forcible separation effected by the projections 22 of the push button 2 pushing down the distal end of the bent portion 4*a* of the stationary terminal 4. The other projections serve to push down the distal end of the fixing member 137*a* of the auxiliary stationary contact 137.

Incidentally, the distal end of the bent portion 4*a* of the stationary terminal 4 is lowered a little when the push button 2 is depressed to shift the switch to the ON state. When the terminals are forced into separation, the amount of lower movement of the bent portion 4*a* of the stationary terminal 4 is increased. The auxiliary stationary contact 137 and the auxiliary movable contact 138 are disposed so as not to interfere with such a lower movement of the distal end of the bent portion 4*a* of the stationary terminal 4.

Such a provision of the auxiliary stationary contact 137 and the auxiliary movable contact 138 in combination with the first and second contacts 41, 51 permits a single switch to effect the switching of the circuit by means of the first and second contacts 41, 51 as well as the switching of another circuit by means of the auxiliary stationary contact 137 and auxiliary movable contact 138.

Accordingly to the tenth embodiment, a single switch is allowed to effect the switching of the circuit by means of the first and second contacts 41, 51 as well as the switching of another circuit, because of the provision of the auxiliary stationary contact 137 and the auxiliary movable contact 138 within the case 3.

Needless to say, the construction and arrangement of the auxiliary contact pair should not be limited to the above. Any arrangement is applicable as long as both auxiliary contacts may be brought either into and out of contact when the first and second contacts 41, 51 come into contact while both auxiliary contacts may be brought either out of or into contact when the first and second contacts 41, 51 are separated from each other.

Incidentally, a plurality of such auxiliary contact pairs may be provided in the case 3. In addition, the aforesaid pair of auxiliary contacts may be provided in the push-button switches of the second to eighth embodiments hereof.

(Eleventh Embodiment)

Figure 50:
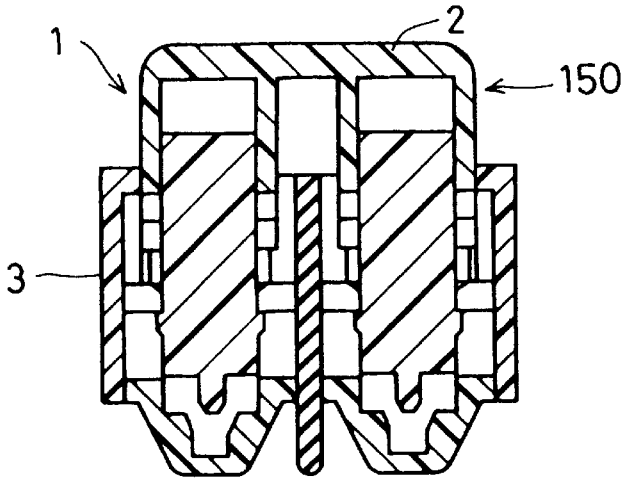
FIG. 50 is a sectional side view showing a schematic construction of a push-button switch according to an eleventh embodiment hereof.
Figure 51:
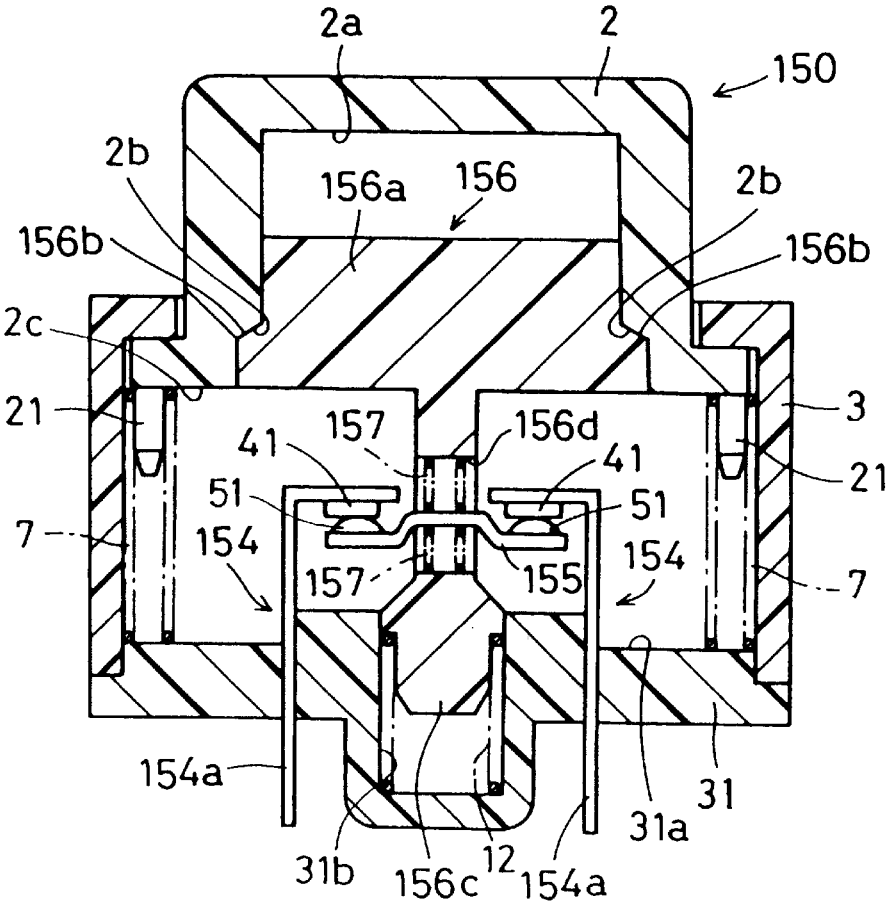
FIG. 51 is a sectional rear view showing the push-button switch according to the eleventh embodiment.

Next, an eleventh embodiment of the invention will be described with reference to FIGS. 50 and 51. FIG. 50 is a sectional side view showing a schematic construction of a push-button switch according to the eleventh embodiment; and FIG. 51 is a sectional rear view thereof. In the figures, the same reference characters as those of the first embodiment represent the same or equivalent portions.

In this embodiment, as shown in FIG. 50, a normally closed switch 150 (NC switch) is juxtaposed with the push-button switch 1 of the first embodiment via an insulating partitioning member, thus sharing the push button 2 and the case 3.

As shown in FIG. 51, the NC switch 150 includes the push button 2 and the case 3, which also constitute the push-button switch 1, and a switching mechanism 156 possessing an electrically conductive stationary terminal 154 fixed to the bottom 31 of the case 3 and an electrically conductive movable terminal 155 disposed above the stationary terminal 154.

The push button 2 and the case 3 are both formed to have at least double the sizes of those of the first embodiment so as to accommodate the essential components of the push-button switch 1 and the NC switch 150. The concave hole 2*a* is also formed at a lower side of a portion of the push button 2 that receives the NC switch 150. This hole 2*a* is stepped substantially at midportions of left and right sides thereof. Both stepped portions of the hole 2*a* are formed with slopes 2*b*, 2*b*, respectively. A plurality of support shafts 21 project downward from the lower side of the push button 2 in a similar manner to the push-button switch 1. Each support shaft 21 carries thereabout the coiled spring 7 greater in length than the support shaft. Each coiled spring 7 has its upper end locked to the lower surface 2*c* of the push button 2 and its lower end locked to the bottom surface 31*a* of the bottom 31. The push button 2 is constantly urged upward by the spring force of these coiled springs 7.

The stationary terminal 154 consists of a pair of L-shaped fixing members 154*a* extended through the bottom of the case 3. The first contact 41 is affixed to the lower side of the upper end portion of the fixing member 154*a* in the case 3.

An inserted portion 156*a* at an upper part of the switching mechanism 156 is inserted in the hole 2*a* of the push button 2. The inserted portion 156*a* is formed with slopes 156*b* in engagement with the slopes 2*b* of the push button 2. The engagement between the slopes 2*b*, 156*b* serves to interlock the depression of the push button 2 with a downward movement of the switching mechanism 156.

Disposed at a lower part of the switching mechanism 156 is a shaft 156*c* extended downward. A substantial midportion of the shaft 156 is formed with a notched recess 156*d* of U-shape in which a midportion of the movable terminal 155 is disposed. The second contacts 51 are affixed to respective upper sides of the opposite ends of the movable terminal 155. The movable terminal 155 is disposed in a manner that the second contacts 51 are in contact with the first contacts 41 when the push button 2 is not depressed.

In this case, coiled springs 157, 157 are disposed on upper and lower sides of the movable terminal 155 in the notched recess 156. The movable terminal 155 is held in the notched recess 155*d* by the spring force of the coiled springs 157, 157. In addition, the coiled springs 157, 157 are adapted to ensure a contact pressure under which the first contacts 41 are in contact with the second contacts.

A lower part of the shaft 156*c* is inserted in the hole 31*b* defined in the bottom 31 of the case 3. Similarly to the push-button switch 1, the hole 31*b* receives therein the coiled spring 12 as the return spring. An upper part of the coiled spring 12 is carried about a boss-like portion having a minor diameter and defined at the bottom portion of the shaft 156*c*. The shaft 156*c* is constantly urged upward by the spring force of this coiled spring 12.

Next, a brief description will be made on the operations of the NC switch 150 of this construction. When the push button 2 is not depressed or when the push-button switch 1 is in the first OFF state, the first and second contacts are in contact, as shown in FIG. 51, thus maintaining the NC switch 150 in the ON state.

If the push button 2 in this ON state is depressed, the push-button switch 1 is shifted from the first OFF state to the ON state as described in the first embodiment. In the NC switch 150, on the other hand, the switching mechanism 156 is moved down as interlocked with the depression of the push button 2, so that the movable terminal 155 is also lowered to separate the second contacts 51 from the first contacts 41. Thus, the NC switch is shifted from the ON sate to an OFF state.

Subsequently, if the push button 2 with the push-button switch 1 in the ON state is further pressed down, the push-button switch 1 is shifted from the ON state to the second OFF state, as described in the first embodiment. In the NC switch 150, on the other hand, the increase in the amount of depression of the push button 2 only results in the further downward movement of the switching mechanism 156 interlocked with the push button 2 and no change occurs in the state wherein the second contacts 51 are separated from the first contacts 41. Thus, the NC switch 150 maintains the OFF state.

That is, the push-button switch 1 assumes OFF states which include the aforementioned first OFF state or the initial state prior to the depression of the push button 2, and the second OFF state established by depressing the push button 2. In a circuit switched by means of the push button 2, however, it is impossible to determine whether the OFF state in which the circuit is interrupted is brought by the first OFF state of the push-button switch 1 or the second OFF state thereof.

On this account, there may be used a circuit switched by means of the NC switch 150 which is, as mentioned supra, in the ON sate when the push-button switch 1 is in the first OFF state and then is shifted to the OFF state when the push-button switch 1 is in the second OFF state. Thus, whether the push-button switch 1 is in the first OFF state or in the second OFF state can be readily determined based on the ON/OFF state of the NC switch 150.

According to the eleventh embodiment, whether the push-button switch 1 is in the first OFF state or in the second OFF state can be readily determined based on the ON/OFF state of the NC switch 150. This affords great convenience in carrying out various controls according to the state of the push-button switch 1.

Needless to say, the construction of the NC switch should not be limited to the above.

(Twelfth Embodiment)

Figure 52:
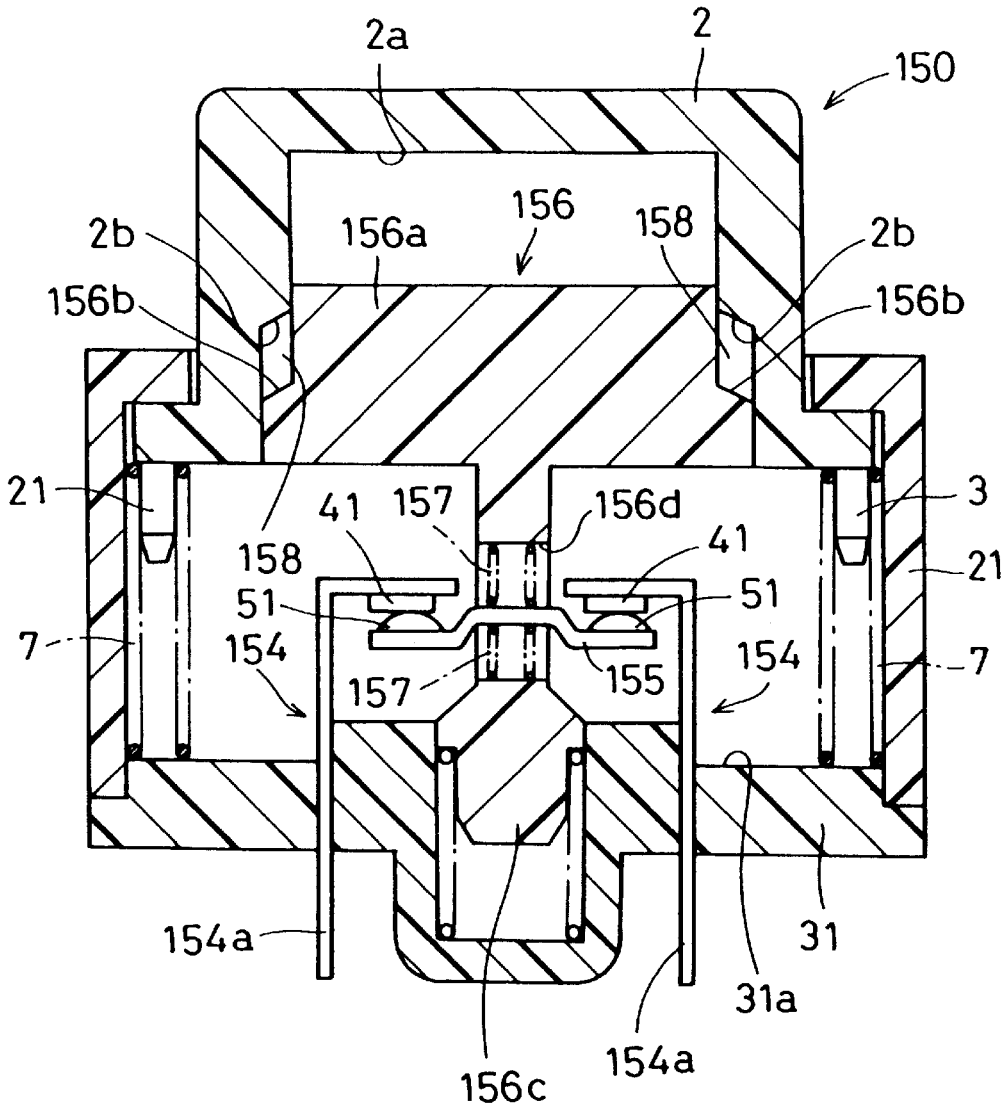
FIG. 52 is a sectional rear view showing a push-button switch according to a twelfth embodiment hereof.

Next, a twelfth embodiment of the invention will be described with reference to FIG. 52. FIG. 52 is a sectional rear view showing a push-button switch according to the twelfth embodiment. In the figure, the same reference characters as those of the eleventh embodiment represent the same or equivalent portions.

The description of the twelfth embodiment particularly focuses on differences from the eleventh embodiment and hence, a detailed explanation of the other portions is dispensed with.

As shown in FIG. 52, in the hole 2*a* of the push button 2 on the NC switch 150 side, the slope 2*b* of the hole 2*a* of the push button 2 is formed at place displaced upward from that of the eleventh embodiment (see FIG. 51) so that a gap 158 may be produced between the slope 2*b* of the push button 2 and the slope 156*b* of the inserted portion 156*a* of the switching mechanism 156 when the push button is not depressed.

Next, a brief description is made of the operation. When the push button 2 is not depressed or in the first OFF state, the first and second contacts 41, 51 are in contact so that the NC switch 150 is in the ON state.

Then, if the push button 2 in the ON state is depressed, the push-button switch 1 is shifted from the first OFF state to the ON state, as described in the first embodiment. If the gap 158 is adjusted such that the slopes 2*b* of the push button 2 and the slopes 156*b* of the switching mechanism 156 may be out of engagement in the process of shifting the push-button switch 1 from the first OFF state to the ON state and these slopes 2*b*, 156*b* may come into engagement upon the ON state of the push-button switch 1, then the push-button switch 1 is shifted to the ON state whereas the NC switch 150 is in the ON state.

Thus, the NC switch 150 is in the ON state when the push-button switch 1 is shifted to the ON state, which makes difference from the eleventh embodiment.

Subsequently, if the push button 2 of the push-button switch 1 is further pressed down in the ON state, the push-button switch 1 is shifted from the ON state to the second OFF state similarly to the eleventh embodiment, whereas in the NC switch 150, the switching mechanism 156 interlocked with the push button 2 is moved down thereby to lower the movable terminal 155, as well, so that the second contacts 51 are separated from the first contacts 41. Thus, the NC switch 150 is shifted from the ON state to the OFF state.

Thus, the provision of the gap 158 permits the NC switch 150 to assume the ON state, the ON state and the OFF state in correspondence to the first OFF state, the ON state and the second OFF state of the push-button switch 1, respectively. That is, the first OFF state of the push-button switch corresponds the ON state of the NC switch 150 whereas the second OFF state of the push-button switch corresponds the OFF state of the NC switch.

Accordingly, the twelfth embodiment provides equivalent effects to the eleventh embodiment.

As a matter of course, the NC switches of the eleventh and twelfth embodiments each may be juxtaposed with any of the push-button switches of the second to eighth embodiments.

Although the NC switches are mentioned in the eleventh and twelfth embodiments, such NC switches may be replaced with a normally open switch which is juxtaposed with the push-button switch 1. This case also provides equivalent effects to the eleventh and twelfth embodiments. In this case, the normally open switch may be embodied by making an arrangement such that the first contacts 41 of the eleventh and twelfth embodiments are affixed to the upper sides of the upper ends of the fixing members 154*a* while the movable terminal of the twelfth embodiment is inverted in position and placed above the first contacts 41 and that the movable terminal 155 is so positioned as to keep the second contacts 51 out of contact with the first contacts 41 in the initial state.

(Thirteenth Embodiment)

Figure 53:
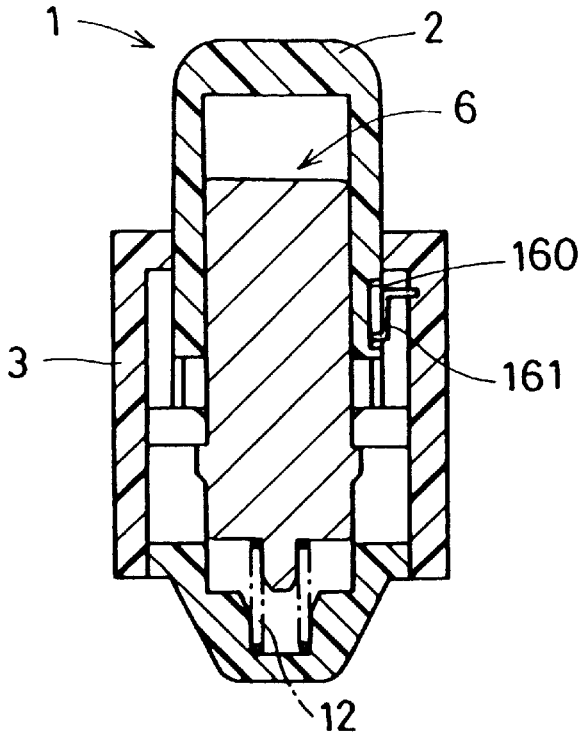
FIG. 53 is a sectional side view showing a push-button switch according to a thirteenth embodiment hereof.
Figure 54:
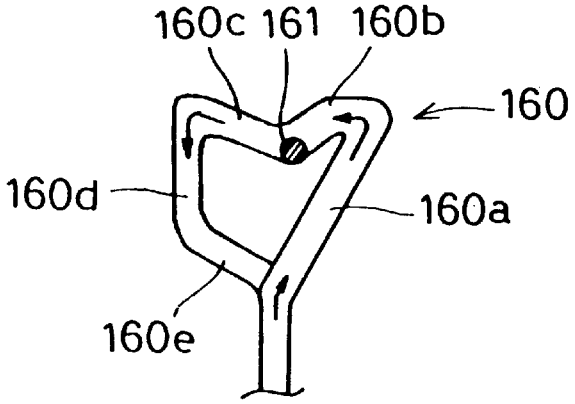
FIG. 54 is a schematic diagram showing a portion of the push-button switch according to the thirteenth embodiment.

Next, a thirteenth embodiment of the invention will be described with reference to FIGS. 53 and 54. FIG. 53 is a sectional side view showing a push-button switch according to the thirteenth embodiment; FIG. 54 is a fragmentary schematic diagram. In the figures, the same reference characters as those of the first embodiment represent the same or equivalent portions.

The description of the thirteenth embodiment particularly focuses on differences from the first embodiment and hence, a detailed explanation of the other portions is dispensed with.

As shown in FIG. 53, a substantially bilateral heart-shaped cam groove 160, shown in FIG. 54, is formed in the front or rear surface of the push button 2. A pin 161 has its root portion pivotally fixed to the inside surface of the case 3 at place opposite to the cam groove 160. A tip of the pin 161 is brought into relative movement through the cam groove 160 by depressing the push button 2. The cam groove 160 and the pin 161 constitute an alternating mechanism operating as a lock/reset mechanism.

As shown in FIG. 54, this heart-shaped cam groove 160 consists of a diagonally elongated first groove portion 160*a*, a horizontal second groove portion 160*b*, a third groove portion 160*c* diagonally extended upward to the left from place somewhat lower than the second groove portion 160*b*, a fourth groove portion 160*d* extended vertically downward from an end of the third groove portion 160*c*, and a fifth groove portion 160*e* diagonally elongated in the opposite direction to the first groove portion 160*a*.

Next, a brief description will be made of the operation. When the push button 2 is not depressed or the push-button switch 1 is in the first OFF state, the tip of the pin 161 is positioned at a lower end of the cam groove 160. When the push button 2 is depressed to shift the switch from the first OFF state to the ON state, the pin tip 161 is relatively moved upward through the first groove portion 160*a* of the cam groove 160 along a direction of the arrow in FIG. 54. When the switch is shifted to the second OFF state, the pin tip 161 reaches an upper end of the first groove portion 160 to abut against an upper side of the groove.

When the pin tip 161 abuts against the upper side of the first groove portion 160*a*, the coiled spring 12 for pushing up the switching mechanism 6 is compressed so that the push button 2 cannot be pressed down any further.

Subsequently, if the push button 2 is released, the push button 2 will be elevated by the spring force of the coiled spring 12 so that the pin tip 161 is moved through the second groove portion 160*b* to the third groove portion 160*c* of the cam groove 160, as shown in FIG. 54. At this time, the pin tip 161 abuts against a lower side of the third groove portion 160*c* thereby to restrict the pushing up of the push button 2. Thus, the push-button switch 1 is maintained in the second OFF state. Since the push button 2 stays depressed, the switch operator, seeing the push button 2 not returned to the initial state, can readily determine that the switch is maintained in the second OFF state.

Subsequently, if the push button 2 is pressed down once more for releasing the push-button switch 1 from the second OFF state thus maintained, the pin tip 161 moves through the third groove portion 160*c* and the fourth groove portion 160*d* to reach an upper end of the fifth groove portion 160*e*. If at this time, the push button 2 is released, the pin 161 does not restrict the pushing up of the push button 2 so that the push button 2 is elevated by the spring force of the coiled spring acting on the push button 2 while the pin 161 is relatively moved downward through the fifth groove portion 160*e*. Thus, the push button 2 and the pin tip 161 are returned to the initial states.

According to the thirteenth embodiment, by virtue of the provision of the alternating mechanism consisting of the cam groove 160 and the pin 61 fittedly inserted therein, the switch can be maintained in the second OFF state. Hence, the switch operator can readily determine from the state of the push button 2 that the switch is maintained in the second OFF state.

In addition, the switch can be returned to the initial first OFF state by depressing again the push button in the state thus maintained.

It is noted that such an alternating mechanism may be juxtaposed with any of the push-button switches of the second to eighth embodiments.

(Fourteenth Embodiment)

Figure 55:
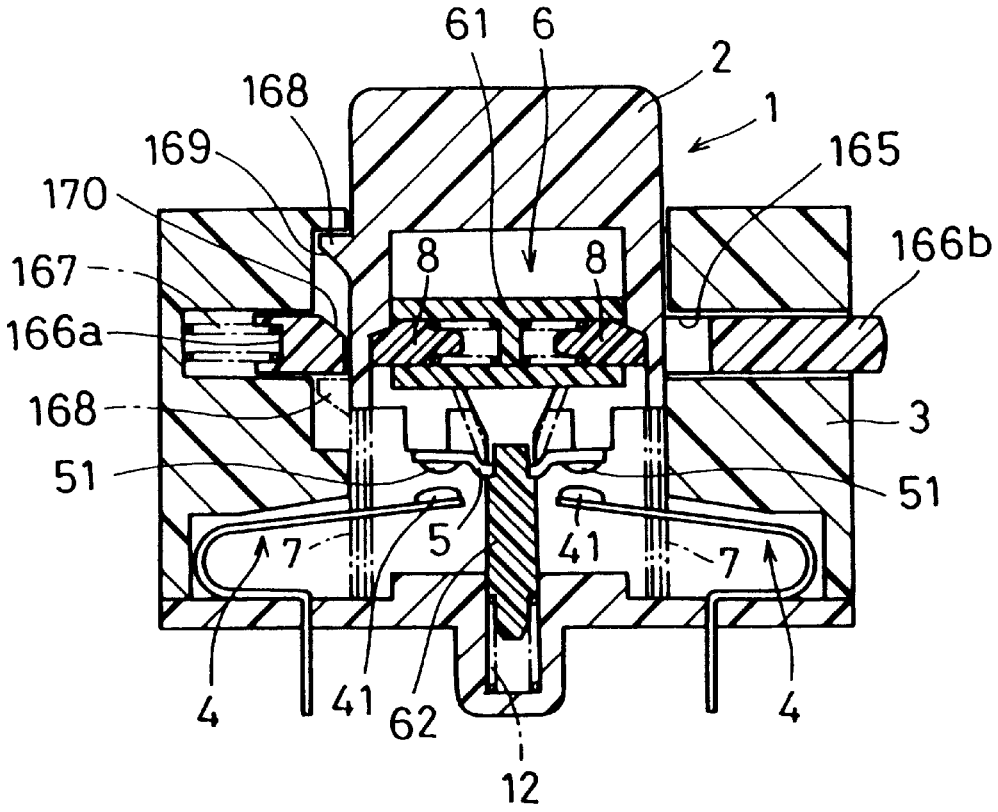
FIG. 55 is a sectional front view showing a push-button switch according to a fourteenth embodiment hereof.
Figure 56:
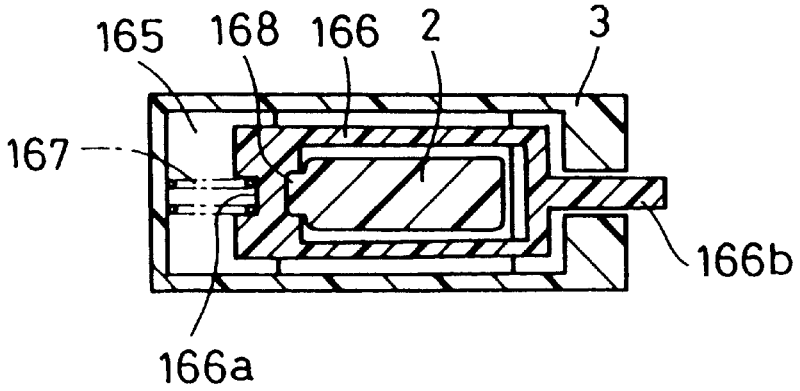
FIG. 56 is a sectional top plan view showing the push-button switch according to the fourteenth embodiment.

Next, a fourteenth embodiment of the invention will be described with reference to FIGS. 55 and 56. FIG. 55 is a sectional front view showing a push-button switch according to the fourteenth embodiment; and FIG. 56 is a sectional top plan view thereof. In the figures, the same reference characters as those of the first embodiment represent the same or equivalent portions.

In this embodiment, as shown in FIG. 55, the lateral sides of the case 3 are particularly increased in thickness so that a containing portion 165 is formed in the lateral sides of the case 3 for defining a space in which an operating member constituting a lock/reset mechanism is accommodated. The containing portion 165 laterally movably receives a rectangular frame-like operating member 166. The operating member 166 is disposed with an inside portion of the left side thereof is partly projected into the case 3. The push button 2 is adapted to move through a central space in the operating member 166.

The operating member 166 includes a recess 166*a* formed in a lefthand side surface of the left side thereof for receiving a right end portion of a coiled spring 167. A left end portion of the coiled spring 167 is locked to a lefthand side surface of the containing portion 165. The operating member 166A is urged rightward by a spring force of the coiled spring 167.

An operating bar 166*b* is integrally formed with the operating member 166 at a midportion of a right side thereof, having a distal end thereof extended out of the case 3. By depressing a tip of the operating bar 166*b* extended out of the case 3, the operating member 166 is moved leftward against the spring force of the coiled spring 167.

A locking projection 168 is integrally formed with the push button 2 substantially at a midportion of a lefthand side surface thereof. A slope 169 is formed on a lower surface of this projection 16 whereas a slope 170 for engagement with the slope 169 of the push button 2 is formed on a top surface of the portion of operating member 166 that projects from the left side thereof into the case 3.

In this manner, the containing portion 165, operating member 166, coiled spring 167, projection 168, slopes 169, 170 and operating bar 166*b* compose the lock/reset mechanism.

Next, a brief description will be made of the operation. If the push button 2 in the first OFF state is depressed, the push button 2 is lowered to bring the slope 169 into abutting engagement with the slope 170. At this time, the first and second contacts 41, 51 come into contact to shift the switch from the first OFF state to the ON state.

If the push button 2 in this ON state is further pressed down, the slope 169 of the push button 2 slides on the slope 170 of the operating member 166 thereby to move the operating member 166 leftward as the push button 2 is further pressed down. Eventually, the left side of the operating member 166 is completely retracted into the containing portion 165 so that the push button 2 can be depressed without interference of the operating member 166. At this time, the first and second contacts 41, 51 are separated from each other thereby shifting the switch from the ON state to the second OFF state. On the other hand, the spring force of the coiled spring 167 causes the left side of the operating member 166 to move rightward from its retracted position in the containing portion 165, thereby projecting again the left side of the operating member 166 partially into the case 3.

At the subsequent release of the push button 2, the spring force of the coiled spring 7 tends to move up the push button 2 but the push button 2 is locked because the upper surface of the projection 168 thereof abuts against the lower surface of the left side of the operating member 166. Hence, the upward movement of the push button 2 is restricted whereby the switch is maintained in the second OFF state with the push button 2 staying depressed. Seeing the push button 2 disabled to return to the initial state, the switch operator can readily recognize that the switch is maintained in the second OFF state.

If the operating bar 166*b* of the operating member projected from the case 3 is depressed in order to bring the switch out of this state thus maintained, the operating member 166 is moved leftward thereby to retract the left side thereof completely into the containing portion 165. This unlocks the switch, removing the restriction on the upward movement of the push button 2 imposed by the operating member 166. Hence, the push button 2 is raised to its initial position by the spring force of the coiled spring 7 while the operating member 166 is urged rightward into its initial state (reset state) by the spring force of the coiled spring 167.

Accordingly, the fourteenth embodiment provides equivalent effects to the thirteenth embodiment. More specifically, the provision of the lock/reset mechanism permits the switch operator to readily determine from the state of the push button 2 that the switch is maintained in the second OFF state.

It is noted that such a lock/reset mechanism may be juxtaposed with any of the push-button switches of the second to eighth embodiments.

Alternatively, some of the components of the lock/reset mechanism that are formed or accommodated in the case 3, such as the containing portion 165, operating member 166 and coiled spring 167, may be disposed in a separate member from the case 3. This separate member may be mounted to the case 3 in a manner to permit the engagement between the projection 168 of the push button 2 and the operating member 166 of the separate member.

Further, the lock/reset mechanism may be arranged as follows. A separate operation button for depressing the push button 2 is removably attached to the push button 2 such that the switch is shifted through the first OFF state and the ON state to the second OFF state by depressing the push button 2 via this operation button. In this case, the operation button is adapted to be locked by a locking member such as disposed in the case 3 for maintaining the switch in the second OFF state. The switch is brought out of the state thus maintained by rotating the operation button in a predetermined direction.

(Fifteenth Embodiment)

Now referring to FIGS. 57 to 60, a description will be made on a fifteenth embodiment of the invention in which the inventive push-button switch is used as an emergency stop switch.

Figure 57:
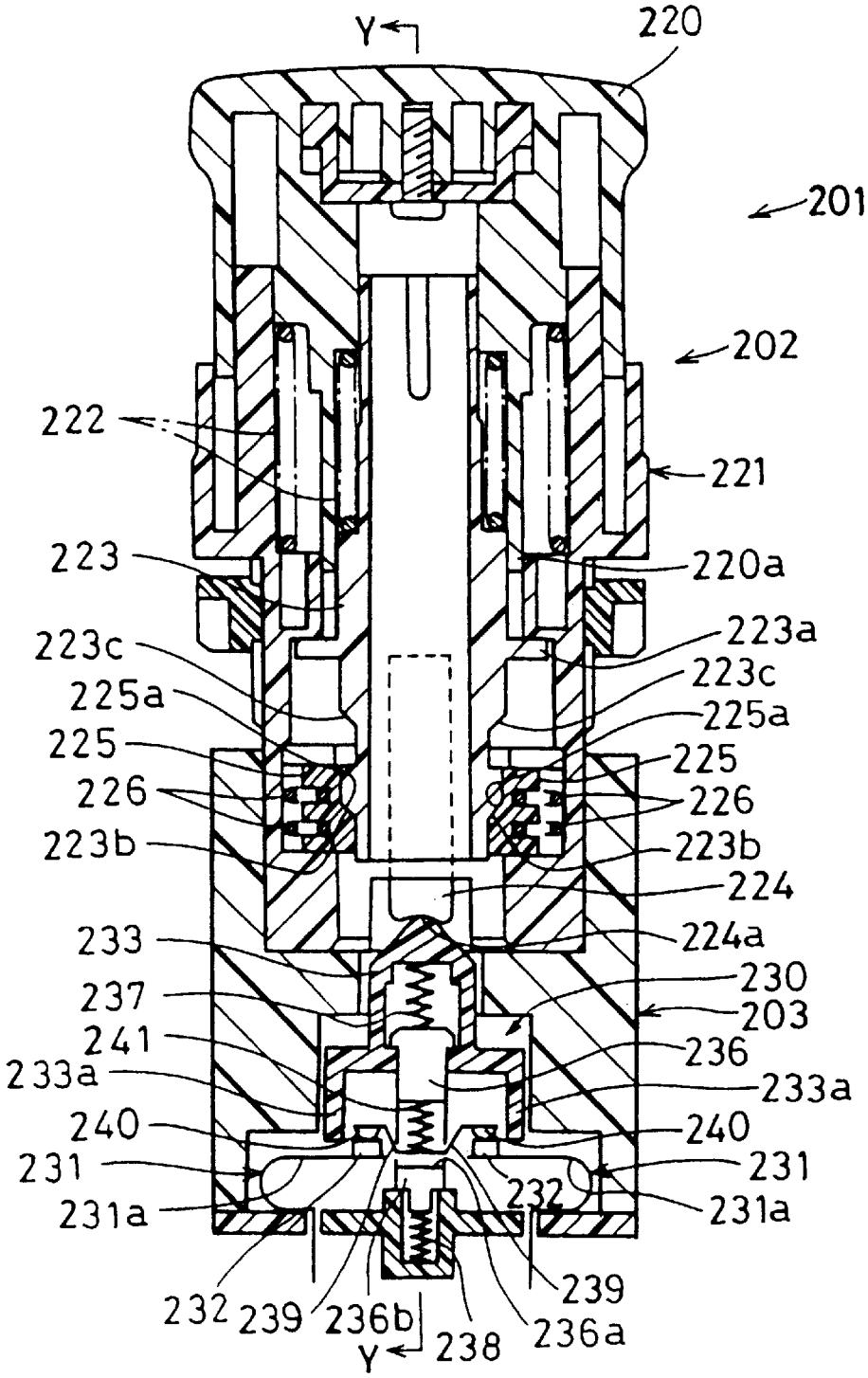
FIG. 57 is a sectional front view showing an emergency stop switch according to a fifteenth embodiment hereof.
Figure 58:
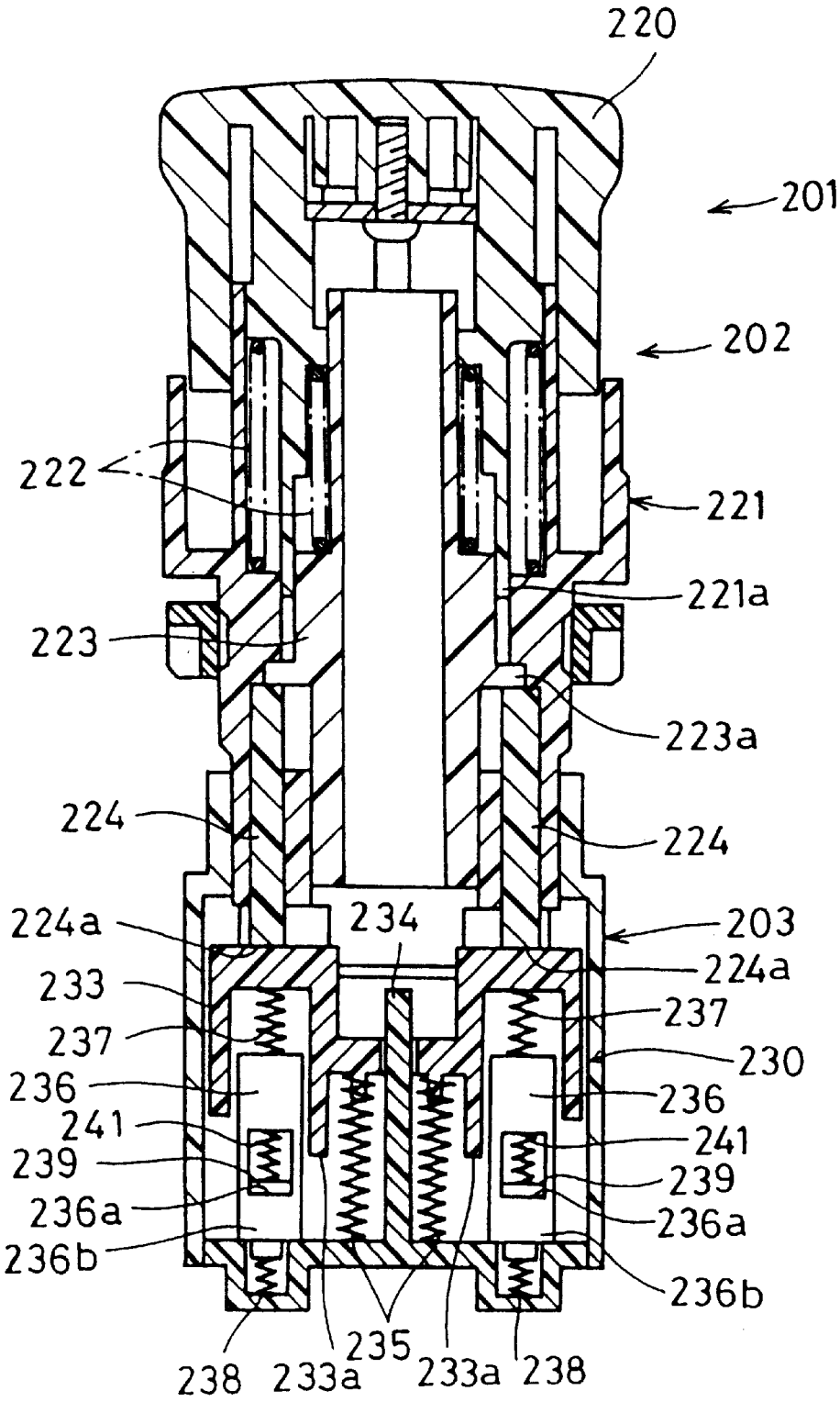
FIG. 58 is a sectional front view taken on the line Y—Y in FIG. 57.
Figure 59:
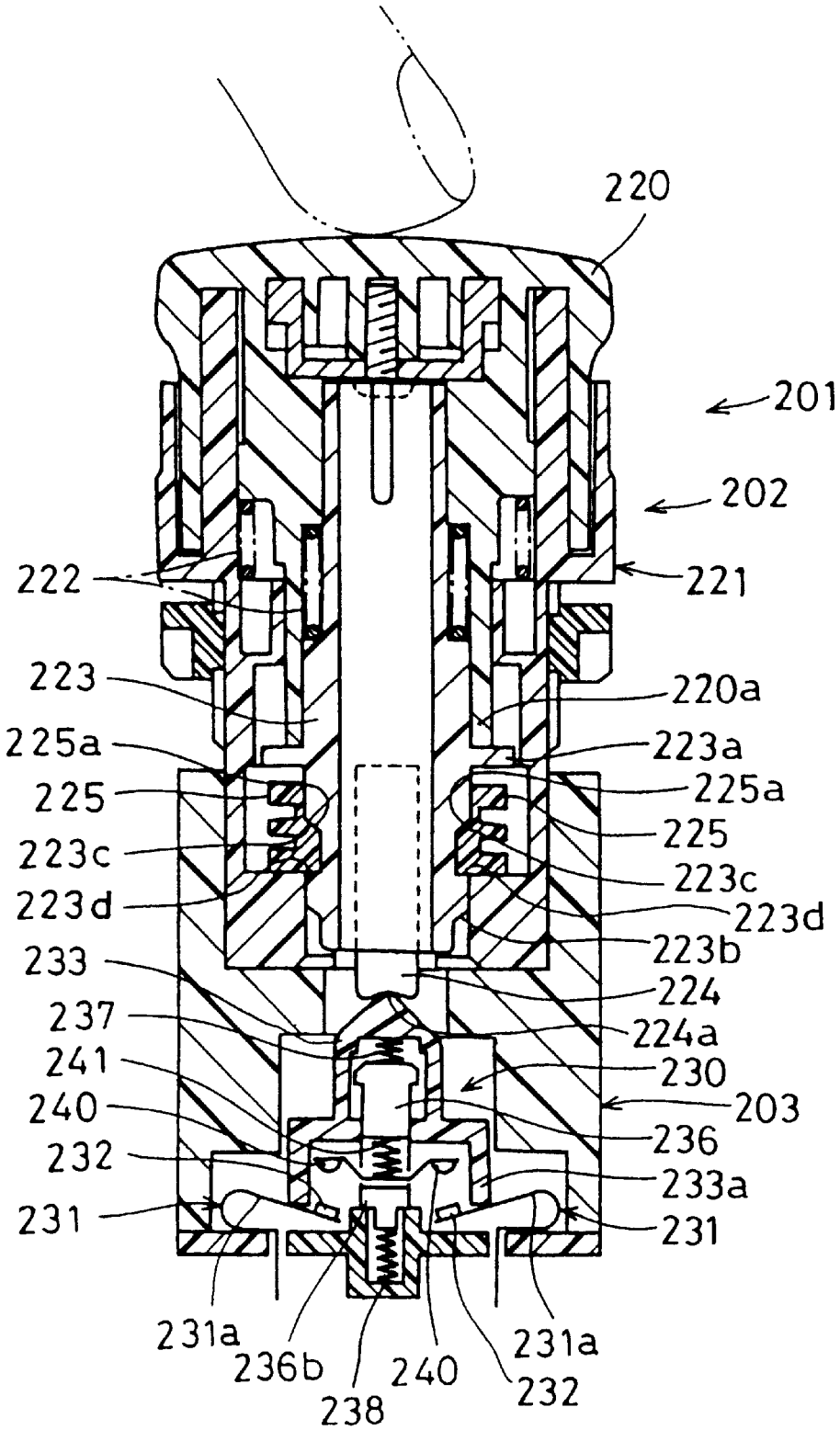
FIG. 59 is a sectional front view for illustration of operation of the emergency stop switch according to the fifteenth embodiment hereof.

FIG. 57 is a sectional front view showing an emergency stop switch according to the fifteenth embodiment; FIG. 58 a sectional front view taken on the line Y—Y in FIG. 57; FIG. 59 a sectional front view for illustration of the operations of the emergency stop switch; and FIG. 60 a diagram for illustration of working effects of this embodiment.

As shown in FIGS. 57 and 58, the emergency stop switch 201 is essentially comprised of an operation block (operation section) 202 and a contact block (contact section) 203 removably attached thereto.

The operation block 202 includes an emergency stop button 220 equivalent to the push button and a support block 221 for supporting the same. Disposed in the support block 221 is a return spring 222 for returning the depressed emergency stop button 220 to its initial position.

Further, an operating shaft 223 is axially slidably disposed in the support block 221. The operating shaft 223 is provided with a flange 223*a*.

Operating plates 224, 224 are disposed laterally of a lower portion of the operating shaft 223 as opposing each other across the operating shaft 223. Each of the operating plates 224, 224 has its upper end pressed against the flange 223*a* of the operating shaft 223.

A lock member 225 is disposed at a lower portion of the support block 221. A slope 225*a* formed on the lock member 225 is engaged with a slope 223*b* formed on the lower portion of the operating shaft 223. Disposed at the bottom of the support block 221 is a spring 226 for applying a spring force in a manner to project the lock member 225 toward the operating shaft 223. The operating shaft 223 is further formed with a similar slope 223*c* to the slope 223*b* at place thereabove.

A stationary terminal 231 is fixed to a bottom of the contact block 203. The stationary terminal 231 is substantially bent into U-shape and a bent portion 231*a* thereof present a vertical resilience. Affixed to a distal end of the bent portion 231*a* is a stationary contact 232 equivalent to the first contact.

A movable contact unit 230 interlocked with the operating shaft 223 is disposed in the contact block 203. The movable contact unit 230 includes an abutment portion 233 abutting against an edge 224*a* of the operating plate 224. The abutment portion 233 is vertically slidably carried by a support shaft 234 extended upward from the bottom of the contact block 203. Additionally, the abutment portion 233 is subject to a spring force of springs 235 disposed at the bottom of the contact block 203.

Contact holders 236 are disposed in the abutment portion 233. The contact holder 235 receives a downward spring force of a spring 237 on its top end as well as an upward spring force of a spring (urging member) 238 on its bottom end. The contact holder 236 is formed with a window 236*a* substantially at its midportion, the window extending through the contact holder 236 in a direction orthogonal to the axial direction thereof.

A movable terminal 239 is inserted in the window 236*a*. A movable contact 240, equivalent to the second contact, is affixed to a distal end of the movable terminal 239. The movable contact 240 is in contact with the stationary contact 232 of the stationary terminal 231 and hence, the contacts 232, 240 are maintained in the ON state. Within the window 236*a*, the movable terminal 239 is subject to a downward spring force of a spring 241 thereby attaining a contact pressure for the contact between the contacts 232, 240.

A lower portion 233*a* of the abutment portion 233 is designed to come from above into abutment against the bent portion 231*a* of the stationary terminal 231. This lower portion 233*a* serves as a separating section for separating the stationary contact 232 of the stationary terminal 231 from the movable contact 240 of the movable terminal 239 at the manipulation of the emergency stop button 220.

In the emergency stop switch 201 of this construction, the edges 224*a* of the operating plates 224 is in abutment against the abutment portion 233 in the contact block 203 while the contact block 203 is attached to the operation block 201, as mentioned supra. This causes a minor downward movement of the abutment portion 233 together with the contact holders 236 for abutting a lower ends of the contact holders 236 against the bottom of the contact block 203. (see FIGS. 57 and 58).

If the emergency stop button 220 in this state is lightly depressed, the return spring 222 applies the downward spring force to the operating shaft 223 but because of the engagement between the slope of the lower portion of the operating shaft 223 and the lock member 225, the operating shaft 223 does not immediately move in synchronism with the movement of the emergency stop button 220.

In a case where the emergency stop button 220 is depressed so forcibly that a lower end 220*a* of the emergency stop button 220 is pressed against the flange 223*a* of the operating shaft 223 and that a pressing force applied to the slope 225*a* via the slope 223*b* of the operating shaft 223 exceeds a predetermined limit, the lock member 225 moves away from the operating shaft 223 thereby disengaging the slope 223*b* of the operating shaft 223 from the slope 225*a* of the lock member 225.

As a result, the operating shaft 223 and the operating plates 224 move down, lowering the abutment portion 233 abutting against the edges 224*a* of the operating plates, as shown in FIG. 59. Then, the lower portion 233*a* of the abutment portion 233 pushes down the bent portions 231*a* of the stationary terminal 231, thereby separating the stationary contacts 232 of the stationary terminal 231 from the movable contacts 240 of the movable terminal 239. In this manner, the contacts 232, 240 are separated from each other for shifting the switch to an OFF state (the second OFF state).

On the other hand, the downward movement of the operating shaft 223 brings the lock member 225 into engagement with the slope 223*c* formed on the lower portion of the operating shaft 223 and above the slope 223*b*, and with a stepped surface 223*d* of the lower portion of the operating shaft 223. This holds the operating shaft 223 at the lowered position. It is noted that the stepped surface 223*d* is formed not on the entire circumference of the operating shaft 223 but on a part thereof.

Figure 60:
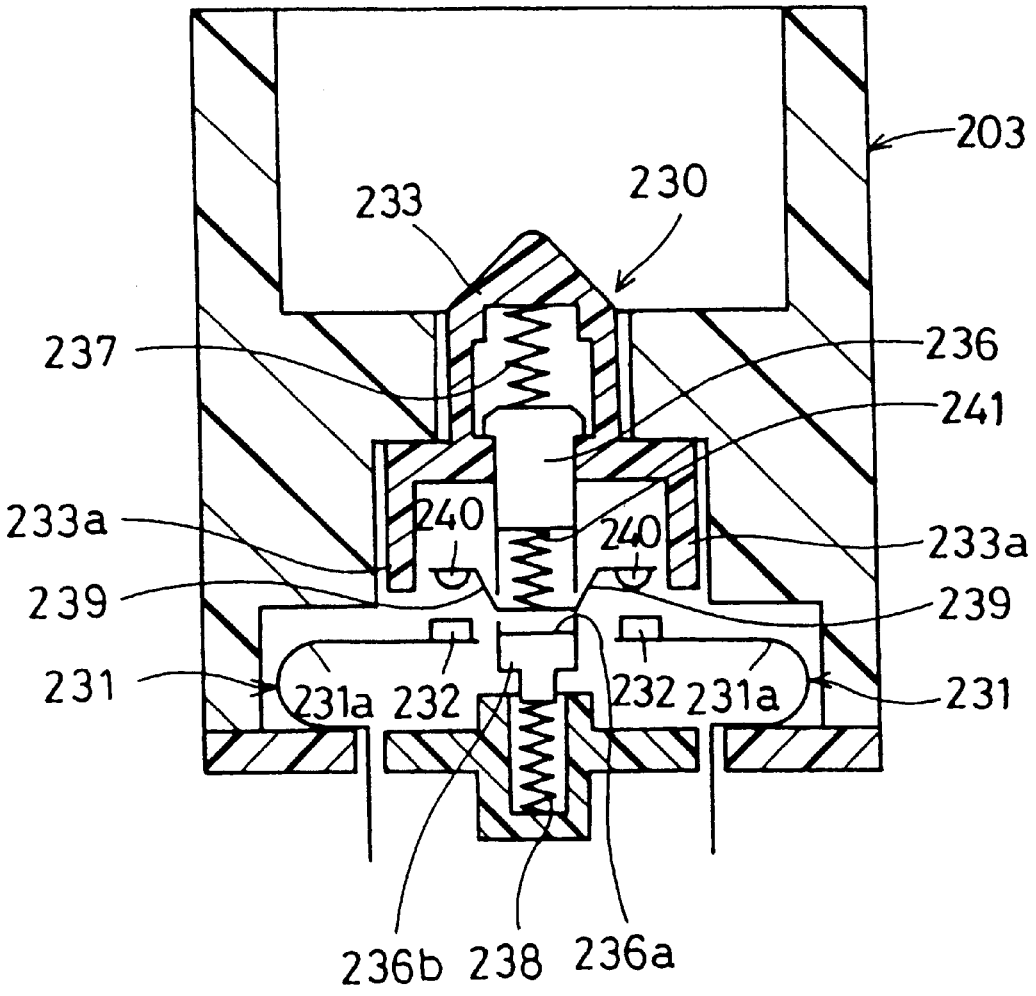
FIG. 60 is a diagram for illustration of a working-effect of the fifteenth embodiment.

Then, in order to remove the emergency stop state shown in FIG. 59, the operator may first rotate the emergency stop button 220 about the axis through a predetermined angle. Then, the operating shaft 223 is also rotated along with the emergency stop button 220 thereby disengaging the stepped surface 223*d* of the operating shaft 223 from the lock member 225. Consequently, the repulsive forces of the springs 235, 237 act via the abutment portion 233 and the operating plates 224 to raise the operating shaft 223 to its original position (see FIG. 57).

Where the contact block 203 is separated from the operation block 202, a repulsive force of springs 238 raises the contact holders 236, as shown in FIG. 60, so that lower ends 236*b* of the contact holders 236 leave the bottom of the contact block 203. At this time, the movable terminal 239 is also raised together with the contact holders 236 so that the movable contacts 240 of the movable terminal 239 leave the stationary contacts 232 of the stationary terminal 231 for shifting the switch to the OFF state (the first OFF state).

The movable terminal 239 is constantly subject, via the contact holders 236, the spring force of the springs 238 which urge the movable terminal into separation from the stationary terminal 231. Therefore, separating the contact block 203 from the operation block 202 permits this spring force to separate the movable contacts 240 from the stationary contacts 232.

Thus, according to the fifteenth embodiment, the switch is shifted to the ON state at attachment of the contact block 203 to the operation block 202 and then to the OFF state (the second OFF state) upon depression of the emergency stop button 220. Accordingly, the switch is stably shifted from the ON state to the OFF state (the second OFF state), accomplishing the stable switching operations. This ensures that the operations of an apparatus such as a machine tool are stopped in the event of an emergency.

In addition, the contacts 232, 240 in the contact block 203 can positively be brought out of contact for shifting the switch to the OFF state (the first OFF state) upon separation of the contact block 203 from the operation block 202. Accordingly, when these blocks are separated, as well, the apparatus, such as the machine tool or the like, can be maintained in a standstill state.

(Sixteenth Embodiment)

Now referring to FIGS. 61 to 65, a description will be made on a sixteenth embodiment of the invention in which the inventive push-button switch is used as the emergency stop switch.

Figure 61:
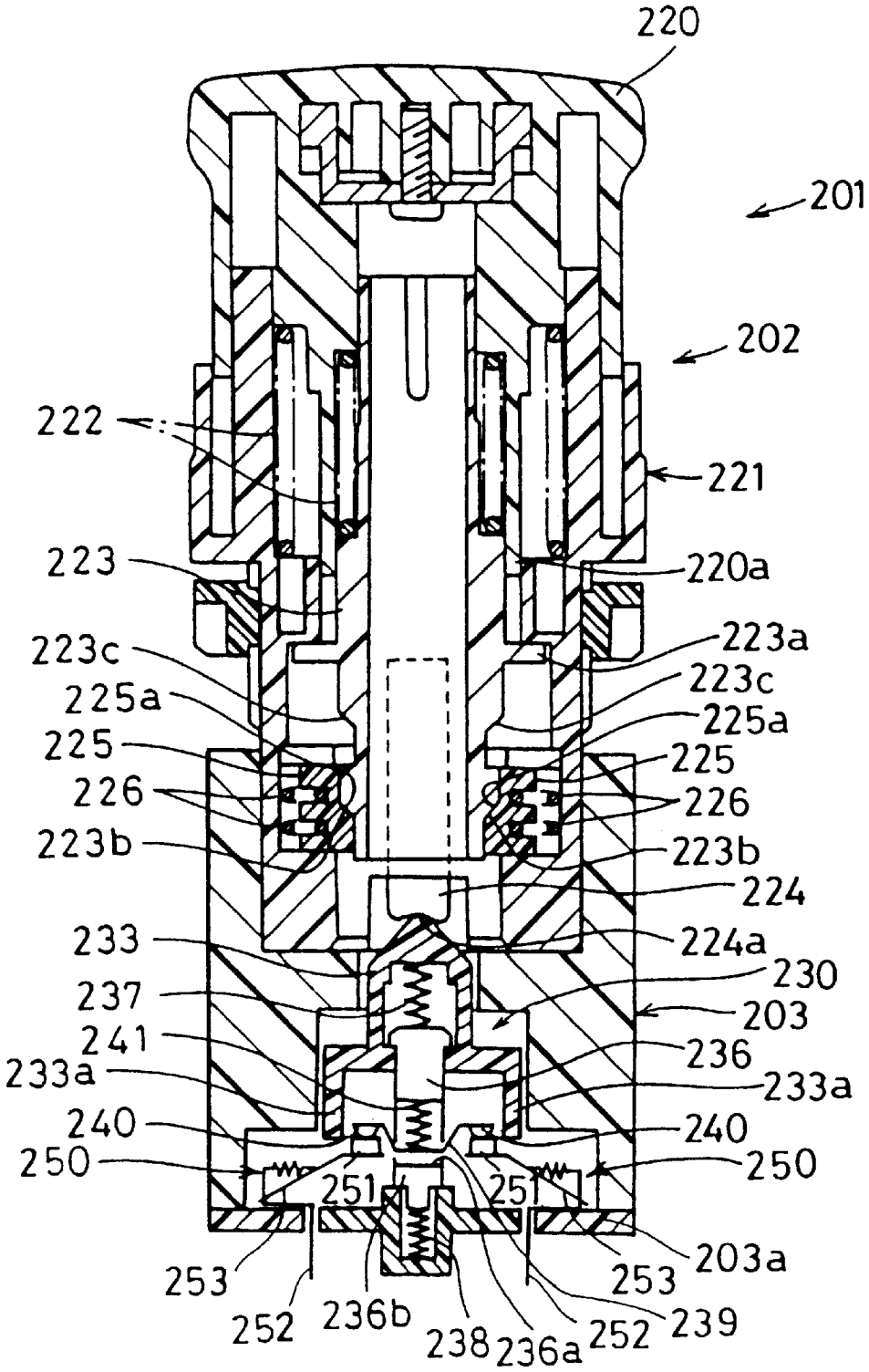
FIG. 61 is a sectional front view showing an emergency stop switch according to a sixteenth embodiment hereof.
Figure 62:
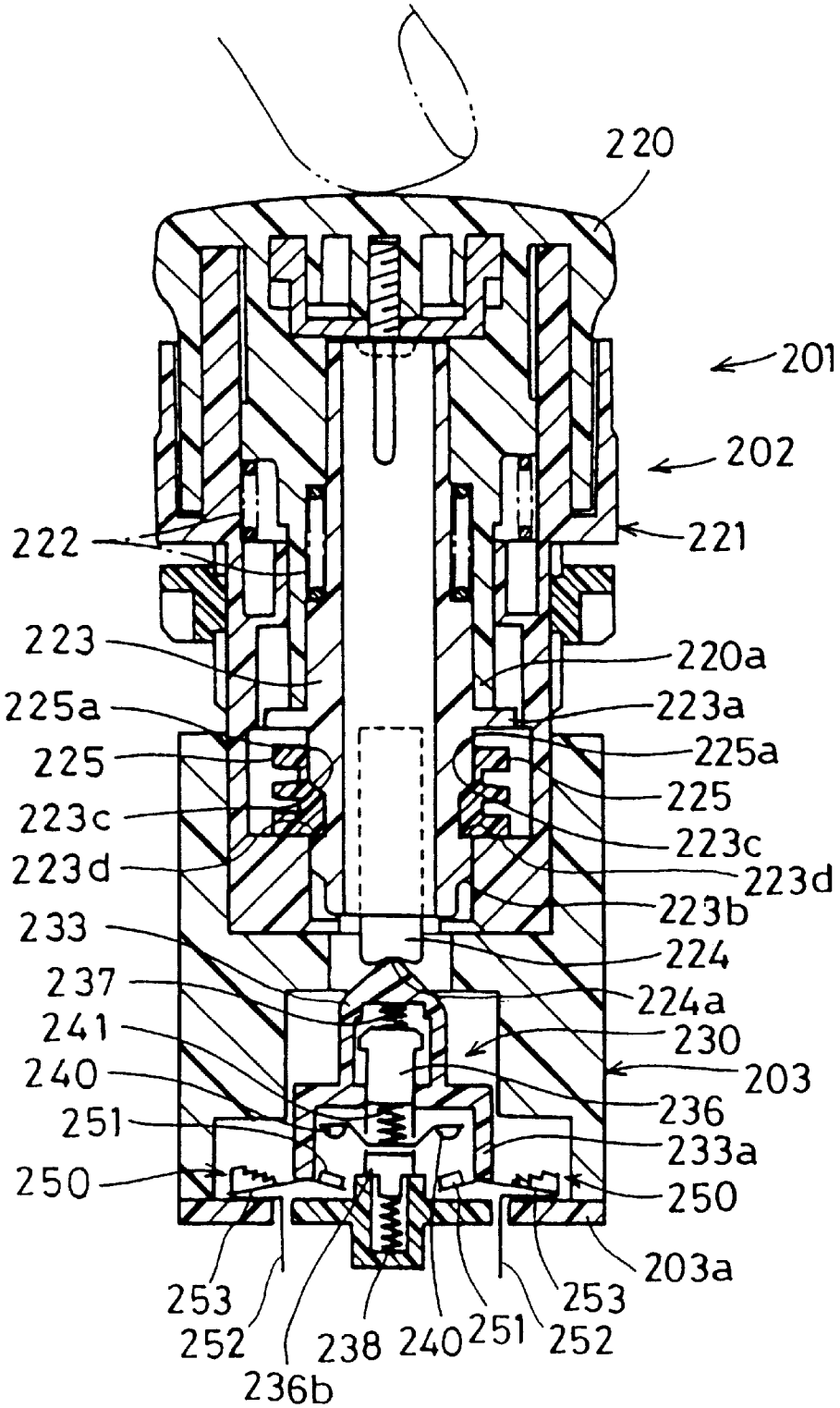
FIG. 62 is a sectional front view for illustration of operation of the emergency stop switch according to the sixteenth embodiment.
Figure 63:
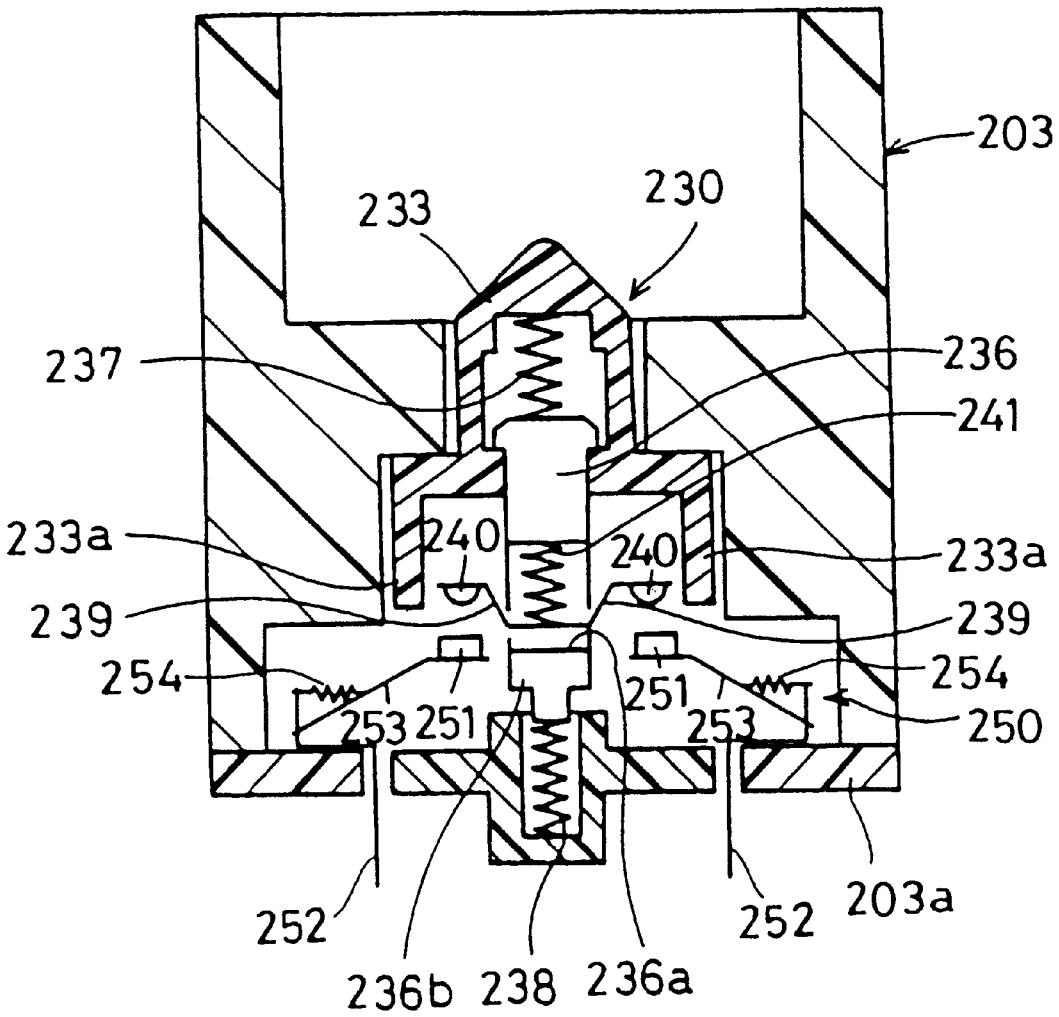
FIG. 63 is a diagram for illustration of a working-effect of the emergency stop switch according to the sixteenth embodiment.

FIG. 61 is sectional front view showing an emergency stop switch according to the sixteenth embodiment; FIG. 62 a sectional front view for illustration of the operations of the emergency stop switch; FIG. 63 a diagram for illustration of working-effects of the embodiment; and FIGS. 64 and 65 enlarged views showing different states of a stationary terminal in the emergency stop switch. FIGS. 61 to 63 correspond to FIGS. 57 to 59 of the fifteenth embodiment, respectively. In the figures, the same reference characters as those of the fifteenth embodiment represent the same or equivalent portions.

The sixteenth embodiment differs from the fifteenth embodiment only in the construction of the stationary terminal. Accordingly, this description focuses on the stationary terminal and a detailed explanation of the other portions is dispensed with.

In FIGS. 61 to 65, a stationary terminal 250 disposed on the bottom of the contact block 203 essentially consists of a fixed metal piece 252 fixed to a bottom portion 203*a*, and a movable metal piece 253 pivotally carried by the fixed metal piece 252.

Figure 64:
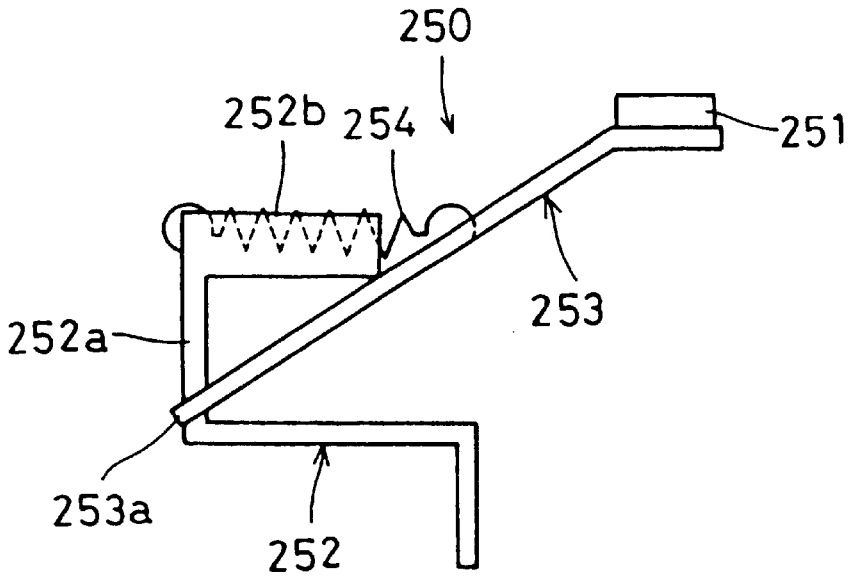
FIG. 64 is an enlarged view showing a state of a stationary contact in the emergency stop switch according to the sixteenth embodiment.
Figure 65:
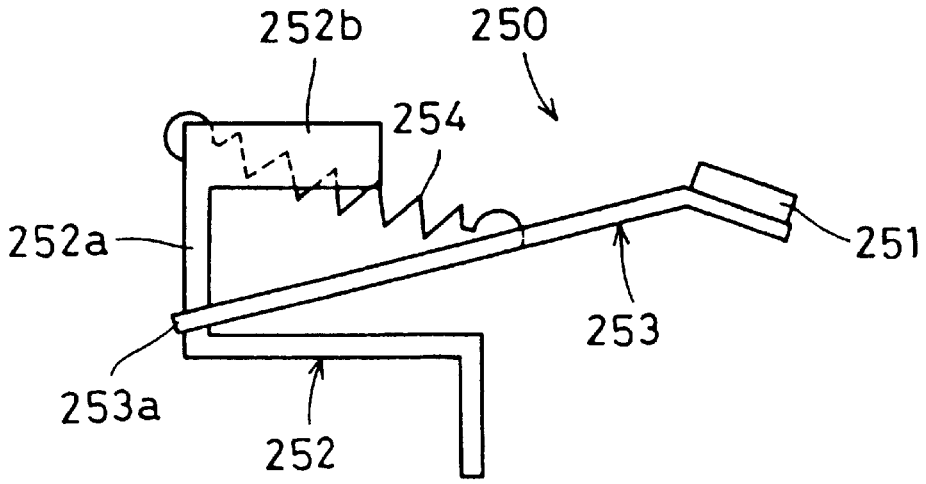
FIG. 65 is an enlarged view showing a different state of the stationary contact in the emergency stop switch according to the sixteenth embodiment.

As shown in FIG. 64, an upright plate 252*a* stands up from one end of the fixed metal piece 252. One end 253*a* of the movable metal piece 253 engages a lower end of the upright plate 252*a*. This construction permits the movable metal piece 253 to pivot up and down on a fulcrum of the lower end of the upright plate 252*a* (see FIG. 65).

The upright plate 252*a* is provided with a restriction plate 252*b* for restricting the upward pivotal movement of the movable metal piece 253. In FIGS. 61 to 63, the restriction plate 252*b* is omitted for convenience in the depiction.

A spring 254 is stretched between the upright plate 252*a* and the movable metal piece 253. The spring 254 has one end thereof locked to the upright plate 252*a* and the other end thereof locked to a substantial midportion of the movable metal piece 253. The movable metal piece 253 is constantly urged in a direction to pivot upward by a spring force of this spring 254. Affixed to a tip of the movable metal piece 253 is a stationary contact 251 equivalent to the first contact.

In the emergency stop switch 210 of this construction, similarly to the fifteenth embodiment, the edge 224*a* of the operating plate 224 abuts against the abutment portion 233 in the contact block 203 whereas the lower end 236*b* of the contact holder 236 is born against the bottom portion 203*a* of the contact block 203 (see FIG. 61) when the contact block 203 is attached to the operation block 202.

In a case where the emergency stop button 220 in this state is depressed so forcibly that the lower end 220*a* of the emergency stop button 220 is pressed against the flange 223*a* of the operating shaft 223 and that a pressing force applied via the slope 223*b* of the operating shaft 223 to the slope 225*a* of the lock member 225 exceeds the predetermined limit, the slope 223*b* of the operating shaft 223 is disengaged from the slope 225*a* of the lock member 225 so that the lock member 225 is moved in a direction to leave the operating shaft 223.

As a result, the operating shaft 223 and the operating plate 224 move down thereby to lower the abutment portion 233 in abutment against the edge 224*a* of the operating plate 224, as shown in FIG. 62. Then, the lower portion 233*a* of the abutment portion 233 causes the movable metal piece 251 of the stationary terminal 250 to pivot downward (see FIG. 65), thereby separating the stationary contact 251 of the stationary terminal 250 from the movable contact 240 of the movable terminal 239. In this manner, the contacts 240, 251 are separated from each other to shift the switch from the ON state to the OFF state (the second OFF state).

In a case where the contact block 203 is separated from the operation block 202, the contact holder 236 is raised by the repulsive force of the spring 238 so that the bottom end 236*b* of the contact holder 236 leaves the bottom portion 203*a* of the contact block 203, as shown in FIG. 63. At this time, the movable terminal 239 is also raised along with the contact holder 236, thereby separating the movable contact 240 of the movable terminal 239 from the stationary contact 251 of the stationary terminal 250. Thus, the contacts 240, 251 are brought out of contact to shift the switch to the OFF state (the first OFF state).

In this manner, the movable terminal 239 constantly receives, via the contact holder 236, the spring force of the spring 238 which urges the movable terminal into separation from the stationary terminal 231. Therefore, when the contact block 203 is separated from the operation block 202, the movable contact 240 can be separated from the stationary contact 232 by this spring force. This ensures that the contacts 240, 251 in the contact block 203 can be positively separated from each other for shifting the switch to the OFF state (the first OFF state).

Accordingly, the sixteenth embodiment provides equivalent effects to the fifteenth embodiment.

In the fifteenth embodiment, the stationary terminal 231 is formed by bending the steel strap substantially into the U-shape. The variations in the quality of the steel straps, the thickness of the steel sheet and the like may result in significant variations in the curvature of the bent portions 231*a* of the stationary terminals 231. Hence, it is not easy to attain the quality and performance of the stationary terminals 4 within a desired range. In contrast, the sixteenth embodiment is designed such that the spring characteristics of the whole body of the stationary terminal 250 depend upon the coiled spring 254. Therefore, it is relatively easy to attain the quality and performance of the stationary terminals within the desired range.

(Seventeenth Embodiment)

Now referring to FIGS. 66 to 69, a description will be made on a seventeenth embodiment of the invention in which the inventive push-button switch is applied to an enable switch for use in a teaching pendant as an operation device for the industrial manipulating robot.

Figure 66:
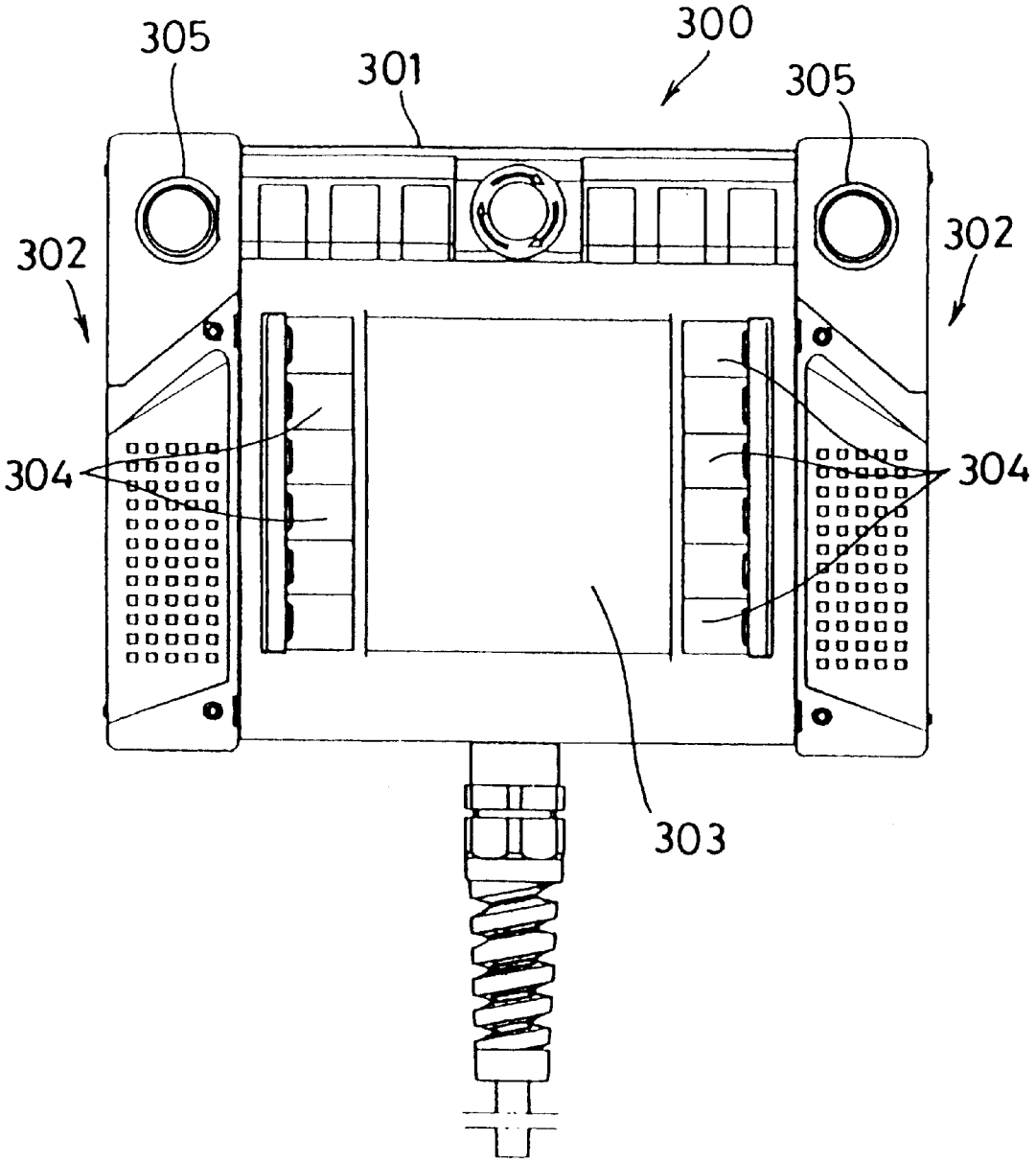
FIG. 66 is a front view showing a teaching pendant according to a seventeenth embodiment hereof.
Figure 67:
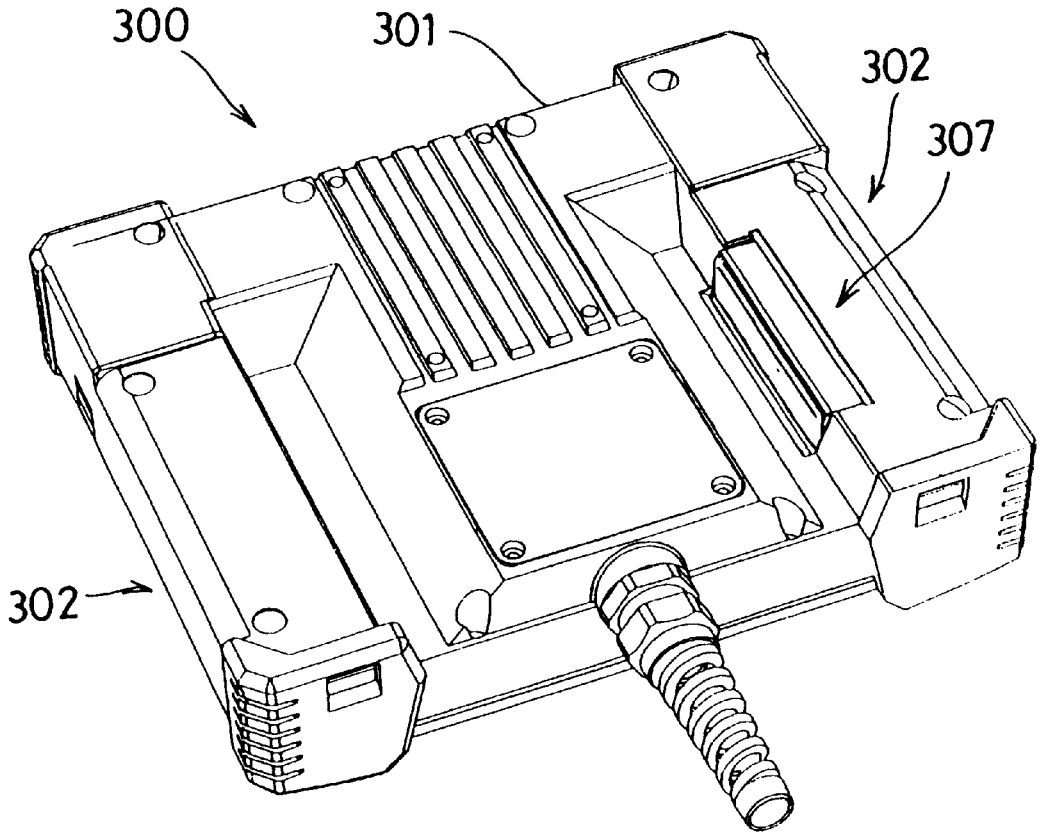
FIG. 67 is a perspective view of the teaching pendant of the seventeenth embodiment as seen from the rear side thereof.

FIG. 66 is a front view showing a teaching pendant according to the seventeenth embodiment; FIG. 67 a perspective view showing the teaching pendant as viewed from its rear side; and FIGS. 68 and 69 a rear view and a plan view showing a portion thereof. In the figures, the same reference characters as those of the first embodiment represent the same or equivalent portions.

The teaching pendant as the operation device for the industrial manipulating robot is a portable unit to be connected to a control device of the robot and is constructed as shown in FIG. 66, for example.

As shown in FIG. 66, a teaching pendant 300 is arranged such that opposite end portions of a pendant body 301 define grip portions 302 to be held by both hands. Disposed at a center of the pendant body 301 is a liquid crystal display 303 (hereinafter referred to as "LCD"). As viewing the screen of this LCD 303, the operator suitably manipulates, with his thumbs or the like, a plural number of operation keys 304 arranged along the opposite sides of the screen and the other operation keys 305, thereby teaching a program to the robot or operating the robot.

In this case, the robot cannot be taught by merely manipulating the operation keys 304, 305. It is arranged such that unless an operation section 307 of an enable switch disposed on a back side of either of the grip portions 302 of the pendant body 301, as shown in FIG. 67, is manipulated to shift the enable switch to the ON state and the operation keys 304, 305 are manipulated, it is impossible to teach the program to the robot or to operate the robot.

Figure 68:
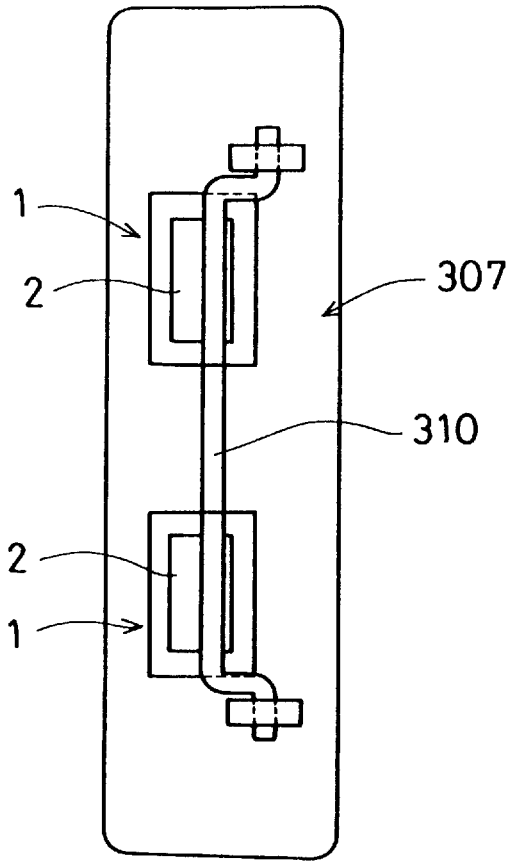
FIG. 68 is a rear view showing a portion of the teaching pendant according to the seventeenth embodiment.

In the operation section 308, as shown in FIG. 68, two push-button switches 1 of the first embodiment, as the enable switches, are juxtaposed with each other with the push buttons 2 thereof exposed to outside. Both push-button switches 1 are electrically connected in series. The two push buttons connected in series ensure that even if either of the push-button switches 1 suffers contact fusion, the other push-button switch 1 can accomplish the ON state as an enabled state and the second OFF state for emergency. Thus is ensured the reliability of the robot control.

Figure 69:
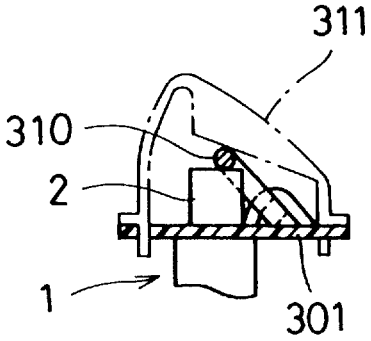
FIG. 69 is a side view showing the portion of the teaching pendant according to the seventeenth embodiment.

As shown in FIGS. 68 and 69, a U-shaped abutting member 310 to be abutted against both push buttons 2 is pivotally fixed to the operation section 307 at its opposite ends for simultaneously depressing the push buttons 2 of both push-button switches 1. The abutting member 310 is covered with a flexible cover 311 such that both the push buttons 2 are positively depressed by the abutting member 310 which is pivoted as gripped via the cover 311 when the grip portion 302 is held in hand.

In this case, the cover 311 may be formed of rubber or the like for making the operation section 307 waterproof.

According to the seventeenth embodiment, the abutting member 310 permits the push buttons 2 of both push-button switches 1 to be simultaneously depressed. The simple construction and manipulation allow for the simultaneous manipulation of both push-button switches 1.

It is noted that there may be provided three or more push button switches and that there is not a particular need for the cover 311.

The construction of the abutting member should not be limited to the above. The abutting member may be constructed any way as long as the abutting member is pivotally fixed to the pendant body 301 and adapted to abut against all the push buttons 2 at a time.

As a matter of course, any of the push-button switches of the second to fourteenth embodiments may be used as the enable switch.

(Eighteenth Embodiment)

Now referring to FIGS. 70 to 73, a description will be made on an eighteenth embodiment in which the inventive push-button switch is applied to the enable switch for use in the teaching pendant as the operation device for the industrial manipulating robot.

Figure 70:
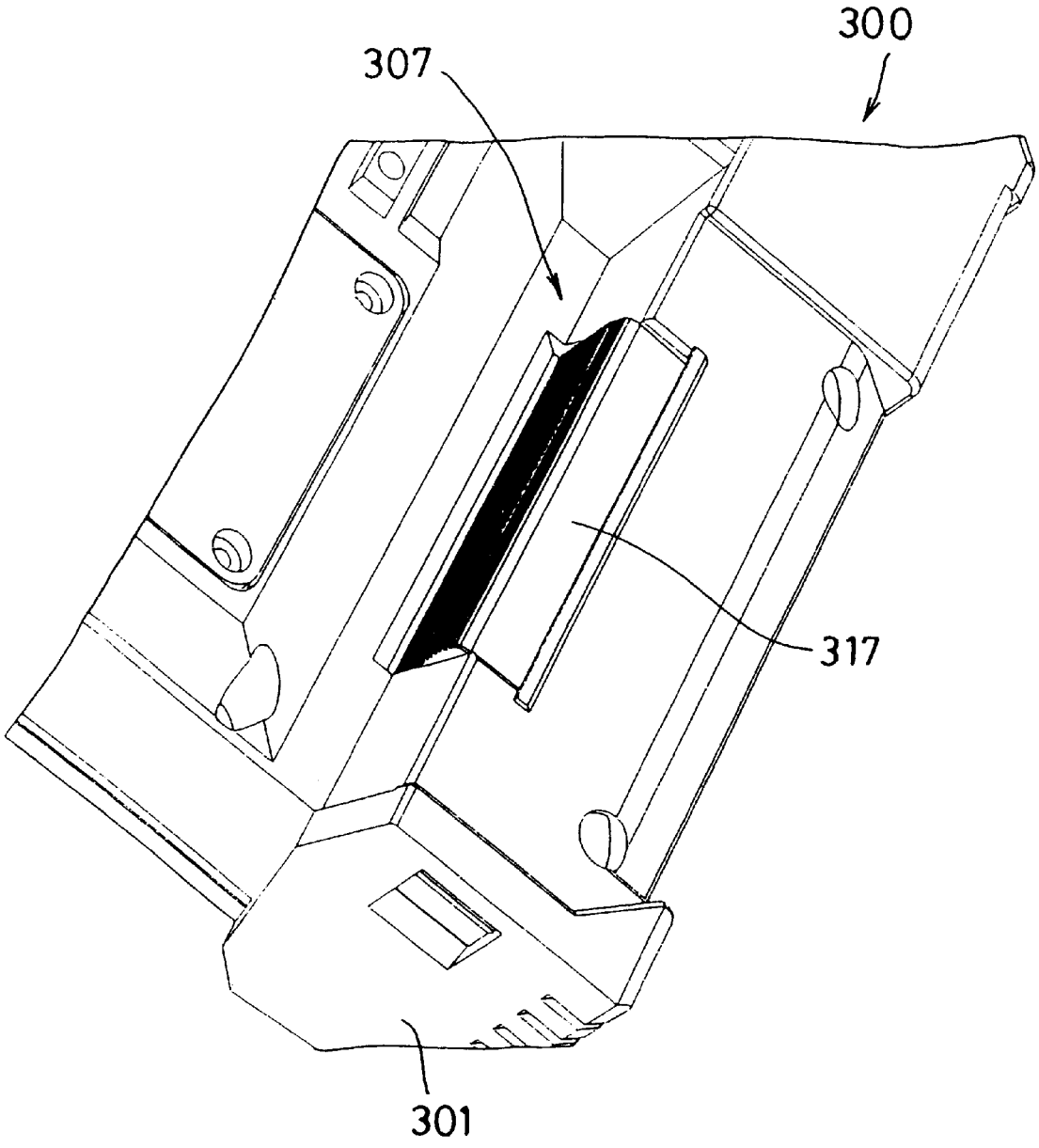
FIG. 70 is a perspective view showing a state of a teaching pendant according to an eighteenth embodiment hereof as seen from the rear side thereof.
Figure 72:
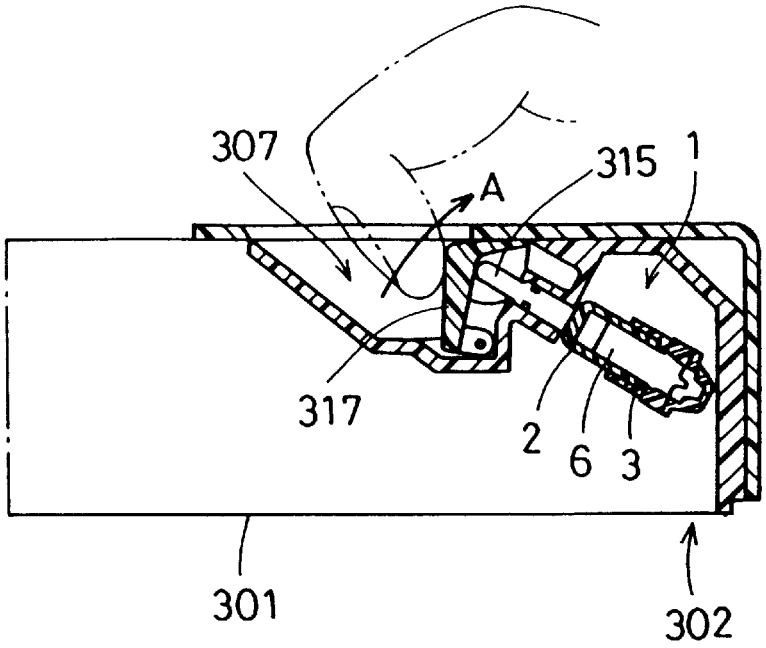
FIG. 72 is a plan view showing a state of the teaching pendant of the eighteenth embodiment with its right half portion cut off.

FIGS. 70 ad 71 are perspective views showing different states of a teaching pendant according to the eighteenth embodiment as viewed from its rear side; FIG. 72 a plan view showing a state of the teaching pendant with its right half portion cut off; and FIG. 73 a fragmentary perspective view. In the figures, the same reference characters as those of the seventeenth embodiment represent the same or equivalent portions.

Figure 71:
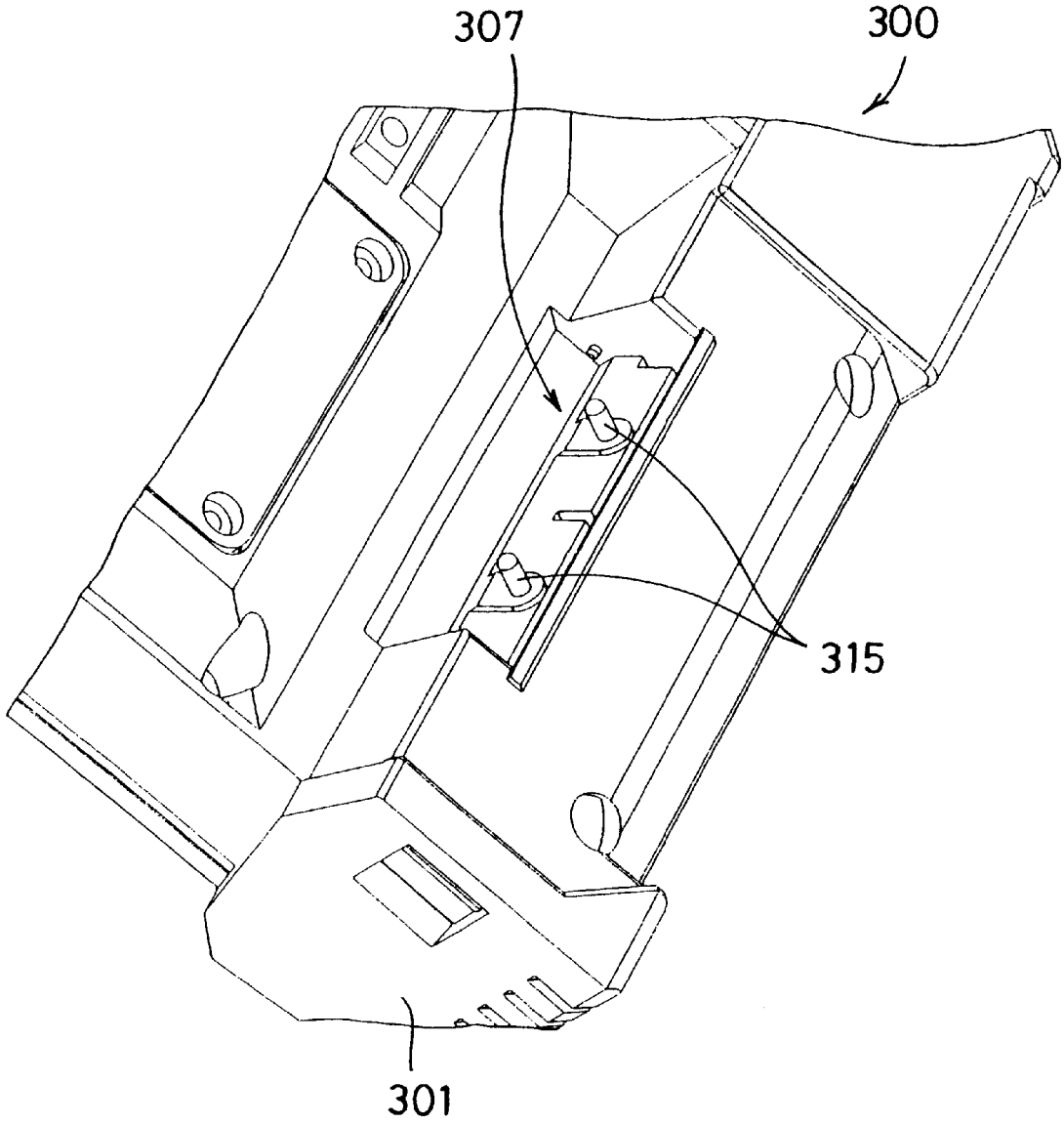
FIG. 71 is a perspective view showing a different state of the teaching pendant according to the eighteenth embodiment as seen from the rear side thereof.

In this embodiment, two push-button switches 1 are embedded in the operation section 307 on the back side of one of the grip portions 302 of the pendant body 301, as shown in FIG. 72. As shown in FIG. 71, actuator shafts 315 for depressing the respective push buttons 2 of the push-button switches 1 are retractably provided at the operation section 307 in correspondence to the respective push-button switches 1. As shown in FIG. 70, a manipulating lever 317 such as formed of a resin material or the like is pivotally attached to the operation section 307 for simultaneously manipulating the actuator shafts 315.

Figure 73:
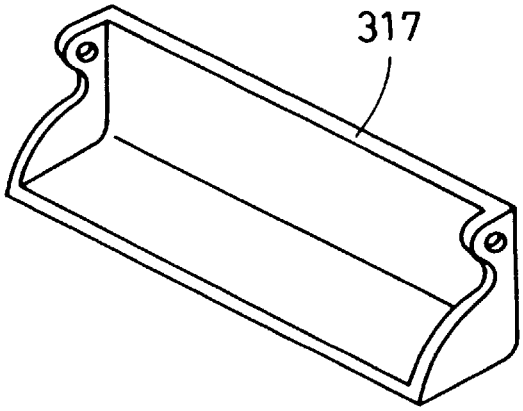
FIG. 73 is a fragmentary perspective view of the eighteenth embodiment.

In this case, the manipulating lever 317 has, for example, an L-shaped section as shown in FIG. 73 and has opposite ends thereof pivotally carried, via a support shaft, by a portion of the pendant body 301 at the operation section 307. The provision of such a manipulating lever 317 ensures that the respective push buttons 2 are positively depressed by the manipulating lever which is pivoted in a direction of an arrow A in FIG. 72 when the grip portion 302 is held in hand.

Accordingly, the eighteenth embodiment provides equivalent effects to the seventeenth embodiment.

It is noted that the construction of the manipulating lever 317 should not be limited to the above. The manipulating lever may be constructed in any way as long as the manipulating lever is pivotally mounted to the pendant body 301 for depressing all the push buttons 2 at a time.

In this case, as well, two or more push-button switches may be used as the enable switches. Further, any of the push-button switches of the second to fourteenth embodiment may be used as the enable switch.

(Nineteenth Embodiment)

Figure 74:
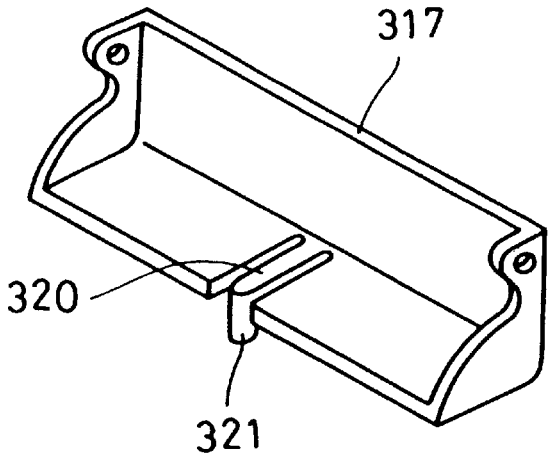
FIG. 74 is a perspective view showing a portion of a teaching pendant according to a nineteenth embodiment hereof.
Figure 75:
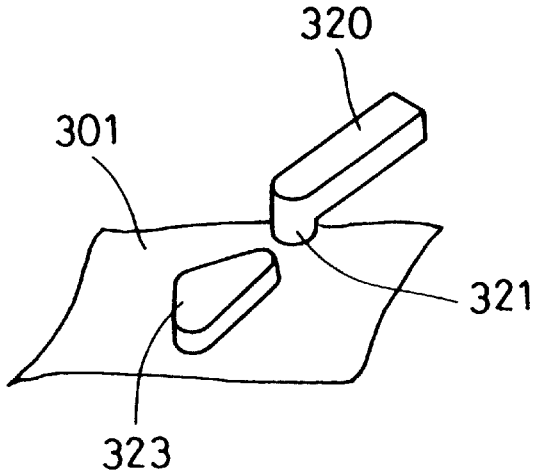
FIG. 75 is a perspective view showing another portion of the teaching pendant according to the nineteenth embodiment.

Now referring to FIGS. 74 to 76, a description will be made on a nineteenth embodiment of the invention in which the inventive push-button switch is applied to the enable switch for use in the teaching pendant as the operation device for the industrial manipulating robot. FIG. 74 is a perspective view showing a portion of the teaching pendant according to the nineteenth embodiment; FIG. 75 a perspective view showing a schematic construction of another portion thereof; and FIG. 76 a group of diagrams for illustration of the operations. In the figures, the same reference characters as those of the eighteenth embodiment represent the same or equivalent portions.

This embodiment further includes a tactile operation-touch generating mechanism for providing a tactile operation-touch indicative of the operation of the push-button switch 1 when the manipulating lever of the eighteenth embodiment is manipulatively pivoted.

More specifically, a resilient spring portion 320, as shown in FIG. 74, is defined by forming slits in a midportion of a rear wall of the manipulating lever 317. A rearward projection 321 is integrally formed with a tip of the spring portion 320. On the other hand, the pendant body 301 is formed with a cam-like projection 323, as shown in FIG. 75, against which the projection 321 is abutted. It is designed to provide the operator with the tactile response to the operation of the push-button switch 1 by way of the projection 321 of the manipulating lever 317 which abuts against the cam-like projection 323 for sliding on a part of a periphery of the cam-like projection 323 during the pivotal movement of the manipulating lever 317. For this purpose, the amount of the pivotal movement of the manipulating lever 317 and the amounts of the depressions of the actuators 315 and of the push buttons 2 may be adjusted such that the push-button switch 1 is shifted to the ON state when the projection 321 has substantially finished sliding on the part of the periphery of the cam-like projection 323 in conjunction with the pivotal movement of the manipulating lever 317.

Figure 76A:
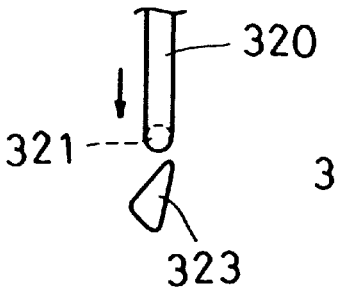
FIG. 76 is a group of diagrams illustrating operations of the teaching pendant according to the nineteenth embodiment.
Figure 76B:
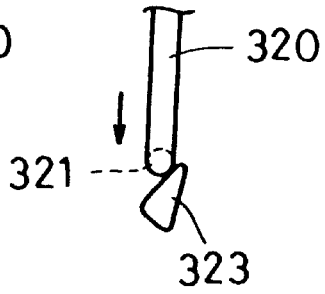

Next, a brief description will be made on the operations with reference to FIG. 76. When the manipulating lever 317 is not pivoted, or the push-button switch 1 is in the first OFF state, the projection 321 of the spring portion 320 does not abut against the cam-like projection 323, as shown in FIG. 76A. If, in this state, the manipulating lever 317 is pivoted by gripping the grip portion 320, the spring portion 320 is brought closer to the cam-like projection 323 so that the projection 321 comes into abutment against a part of the periphery of the cam-like projection 323, as shown in FIG. 76B.

Figure 76C:
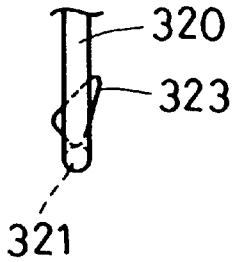

Subsequently, the projection 321 of the spring portion 320 slides on the one part of the periphery of the cam-like projection 323 to finish sliding on the one part of the periphery of the cam-like projection 323 as shown in FIG. 76C. Then, the push-button switch 1 is shifted to the ON state because of an increased amount of depression of the push button 2 while the operator is provided with the tactile operation-touch through the disengagement of the projection 321 from the cam-like projection 323. At this time, the pendant 300 is enabled by the push-button switch 1 shifted to the ON state.

Figure 76D:
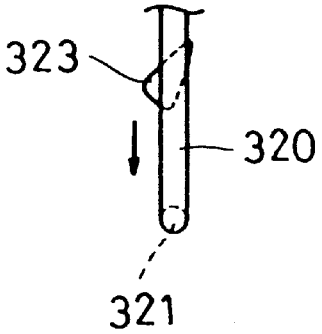

Subsequently, as the manipulating lever is further pivoted, the projection 321 of the spring portion 320 moves away from the cam-like projection 323 as shown in FIG. 76D, while the push-button switch 1 is shifted to the second OFF state because of an increased amount of depression of the push button 2. Such a state occurs in the event of some abnormal conditions and results from a sharp increase in the amount of pivotal movement of the manipulating lever 317, which is caused by the operator reacting to such abnormal conditions by firmly gripping the grip portion 302.

Figure 76E:
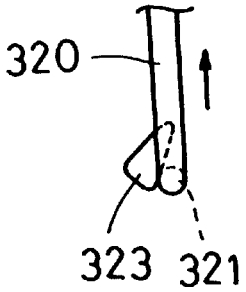
Figure 76F:
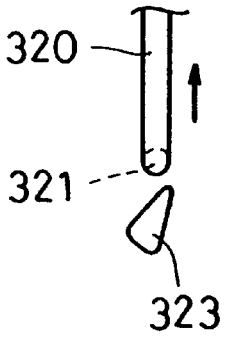
Figure 77:
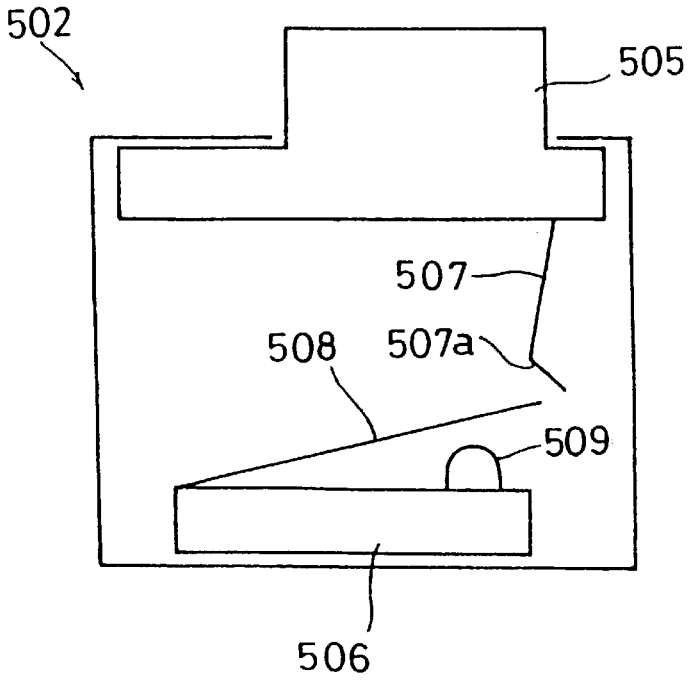
FIG. 77 is a schematic diagram showing a construction of a prior-art push-button switch.
Figure 78:
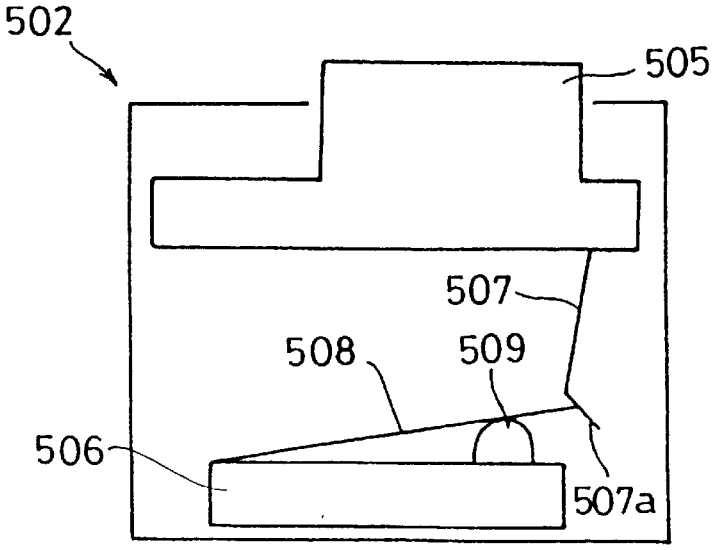
FIG. 78 is a diagram for illustration of operations of the prior-art push-button switch.
Figure 79:
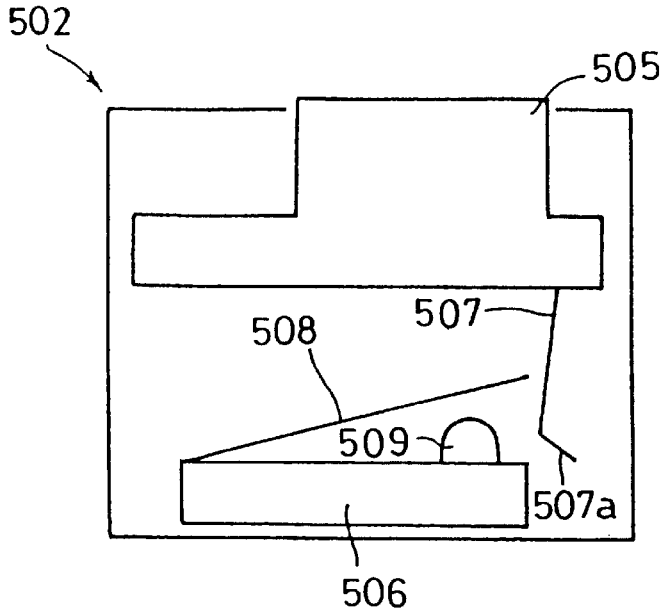
FIG. 79 is a diagram for illustration of the operations of the prior-art push-button switch.
Figure 80:
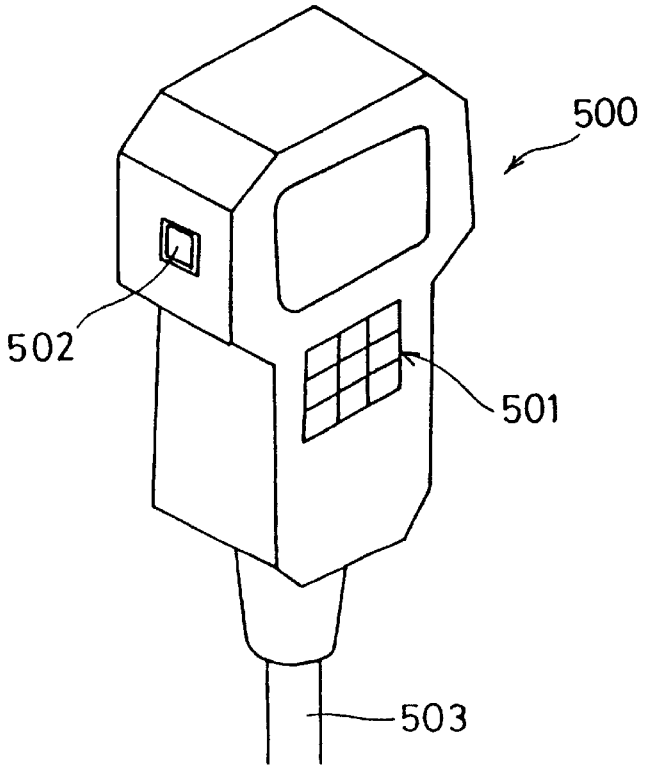
FIG. 80 is a perspective view showing a pendant including the prior-art push-button switch.

When the grip on the grip portion 302 is reduced after such abnormal conditions are circumvented, the manipulating lever 317 tends to return to its original position in synchronism with the return of the push button 2 effected by the return spring of the push-button switch 1. The manipulating lever 317 thus returned causes the projection of the spring portion 320 to slide on the other part of the periphery of the cam-like projection 323, as shown in FIG. 76E. Eventually, as shown in FIG. 76F, the projection 321 of the spring portion 320 leaves the cam-like projection 323 to return to its original position.

According to the nineteenth embodiment, by virtue of the provision of the tactile operation-touch generating mechanism consisting of the spring portion 320, projection 321 and cam-like projection 323, the tactile response to the operation of the push-button switch 1 can be offered to the operator of the teaching pendant 300 when the push-button switch 1 as the enable switch is shifted to the ON state.

If a difference is produced between a tactile operation-touch provided by means of the cam-like projection 323 and a tactile operation-touch provided at the shift from the ON state to the second OFF state of the enable switch, it is possible to distinguish the tactile operation-touch upon the shift to the ON state from that upon the shift to the second OFF state. Such a difference in the tactile operation-touches contributes to the prevention of operation errors.

It is taken for granted that the cam-like projection may be provided at the manipulating lever 317 while the spring portion and projection may be provided at the pendant body 301.

Needless to say, the tactile operation-touch generating mechanism should not be limited to the above construction.

Additionally, any of the push-button switches of the second to fourteenth embodiment may be used as the push-button switch for the nineteenth embodiment.

Incidentally, the descriptions of the seventeenth to nineteenth embodiments refer to the teaching pendant for the industrial manipulating robot as the operation device. However, the operation device which should employ the push-button switch 1 adapted to assume three states of the first OFF state, ON state and the second OFF state is not limited to such a teaching pendant but, as a matter of course, may be any other operation device.

Incidentally, any of the emergency stop buttons of the fifteenth and sixteenth embodiments may be provided in the teaching pendants of the seventeenth to nineteenth embodiments.

What is claimed is:

1. A push-button switch controlling an ON or OFF state of the switch according to an increase in depression of a push button, said push-button switch comprising:

a push button;

a case for depressibly supporting said push button;

a first contact disposed in said case;

a second contact disposed in said case in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact;

a switching mechanism having two opposite end portions, wherein one end portion is inserted in a hollow portion defined in said push button and the other end portion extends in said case;

a slide block disposed in the one end portion of said switching mechanism said slide block being slidable in a direction intersectional to a direction of the depression of the push button;

a push-button slope formed in the hollow portion of said push button;

a slide-block slope formed on said slide block, wherein said slide-block slope is engagable with said push-button slope; and a return spring disposed in said case for urging the other end portion of said switching mechanism toward the push button, wherein said second contact is movable in said case interlocked with said switching mechanism, wherein said switching mechanism is moved interlocked with the depression of said push button while said push-button and slide-block slopes are in engagement when said push-button is pressed between the first OFF state and the second OFF state, and, wherein said side block slides to bring said push-button and slide-block slopes out of engagement when said push-button is depressed to said second OFF state, and wherein said switching mechanism is released from the interlocked relation with the depression of said push button so as to be moved in the hollow portion of said push button by an urging force of said return spring when said push-button is depressed to said second OFF state.

2. A push-button switch as claimed in claim 1, further comprising a forcible separation means for forcibly moving said first contact away from said second contact when said push-button switch is shifted to said second OFF state.

3. A push-button switch controlling an ON or OFF state of the switch according to an increase of depression of a push button, said push-button switch comprising:

a push button;

a case for depressibly supporting said push button;

a first contact disposed in said case;

a second contact disposed in said case in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact;

a switching mechanism having two opposite end portions, wherein one end portion is inserted in a hollow portion defined in said push button and the other end portion extends in said case;

a slide block disposed in the one end portion of said switching mechanism slidable in a direction intersectional to a direction of the depression of the push button;

a push-button slope formed in the hollow portion of said push button;

a slide-block slope formed on said slide block wherein said slide-block slope is engagable with said push-button slope, wherein said switching mechanism is interlocked with the depression of said push button while said push-button and slide block slopes are in engagement when said push-button is pressed between the first OFF state and the second OFF state, wherein said slide block slides to bring said push-button and slide block slopes out of engagement when said push-button is depressed to said second OFF state, and wherein said switching mechanism is released from the interlocked relation with the depression of said push button so as to become movable in said hollow portion when said push-button is depressed to said second OFF state; and a reversing mechanism disposed in said case, having an end normally spaced from said first contact but movable toward said first contact by said other end portion of the switching mechanism abutting against and pressing down a midportion of said reversing mechanism when said push-button is moved to the second OFF state, and wherein said second contact is affixed to said end of said reversing mechanism.

4. A push-button switch as claimed in claim 3, further comprising a forcible separation means for pressing down said end of said reversing mechanism for forcibly separating said second contact from said first contact when said push-button switch is shifted to said second OFF state.

5. A push-button switch as claimed in any one of claims 1–4 further comprising:

an urging means for urging said push button into a state prior to the depression thereof; and an engaging piece disposed at said push button and coming into engagement with said switching mechanism for assisting said switching mechanism in returning when said push button returns to the position prior to the depression thereof.

6. A push-button switch controlling an ON or OFF state of the switch according to an increase of depression of a push button, said push-button switch comprising:

a push button;

a case for depressibly supporting said push button;

a first contact disposed in said case;

a second contact disposed in said case in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact; and a switching mechanism movable interlocked with a depression of said push-button for shifting the switch from said first OFF state to said ON state and rotating in response to the subsequent depression of said push button, wherein said first contact is shifted from said ON state to said second OFF state by the rotation of said switching mechanism.

7. A push-button switch controlling an ON or OFF state of the switch according to an increase of depression of a push button, said push-button switch comprising:

a push button;

a case for depressibly supporting said push button;

a first contact disposed in said case;

a second contact disposed in said case in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact;

a first electrically conductive member disposed in said case, wherein a distal end of said first conductive member is urged toward said push button and has said first contact affixed thereto;

a second electrically conductive member disposed in said case, wherein a distal end of said second conductive member is interposed between said push button and said first contact and has said second contact affixed thereto in opposed relation with said first contact;

a leaf spring disposed in said case having two ends wherein one end of said leaf spring is fixed to said push button, the other end of said leaf spring is positioned close to said distal end of said second conductive member, and wherein said leaf spring has a bent portion formed by bending a tip portion of the other end of said leaf spring and wherein the bent portion is engageable with said distal end of said second member; and an operating member fixed to said push button for forcible separation, wherein a distal end of said operating member abuts against said distal end of said first conductive member, wherein said bent portion of the leaf spring is brought into engagement with said distal end of said second conductive member by the depression of said push button thereby pressing down said distal end of said second conductive member against an urging force of said second conductive member for shifting the push-button switch from said first OFF state to said ON state, and wherein said bent portion of the leaf spring is caused to slide on said distal end of said second conductive member by the subsequent depression of said push button and disengages from said second conductive member while said operating member presses down said distal end of said first conductive member against the urging force of said first conductive member whereby the switch is shifted from said ON state to said second OFF state.

8. A push-button switch controlling an ON or OFF state of the switch according to an increase of depression of a push button said push-button switch comprising:

a push button;

a case for depressibly supporting said push button;

a first contact disposed in said case;

a second contact disposed in said case in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact;

an electrically conductive stationary member disposed in said case, wherein said first contact is affixed to an end of said stationary member; and an electrically conductive movable member having a U-shaped section and received in a hollow portion defined in said push buttons wherein resilient opposite ends of said movable member are urged in directions to move away from each other and are retractable into the hollow portion of said push button, wherein said second contact is affixed to at least one of said opposite ends of said movable member, wherein said movable member is shifted from said first OFF state to said ON state interlocked with a depression formed in said push button, and wherein said opposite ends of said movable member are retracted into said hollow portion of said push button by the subsequent depression of said push button while a part of said push button is interposed between said first and second contacts whereby the switch is shifted from said ON state to said second OFF state.

9. A push-button switch as claimed in any one of claims 1 to 4 and 6 to 8, further comprising a tactile click-touch generating mechanism, wherein said click-touch mechanism includes a push-button projection formed on an outer periphery of said push button and a case projection formed on an inside circumferential surface of said case, and wherein said push-button projection is slidable over said case projection thereby providing a tactile click-touch when the push-button switch is shifted from said first OFF state to said ON state.

10. A push-button switch as claimed in claim 5, further comprising a tactile click-touch generating mechanism, wherein said click-touch mechanism includes a push-button projection formed on an outer periphery of said push button and a case projection formed on an inside circumferential surface of said case, and wherein said push-button projection is slidable over said case projection thereby providing a tactile click-touch when the push-button switch is shifted from said first OFF state to said ON state.

11. A push-button switch as claimed in any one of claims 1 to 4 and 6 to 8, further comprising a pair of auxiliary contacts disposed in said case, wherein said auxiliary contacts are brought either into or out of contact in synchronism with a contact between said first and second contacts, and are brought either out or into contact in synchronism with the separation of said first contact from said second contact.

12. A push-button switch as claimed in claim 5, further comprising a pair of auxiliary contacts disposed in said case, wherein said auxiliary contacts are brought either into or out of contact in synchronism with a contact between said first and second contacts and are brought either out of or into contact in synchronism with the separation of said first contact from said second contact.

13. A push-button switch as claimed in any one of claims 1 to 4 and 6 to 8, further comprising a third contact and a fourth contact disposed in said case, wherein said third and fourth contacts are in contact in said first OFF state and are brought out of contact by depressing said push button for shifting the push-button switch to said second OFF state.

14. A push-button switch as claimed in claim 5, further comprising a third contact and a fourth contact disposed in said case, wherein said third and fourth contacts are in contact in said first OFF state and are brought out of contact by depressing said push-button to shift the push-button switch to said second OFF state.

15. A push-button switch as claimed in any one of claims 1 to 4 and 6 to 8, further comprising a lock-and-reset mechanism which operates to hold said push button in a depressed state when the push-button switch is in said second OFF state and which is caused to remove said depressed state by a releasing operation.

16. A push-button switch as claimed in claim 5, further comprising a lock-and-reset mechanism which operates to hold said push button in a depressed state when the push-button switch is in said second OFF state and which is caused to remove said depressed state by a releasing operation.

17. A push-button switch controlling an ON or OFF state of the switch according to an increase of depression of a push button, said push-button switch comprising:

a push button;

a case for depressibly supporting said push button;

a first contact;

a second contact disposed in opposed relation with said first contact, wherein said push-button switch is shifted, in conjunction with a depression of said push button, from a first OFF state in which said first and second contacts are out of contact to an ON state in which said first and second contacts are in contact, and then shifted to a second OFF state in which said first and second contacts are again out of contact;

an operation section including said push button; and a contact section removably attached to said operation section, wherein said first and second contacts are disposed in said contact section to come into contact at the attachment of said contact section to said operation section, wherein at least one of said first and second contacts is separated from the other at the separation of said contact section from said operation section thereby shifting the switch to said first OFF state, and wherein the push-button switch is shifted from said ON state to said second OFF state by depressing said push button through said operation section.

18. A push-button switch as claimed in claim 17, wherein said first contact is a stationary contact fixed to said contact section and said second contact is a movable contact disposed to be brought into or out of contact with said first contact, and wherein said second contact is subject to an urging force acting in a direction to move said second contact away from said first contact.

19. A push-button switch as claimed in claim 17, wherein said operation section further comprises an operating shaft movable interlocked with said push button, wherein said contact section further comprises a movable contact unit interlocked with said operating shaft, and wherein said movable contact unit comprises an abutment portion abutting against said operating shaft or an operating member interlocked therewith, and a separating portion interlocked with said abutment portion for separating said first contact from said second contact when the push-button switch is shifted from said ON state to said second OFF state.

20. A push-button switch as claimed in claim 17, wherein said operation section further comprises an operating shaft movable interlocked with said push button, and a lock member having a slope engagable with a slope formed on said operating shaft and being slidable in a direction orthogonal to a direction of the movement of said operating shaft, wherein said contact section further comprises a movable contact unit interlocked with said operating shaft and a resilient stationary terminal with a contact, and wherein said movable contact unit further comprises a movable terminal contact disposed in contact with the contact of said stationary terminal, an urging member for urging the contact of said movable terminal away from the contact of said stationary terminal, an abutment portion abutting against said operating shaft or an operating member interlocked therewith, and a separating portion interlocked with said abutment portion for separating the contact of said stationary terminal from the contact of said movable terminal upon manipulation of said push button.

21. An operation device, comprising:

a hand-held body device having a grip portion;

a plurality of push-button switches according to claim 1, wherein said push-button switches are arranged on said grip portion of said hand-held device body; and an abutting member pivotally mounted to said device body, wherein said abutting member is pressed against the push buttons of said push-button switches, and wherein said abutting member is depressed to press down said push buttons at one time thereby simultaneously shifting the respective push-button switches to said ON state.

22. An operation device as claimed in claim 21, wherein said operation device is a teaching pendant for an industrial manipulating robot.

23. A teaching pendant, comprising:

a hand-held pedant body having a grip portion;

a push-button switch according to any one of claims 1–4 and 6–8 wherein said push-button switch is disposed at said grip portion of said hand-held pendant body; and a manipulating lever pivotally mounted to said pedant body, wherein said manipulating lever is pressable against the push button of said push-button switch, and wherein the push button of said push-button switch is depressed by gripping said manipulating lever thereby shifting the push-button switch to said ON state, thus enabling a teaching operation.

24. A teaching pendant, comprising:

a hand-held pedant body having a grip portion;

a push-button switch according to any one of claims 1–4 and 6–8, wherein said push-button switch is disposed at said grip portion of said hand-held pendant body;

an actuator shaft for manipulating said push button of said push-button switch, wherein said actuator shaft has a projected tip end;

a manipulating lever for pressing against said actuator shaft, wherein said manipulating lever is rotatably mounted to said pendant body, and wherein said actuator shaft and said push button are depressed by gripping said manipulating lever thereby shifting said push-button switch to said ON state enabling a teaching operation; and a tactile operation-touch generating mechanism for providing a tactile touch indicative of the operation of said push-button switch when said manipulating lever is gripped.

25. A teaching pendant, comprising:

a hand-held pedant body having a grip portion;

a push-button switch according to claim 5, wherein said push-button switch is disposed at said grip portion of said hand-held pendant body;

an actuator shaft for manipulating said push button of said push-button switch, wherein said actuator shaft has a projected tip end;

a manipulating lever for pressing against said actuator shaft, wherein said manipulating lever is rotatably mounted to said pendant body, and wherein said actuator shaft and said push button are depressed by gripping said manipulating lever thereby shifting said push-button switch to said ON state enabling a teaching operation; and a tactile operation-touch generating mechanism for providing a tactile touch indicative of the operation of said push-button switch when said manipulating lever is gripped.

26. A teaching pendant with the push-button switch as claimed in claim 24, wherein said tactile operation-touch generating mechanism further comprising:

a spring portion having spring characteristics and defined in said manipulating lever; and a cam-like projection provided on said pendant body, wherein a tip of said spring portion is caused to slide on a peripheral surface of said projection when the manipulating lever is gripped whereby said tactile operation-touch is provided.

27. A teaching pendant, comprising:

a hand-held pendant body having an operation face; and a push-button switch of any one of claims 17 though 20, wherein said operation section is disposed on said operation face of said hand-held pendant body, and wherein said push-button switch is shifted to said second OFF state for emergency stop by depressing said push button through manipulation of said operation section.

* * * * *

UNITED STATES PATENT AND TRADEMARK OFFICE

CERTIFICATE OF CORRECTION

PATENT NO. : 6,288,352 B1
DATED : September 11, 2001
INVENTOR(S) : Takao Fukui et al.

It is certified that error appears in the above-identified patent and that said Letters Patent is hereby corrected as shown below:

Title page,
Item "[73]", please correct the name of the assignee to read:
-- Idec Izumi Corporation, Osaka (JP) --.

Signed and Sealed this

Fourteenth Day of May, 2002

*Attest:*

*Attesting Officer*

JAMES E. ROGAN
*Director of the United States Patent and Trademark Office*